US011913460B2

(12) United States Patent
Davis

(10) Patent No.: US 11,913,460 B2
(45) Date of Patent: Feb. 27, 2024

(54) EXHAUST FAN

(71) Applicant: Greenheck Fan Corporation, Schofield, WI (US)

(72) Inventor: Daniel Davis, Weston, WI (US)

(73) Assignee: Greenheck Fan Corporation, Schofield, WI (US)

( * ) Notice: Subject to any disclaimer, the term of this patent is extended or adjusted under 35 U.S.C. 154(b) by 76 days.

(21) Appl. No.: 17/207,220

(22) Filed: Mar. 19, 2021

(65) Prior Publication Data

US 2021/0293245 A1 Sep. 23, 2021

Related U.S. Application Data

(60) Provisional application No. 62/992,827, filed on Mar. 20, 2020.

(51) Int. Cl.

| | |
|---|---|
| ***F04D 25/06*** | (2006.01) |
| ***F04D 29/44*** | (2006.01) |
| ***F04D 29/42*** | (2006.01) |
| ***F04D 29/28*** | (2006.01) |

(52) U.S. Cl.

CPC ..... *F04D 25/06* (2013.01); *F04D 25/0606* (2013.01); *F04D 29/283* (2013.01); *F04D 29/4226* (2013.01); *F04D 29/441* (2013.01)

(58) Field of Classification Search

CPC ..... F24F 13/20; F24F 2013/205; F04D 17/16; F04D 17/162; F04D 25/06; F04D 25/0606; F04D 25/08; F04D 25/12; F04D 29/441; F04D 29/283; F04D 29/281; F04D 29/4226; F04D 29/4233

See application file for complete search history.

(56) References Cited

U.S. PATENT DOCUMENTS

| | | | | |
|---|---|---|---|---|
| 2,394,214 A * | 2/1946 | Sprouse | ..... | F04D 29/283 416/187 |
| 6,168,378 B1 | 1/2001 | Craw et al. | | |
| 6,203,423 B1 | 3/2001 | Craw et al. | | |
| 6,261,175 B1 | 7/2001 | Larson et al. | | |

(Continued)

FOREIGN PATENT DOCUMENTS

| | | | | |
|---|---|---|---|---|
| EP | 1 094 224 A2 | 4/2001 | | |
| WO | WO-2014035649 A1 * | 3/2014 | ..... | F04D 25/14 |
| WO | 2017/033303 A1 | 3/2017 | | |

OTHER PUBLICATIONS

International Search Report and Written Opinion for Application No. PCT/US2021/023476 dated Jul. 5, 2021.

(Continued)

*Primary Examiner* — Kenneth J Hansen
(74) *Attorney, Agent, or Firm* — Merchant & Gould P.C.

(57) ABSTRACT

An exhaust fan assembly can include an outer housing, a fan housing mounted to the outer housing, a fan wheel and an electric motor operably coupled to the fan wheel, the fan wheel and electric motor being mounted within the fan housing, wherein the fan housing defines an open inlet side for accepting airflow in a direction generally parallel to a rotational axis of the fan wheel and an outlet for discharging airflow in a direction generally perpendicular to the rotational axis, wherein the fan housing defines a volute section with an outer perimeter having a continuously curved cross-sectional shape.

20 Claims, 46 Drawing Sheets

(56) References Cited

U.S. PATENT DOCUMENTS 6,488,579 B2 12/2002 Larson et al.
6,802,770 B2 10/2004 Larson et al.
6,830,065 B2 12/2004 Sinur et al.
D510,432 S 10/2005 Bargiel
D510,996 S 10/2005 Madika
D511,379 S 11/2005 Penlesky et al.
D512,503 S 12/2005 Roland
6,979,169 B2 12/2005 Penlesky et al.
D514,221 S 1/2006 Vladika
6,991,533 B2 1/2006 Tsai et al.
D530,808 S 10/2006 Sinur et al.
D531,301 S 10/2006 Sinur et al.
7,126,818 B2 10/2006 Lu et al.
7,128,303 B2 10/2006 Penlesky et al.
D533,956 S 12/2006 Vladika
D534,301 S 12/2006 Roland
D535,431 S 1/2007 Roland
7,175,309 B2 2/2007 Craw et al.
7,203,416 B2 4/2007 Craw et al.
7,362,021 B2 4/2008 Huang et al.
7,455,432 B2 11/2008 Craw et al.
7,455,500 B2 11/2008 Penlesky et al.
7,455,583 B2 11/2008 Taya
7,469,486 B2 12/2008 Tamura et al.
7,594,539 B2 9/2009 Isaka
7,654,495 B2 2/2010 Adrian et al.
7,690,583 B2 4/2010 Cherewatti et al.
7,896,319 B2 3/2011 Fujii et al.
7,984,859 B2 12/2011 Goodwin et al.
8,070,138 B2 12/2011 Saitou et al.
8,132,795 B2 3/2012 Hayasi et al.
8,186,656 B2 5/2012 Fujii et al.
8,240,997 B2 8/2012 Shirahama et al.
8,327,473 B2 12/2012 Matsubara et al.
8,360,719 B2 1/2013 Huang et al.
8,373,539 B2 2/2013 Ueki et al.
8,382,332 B2 2/2013 Zakula et al.
D679,046 S 3/2013 Hoshino et al.
D681,794 S 5/2013 Lin et al.
8,434,916 B2 5/2013 Craw et al.
8,485,696 B2 7/2013 Pringle et al.
8,503,178 B2 8/2013 Chen et al.
8,539,788 B2 9/2013 Katsumi et al.
8,602,398 B2 12/2013 Hayasi et al.
8,653,763 B2 2/2014 Lin et al.
8,690,529 B2 4/2014 Tanaka et al.
8,696,419 B2 4/2014 Liang et al.
D706,916 S 6/2014 Penlesky et al.
8,770,774 B2 7/2014 Ye et al.
8,967,832 B2 3/2015 Zakula et al.
2001/0049260 A1 12/2001 Larson et al.
2003/0131891 A1 7/2003 Sinur et al.
2003/0134588 A1 7/2003 Larson et al.
2004/0123978 A1* 7/2004 Hashimoto ..... F04D 29/4213 257/E23.099
2004/0207983 A1 10/2004 Lu et al.
2005/0012416 A1 1/2005 Huang et al.
2005/0111840 A1 5/2005 Craw et al.
2005/0111972 A1 5/2005 Penlesky et al.
2005/0117341 A1 6/2005 Craw et al.
2005/0218289 A1 10/2005 Penlesky et al.
2006/0034686 A1* 2/2006 Smiley ..... F04D 29/4226 415/204
2006/0073008 A1 4/2006 Penlesky et al.
2006/0250799 A1 11/2006 Sinur et al.
2007/0040091 A1 2/2007 Penlesky et al.
2007/0074725 A1 4/2007 Taya
2007/0201236 A1 8/2007 Craw et al.
2008/0011928 A1 1/2008 Adrian et al.
2008/0127403 A1 6/2008 Tantorno et al.
2008/0157410 A1 7/2008 Fujii et al.
2009/0049597 A1 2/2009 Saitou et al.
2009/0056009 A1 3/2009 Matsubara et al.
2009/0073702 A1 3/2009 Craw et al.
2009/0170421 A1 7/2009 Adrian et al.
2009/0188027 A1 7/2009 Katsumi et al.
2009/0275280 A1 11/2009 Liang et al.
2010/0024106 A1 2/2010 Katsumi et al.
2010/0024117 A1 2/2010 Fujii et al.
2010/0024118 A1 2/2010 Hayasi et al.
2010/0143125 A1 6/2010 Vogel et al.
2010/0248612 A1 9/2010 Tsubouchi et al.
2010/0322762 A1 12/2010 Shirahama et al.
2011/0100043 A1 5/2011 Matubara et al.
2011/0250060 A1* 10/2011 Tanaka ..... F04D 29/4226 415/204
2012/0052792 A1 3/2012 Sinur et al.
2012/0083198 A1 4/2012 Sinur et al.
2012/0087128 A1 4/2012 Zakula et al.
2012/0087132 A1 4/2012 Zakula et al.
2012/0087138 A1 4/2012 Pringle et al.
2012/0131743 A1 5/2012 Hayasi et al.
2012/0152778 A1 6/2012 Lin et al.
2013/0004299 A1 1/2013 Weng et al.
2013/0088855 A1 4/2013 Ye et al.
2013/0128575 A1 5/2013 Zakula et al.
2013/0130612 A1 5/2013 Penlesky et al.
2013/0143479 A1 6/2013 Weng et al.
2013/0203336 A1 8/2013 Karst et al.
2013/0272002 A1 10/2013 Craw et al.
2014/0063796 A1 3/2014 Zakula et al.
2014/0065940 A1 3/2014 Penlesky et al.
2014/0065945 A1 3/2014 Zakula et al.
2014/0078718 A1 3/2014 Li et al.
2014/0116414 A1 5/2014 Sinur et al.
2014/0356149 A1 12/2014 Chang et al.
2015/0003966 A1* 1/2015 Duquette ..... F04D 25/08 415/206
2015/0038070 A1 2/2015 Zakula et al.
2015/0044076 A1 2/2015 Huang et al.
2015/0204337 A1* 7/2015 Pihet ..... F04D 29/4226 415/206
2015/0219118 A1* 8/2015 Zakula ..... F04D 17/16 29/888.024
2016/0123337 A1 5/2016 Liang et al.
2017/0254339 A1* 9/2017 Orangi ..... F04D 29/30
2018/0023588 A1* 1/2018 Van Der Kooi ..... F04D 29/283 415/203
2021/0388847 A1* 12/2021 Hayashi ..... F24F 7/007

OTHER PUBLICATIONS

WhisperCeiling Ventilation Fan, FV-08VQ5, Panasonic Home and Environment Company, 1 page (Publicly known at east as early as 2015).
WhisperCeiling Ventilation Fan, FV-11VQ5, Panasonic Home & Environment, 1 page (Publicly known at least as early as 2015).
WhisperGreenSelect Ventilation Fan, FV-11-15VK1, Panasonic Eco Solutions Company of North America, 2 pages (Publicly known at least as early as 2015).
WhisperGreenSelect Ventilation Fan, VF-05-11VK1, Panasonic Eco Solutions Company of North America, 2 pages (Publicly known at least as early as 2015).

* cited by examiner

EXHAUST FAN

RELATED APPLICATION

This application claims priority to U.S. Provisional Patent Application Ser. No. 62/992,827, filed on Mar. 30, 2020, incorporated by reference herein.

TECHNICAL FIELD

Embodiments are in the field of air movement devices, for example exhaust fans, including system design, manufacturing methods, and delivery methods.

BACKGROUND

Exhaust fans are frequently used in commercial, institutional, residential, and industrial applications to remove area from a space. In some applications, relatively small exhaust fans are configured to be mounted in a wall or ceiling wherein the height, width, and depth can be constrained by the studs or other structure of the wall or ceiling. In such circumstances, the fan and motor are typically directly beneath a grille concealing the fan such that sound from the fan and motor are generally transmitted into the space from which air is being exhausted. Fans of this type also have a generally low efficiency rating. Accordingly, improvements in fan performance and the reduction of sound levels, are desired.

SUMMARY

Air movement devices and methods for their manufacture and delivery are disclosed. In one example, an exhaust fan assembly can include an outer housing, a fan housing mounted to the outer housing, a fan wheel and an electric motor operably coupled to the fan wheel, the fan wheel and electric motor being mounted within the fan housing, wherein the fan housing defines an open inlet side for accepting airflow in a direction generally parallel to a rotational axis of the fan wheel and an outlet for discharging airflow in a direction generally perpendicular to the rotational axis, wherein the fan housing defines a volute section with an outer perimeter having a continuously curved cross-sectional shape.

In some examples, the outer perimeter of the volute portion has a generally constant radius.

In some examples, the volute has a first width and the radius is about one half of the first width.

In some examples, the fan housing outlet defines an outlet collar portion.

In some examples, a distal end of the outlet collar portion has an elliptical shape.

In some examples, a backdraft damper is mounted within the outlet collar portion.

In some examples, the backdraft damper has an outer perimeter with an elliptical shape.

In some examples, the outer frame has a width of no greater than 4 inches.

In some examples, the volute section proximate the outlet has an outer perimeter having an oblong or race track shape.

In some examples, the volute section has a continuously curved tongue portion.

In some examples, the motor is directly mounted to a back wall portion of the fan housing oppositely located from the open inlet side.

In some examples, the fan wheel includes a fan blade portion and central portion, wherein the central portion is mounted to a shaft of the motor, wherein the fan wheel further includes a plurality of radially extending arm portions connecting the central portion to the fan blade portion.

In some examples, the exhaust fan assembly further includes an inlet Venturi part mounted to the open inlet side of the fan housing, wherein the inlet Venturi part defines an annulus with an unobstructed central opening.

In some examples, the exhaust fan assembly further includes a grill mounted to the outer housing.

An exhaust fan assembly can include a fan housing including a first half-piece joined to a second half-piece and a fan wheel and an electric motor operably coupled to the fan wheel, the fan wheel and electric motor being mounted within the fan housing, wherein the fan housing defines an open inlet side for accepting airflow in a direction generally parallel to a rotational axis of the fan wheel and an outlet for discharging airflow in a direction generally perpendicular to the rotational axis.

In some examples, the first half-piece is joined to the second half-piece by a snap-fit connection.

In some examples, the first half-piece includes an integrally formed Venturi-shaped portion that forms the open inlet side.

In some examples, the first and second half-pieces are joined together at a tongue and groove interface.

In some examples, the fan wheel defines an inlet air flow region and wherein the electric motor is outside of the inlet air flow region.

In some examples, the fan wheel includes a plurality of fan blades, each of which includes a leading edge presented at an angle of attack relative to a travel path of the fan blades of no more than 50 degrees.

In some examples, the fan blades have an airfoil-type shape.

In some examples, the fan housing defines a volute section with an outer perimeter having a continuously curved cross-sectional shape.

In some examples, the cross-sectional shape includes more than one radius of curvature.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The foregoing summary, as well as the following detailed description, will be better understood when read in conjunction with the appended drawings. For the purpose of illustration only, there is shown in the drawings certain embodiments. It's understood, however, that the inventive concepts disclosed herein are not limited to the precise arrangements and instrumentalities shown in the figures.

FIG. 86 is an enlarged cross-sectional side view showing a portion of the view shown in FIG. 85.

FIG. 87 is a cross-sectional side view of a portion of the exhaust fan assembly shown in FIG. 66.

DETAILED DESCRIPTION

Figure 1:
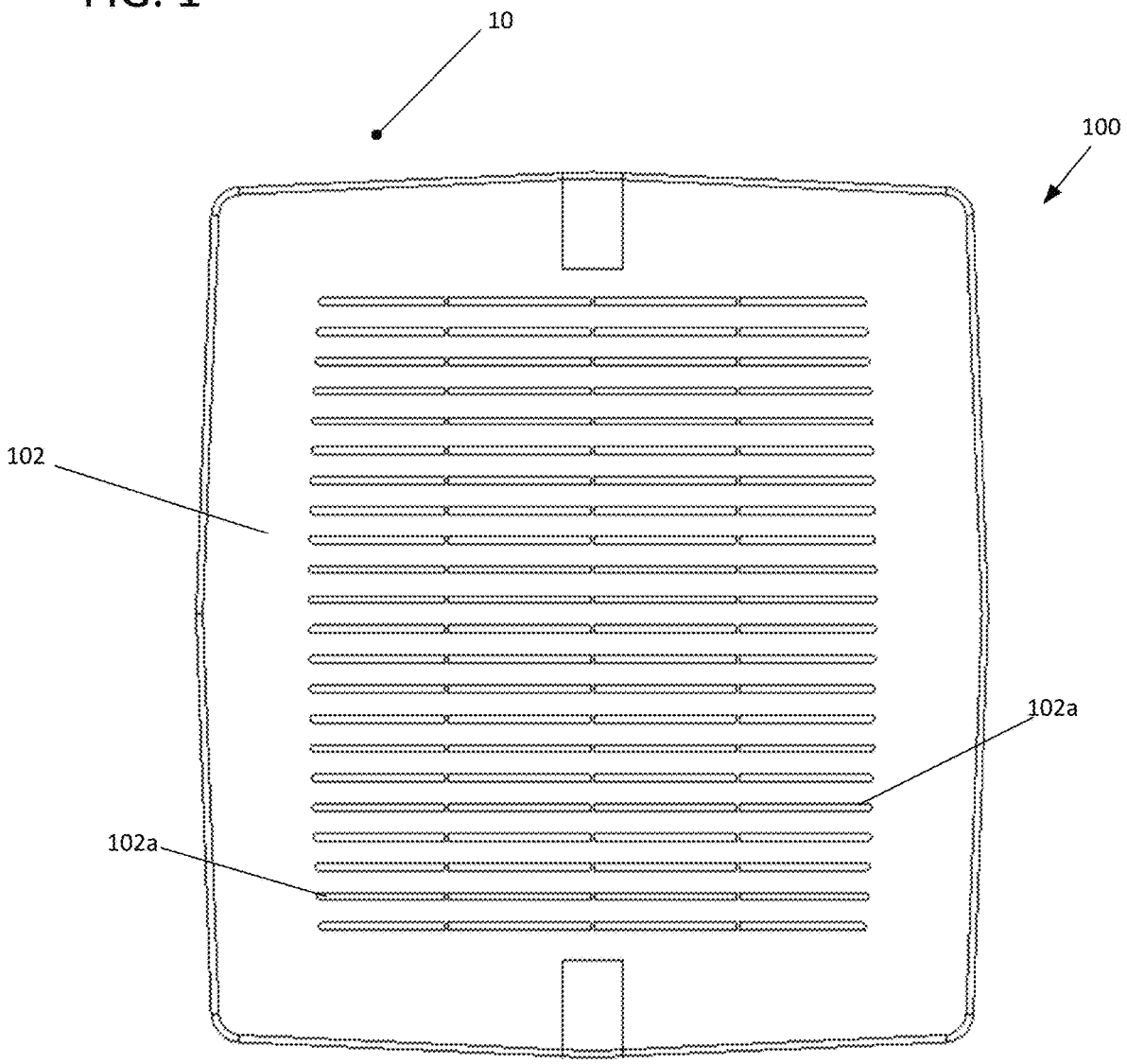
FIG. 1 is a front view of an exhaust fan assembly having features in accordance with the present invention, wherein the fan assembly is mounted within a wall or ceiling and covered with a grill.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Figure 1A:
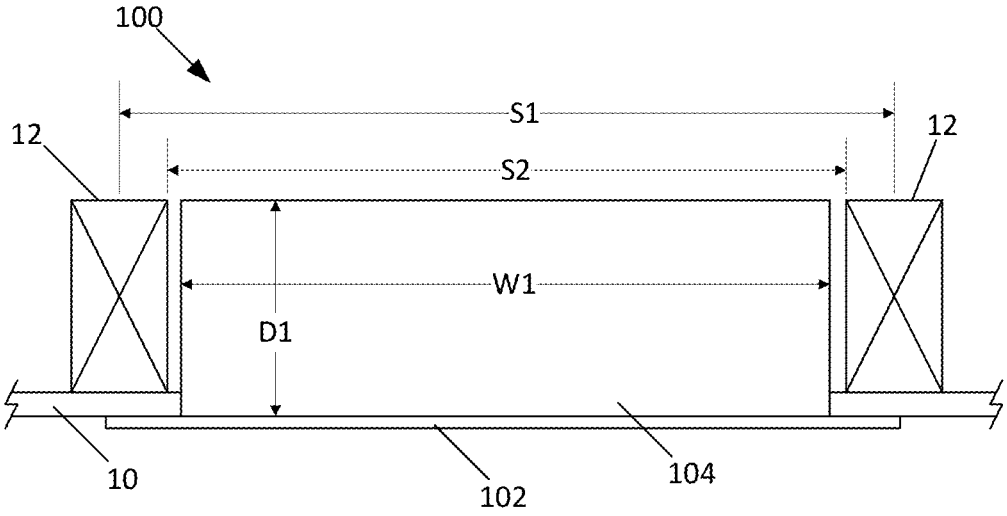
FIG. 1A is a schematic cross-sectional view of the exhaust fan assembly of FIG. 1, wherein the fan assembly is mounted within a wall or ceiling and covered with a grill.
Figure 2:
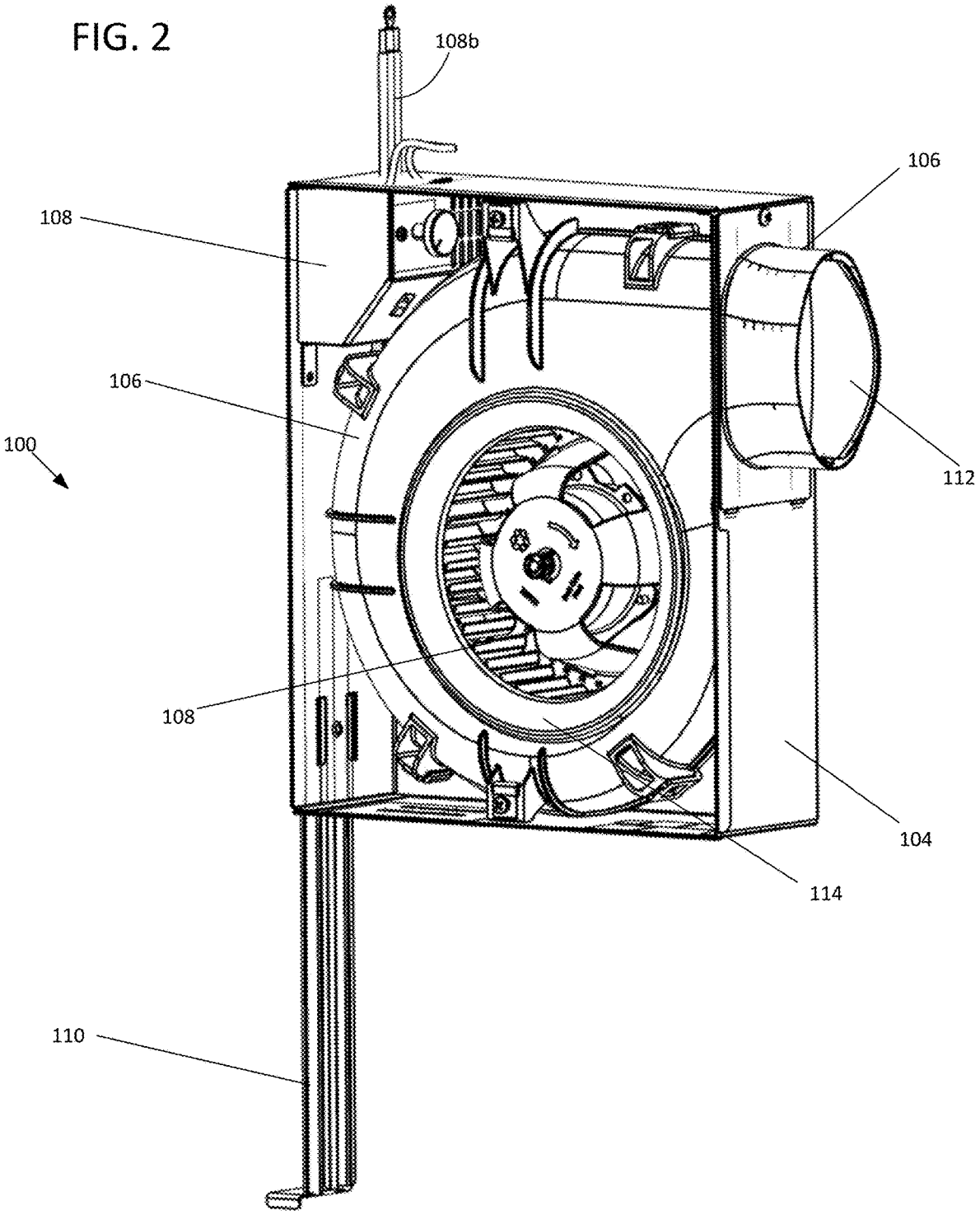
FIG. 2 is a perspective view of the exhaust fan assembly shown in FIG. 1, with the grill removed.
Figure 3:
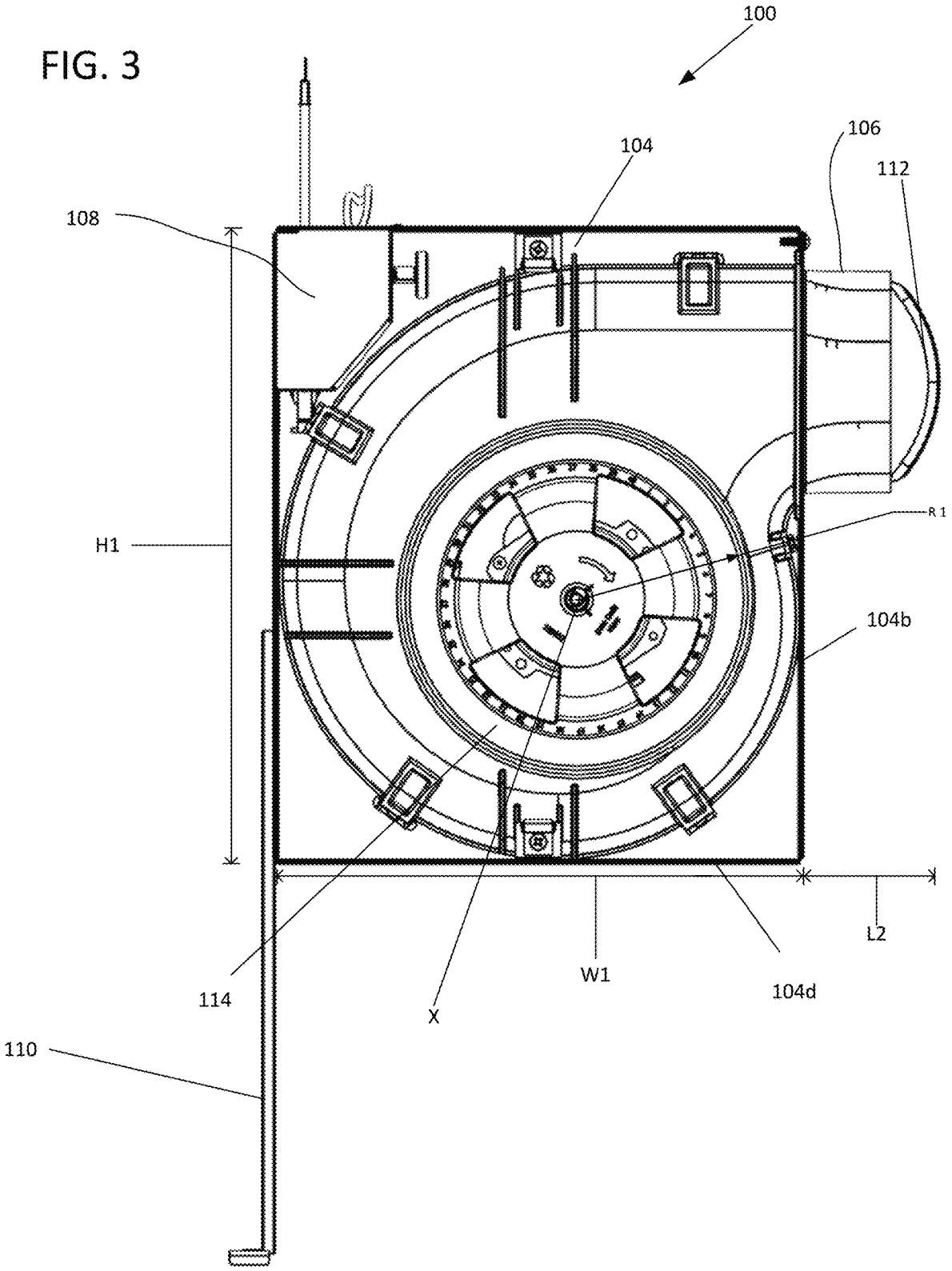
FIG. 3 is a front view of the exhaust fan assembly shown in FIG. 2.
Figure 4:
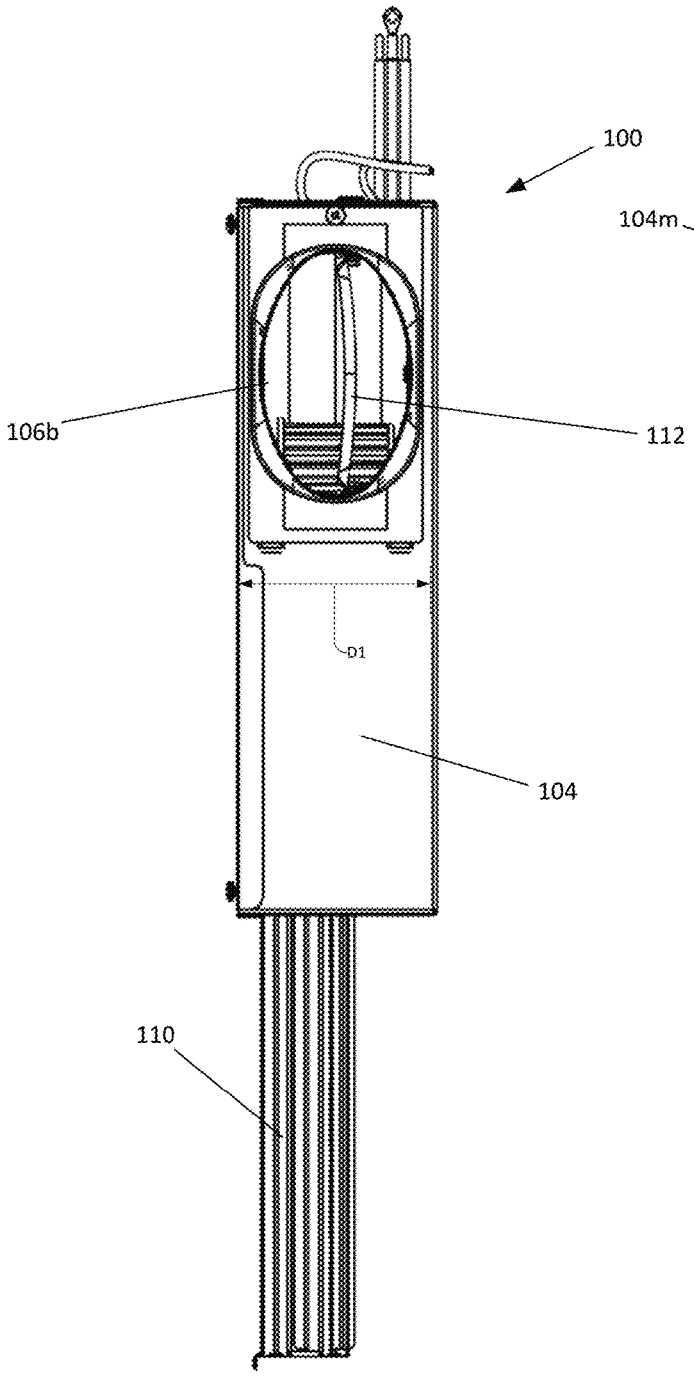
FIG. 4 is a first side view of the exhaust fan assembly shown in FIG. 2.
Figure 5:
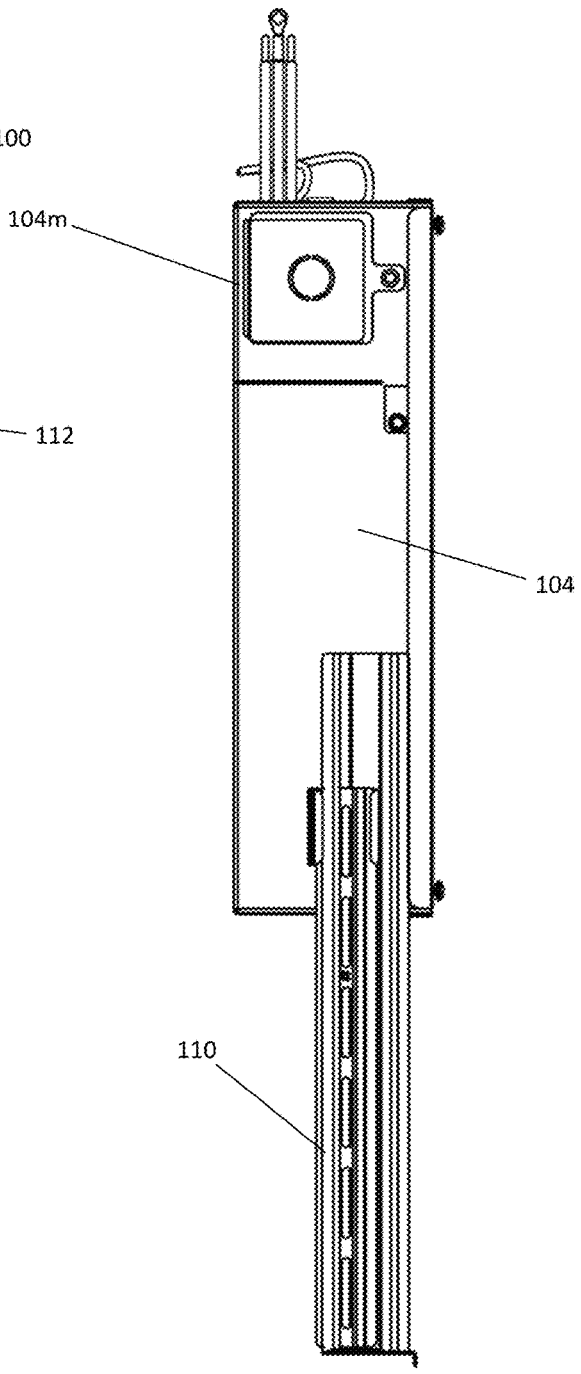
FIG. 5 is a second side view of the exhaust fan assembly shown in FIG. 2.

Referring to FIGS. 1 to 6, an exhaust fan 100 is disclosed. In FIGS. 1 and 1A, the exhaust fan 100 is schematically shown as being mounted in a wall or ceiling 10 and arranged such that a grill 102 of the exhaust fan 100 is the only viewable part of the exhaust fan 100 from within a space from which the exhaust fan 100 is exhausting air. The grill 102 includes a plurality of slots 102*a* which allow air to flow upwards through the exhaust fan 100. FIG. 1A shows a side view of the exhaust fan 100 mounted between two standard 2×4 studs spaced apart at a spacing distance S1, which results in an opening distance S2 between the studs. In one example, the spacing distance S1 is about 16 inches and the opening distance S2 is about 14½ inch. As presented, the exhaust fan 100 is further provided with a housing 104, an outlet collar 106, an electrical junction box assembly 108, a mounting bar 110, a backdraft damper 112, and a fan assembly 150, each of which is discussed in further detail below.

Figure 8:
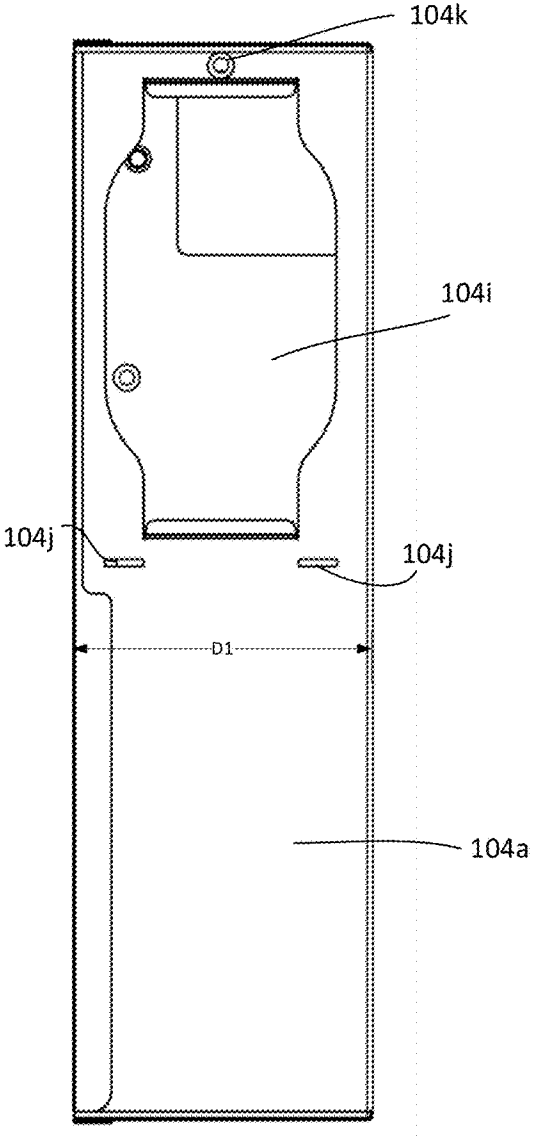
FIG. 8 is a side view of the housing shown in FIG. 7.

The exhaust fan 100 includes a main housing 104 for retaining the components of the exhaust fan 100 and that interconnects with the grill 102, for example via spring clips. The outer housing 104 is shown at FIGS. 2 to 5 with the internal components present, in the exploded view at FIG. 6, and in isolation at FIGS. 7 and 8. As shown, the main housing 104 is defined by an end wall 104*a* from which sidewalls 104*b*, 104*c*, 104*d*, 104*e* extend to define an interior volume 104*f*. In one aspect, the main housing 104 has a height H1, defined by sidewalls 104*b*, 104*d*, a width W1, defined by sidewalls 104*c*, 104*e*, and a depth D1, defined each of the sidewalls 104*b*-104*e*. In one example, the height H1 is about 13⅞ inch, width W1 is about 11½ inch, and depth D1 is about 3⅞ inch. In one aspect, the height H1 is less than the opening distance S2, thereby allowing the exhaust fan 100 to be mounted between adjacent studs in a stud-type wall. In one aspect, the depth D1 is equal to or less than the combined height of the studs 12 and the gypsum board, or other material, that forms the wall or ceiling 10, such that the exhaust fan 100 can be mounted within an interior wall having gypsum board, or other material, on both sides of the studs 12.

In one aspect of the housing 104, the end wall 104*a* includes a plurality of mounting locations 104*h*, for example threaded bosses, for receiving fasteners enabling a fan assembly 150 of the exhaust fan 100 to be mounted to the end wall 104*a* and within the interior volume 104*g*. In the example shown, three mounting locations 104*h*.

In one aspect of the housing 104, the sidewall 104*b* defines an opening 104*i* for allowing air from the fan assembly 150 to be directed through the housing 104. An outlet of the fan assembly 150 abuts the opening 104*i* on the interior side, while the outlet collar 106 covers the opening 104*i* on the exterior side of the housing 104. A pair of slots 104*j* and an opening 104*k*, for example a threaded opening 104*i*, are provided to interconnect with corresponding features on the outlet collar 106 such that the outlet collar 106 can be secured to the exterior side of the end wall 104*a*.

In one aspect of the housing 104, the sidewall 104*c* defines an opening 104*m* for enabling access to an electrical socket or plug of the electrical junction box assembly 108 such that electrical power can be provided to the junction box assembly 108. Openings 104*n* are also provided in sidewall 104*d* for securing the junction box assembly 108 within the interior volume 104*f* of the housing 104. The sidewall 104*c* further defines an attachment structure 104*o* that allows the extendable mounting bar 110 to be slidably mounted to the housing 104. The mounting bar 110 has an adjustable length and is configured to be secured to a stud 12 with the side wall 104*c* being secured to an adjacent stud 12, for example via apertures 104*p*.

With reference to FIGS. 9 to 14, the outlet collar 106, having a length 12 of about 2 inch, is shown in further detail. As shown, the outlet collar 106 is formed with an end wall 106*a* defining an opening 106*b* having the same general shapes as the outlet of the fan assembly 150. A sidewall 106*c* extends from the end wall 106*a* and surrounds the opening 106*b* to form a collar. In one aspect, the sidewall 106*c* transitions from the shape of the opening 106*b*, which can be characterized as an obround or racetrack type shape, to a generally oval shape at a distal end 106*d* of the sidewall 106*c*. In contrast to prior art exhaust fan housing outlets, which are typically rectangular, the rounded shape of the opening 106*b*, enabled by the non-rectangular opening 104*i* in the housing 104, enables the exhaust fan 100 to operate more efficiently and with less sound output. In one aspect, the sidewall 106*c* is shaped such that a duct, for example, a flexible duct, can be slid over and attached to the sidewall 106*c*. The sidewall 106*c* is further provided with a pair of oppositely arranged apertures 106*e* and stop members 106*f*, 106*g* for interconnecting with the backdraft damper 112. The outlet collar 106 is further shown as having a pair of tabs 106*h* and an aperture 106*i* located in the end wall 106*a*. When the outlet collar 106 is mounted to the housing 104, the tabs 106*h* are received into the slots 104*j* and a fastener 107, such as a screw, extends through the aperture 106*i* and threads into the opening 104*k* to secure the outlet collar 106 to the housing 104. In examples, the outlet collar 106 can be formed as a single component, wherein the above-described features are integrally formed into the outlet collar 106.

Figure 15:
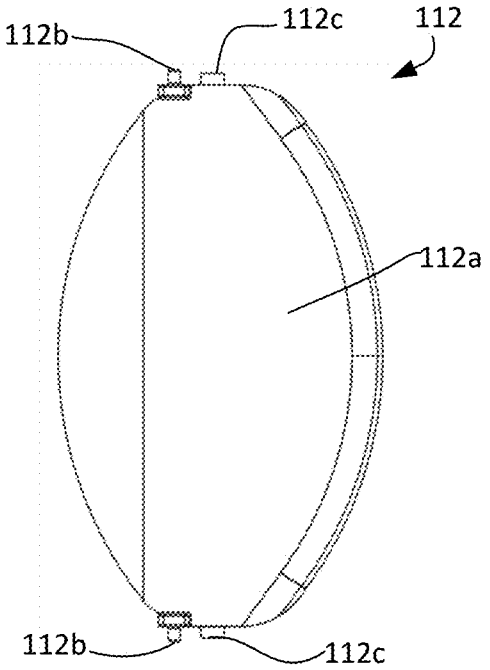
FIG. 15 is a front view of a damper of the exhaust fan assembly shown in FIG. 2.
Figure 16:
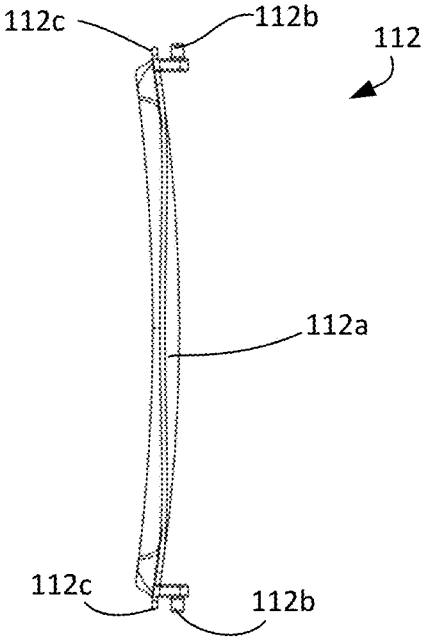
FIG. 16 is a side view of the damper shown in FIG. 15.
Figure 17:
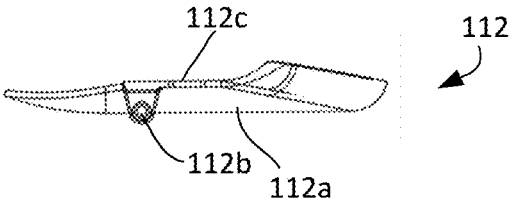
FIG. 17 is a top view of the damper shown in FIG. 15.
Figure 18:
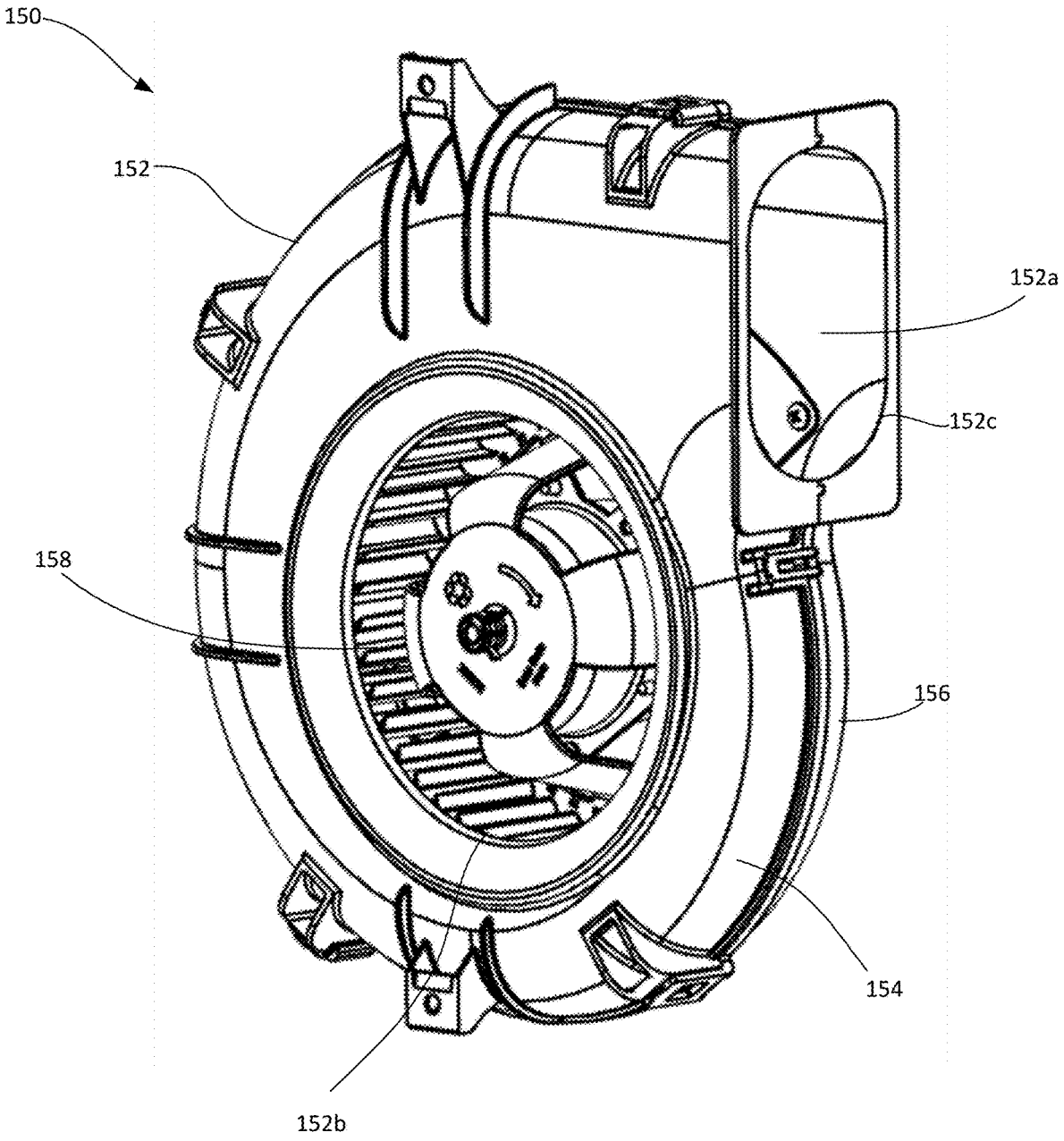
FIG. 18 is a first perspective view of a fan assembly of the exhaust fan assembly shown in FIG. 2.
Figure 19:
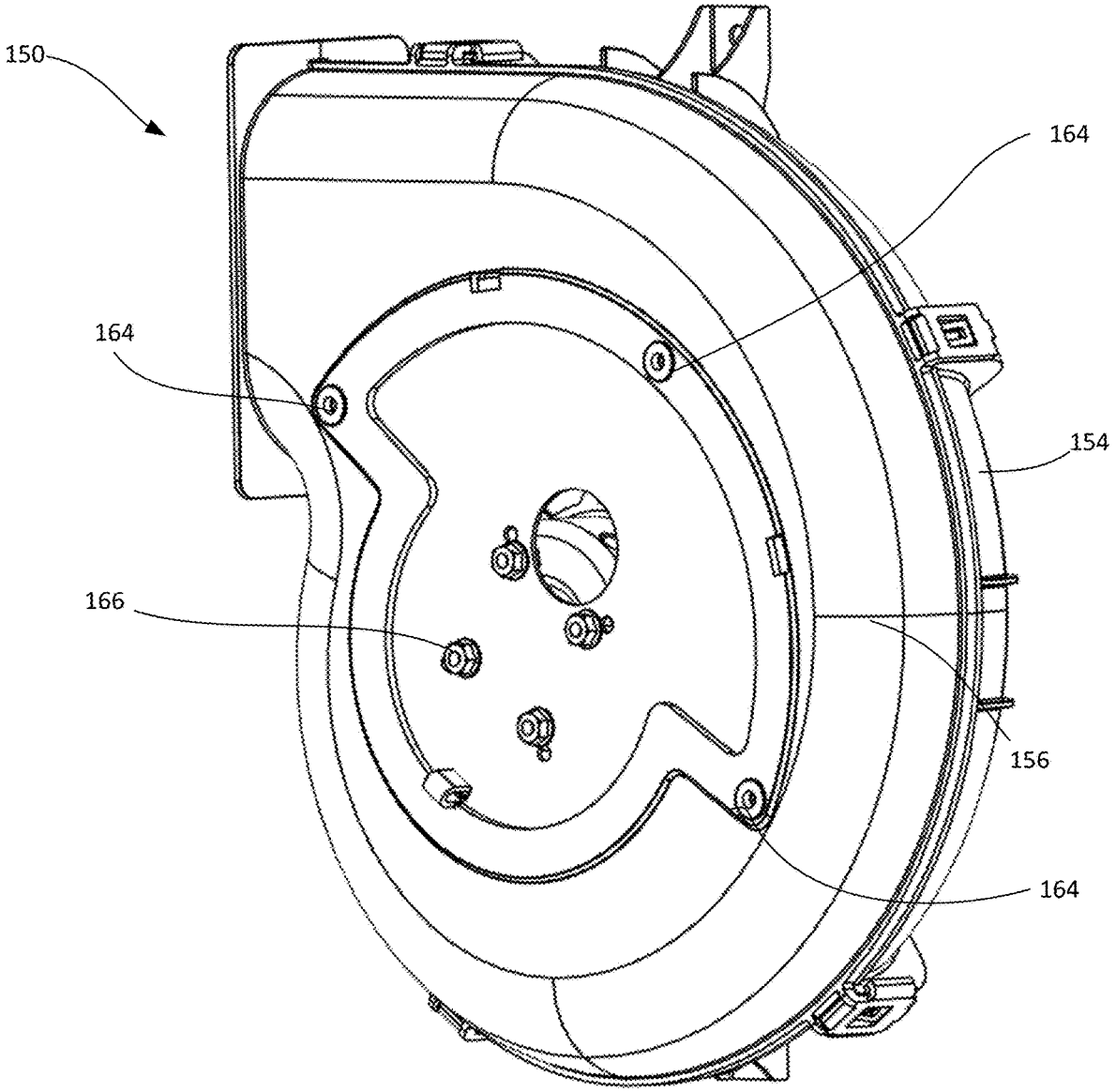
FIG. 19 is a second perspective view of the fan assembly shown in FIG. 18.
Figure 20:
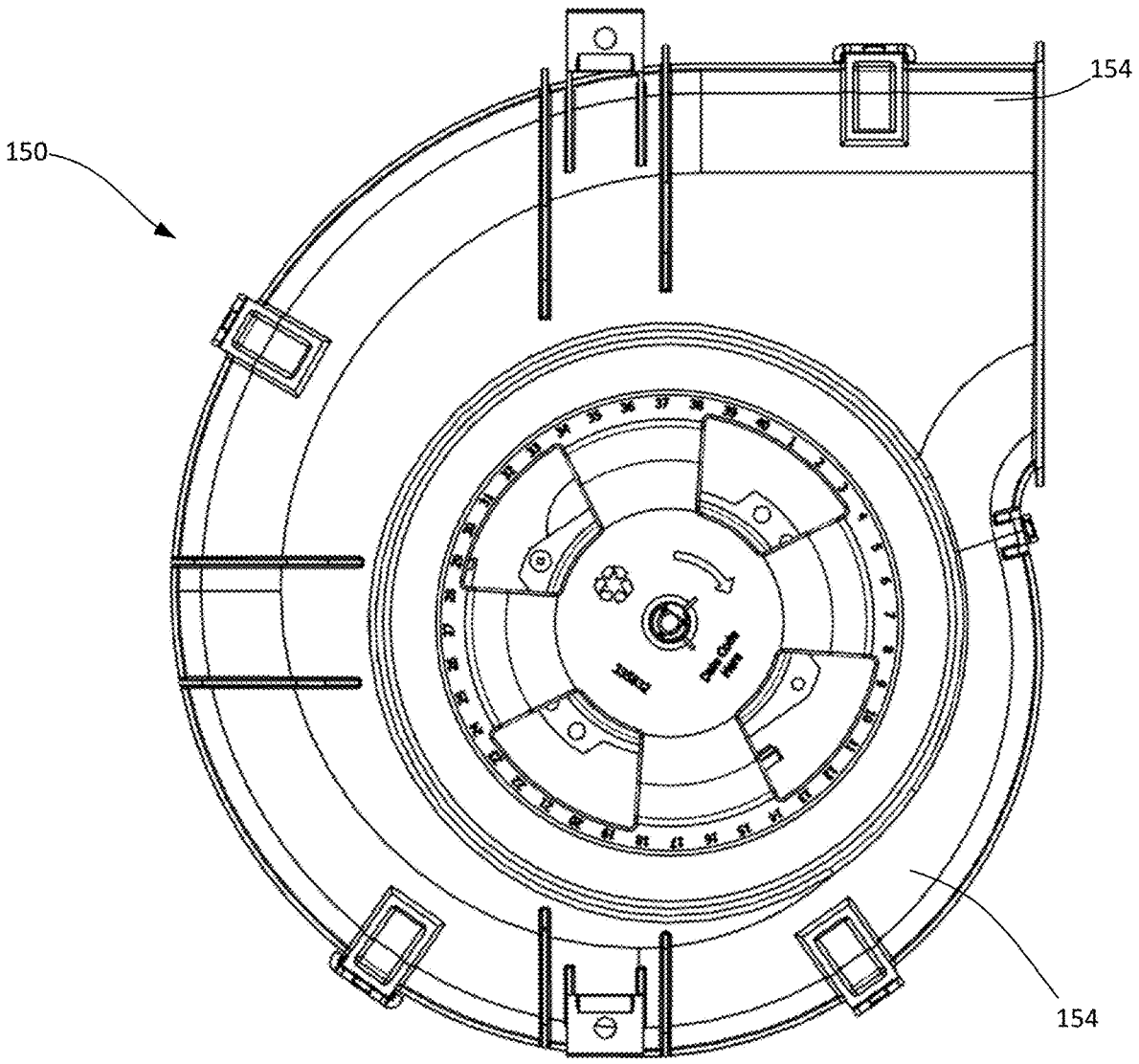
FIG. 20 is a front view of the fan assembly shown in FIG. 18.
Figure 21:
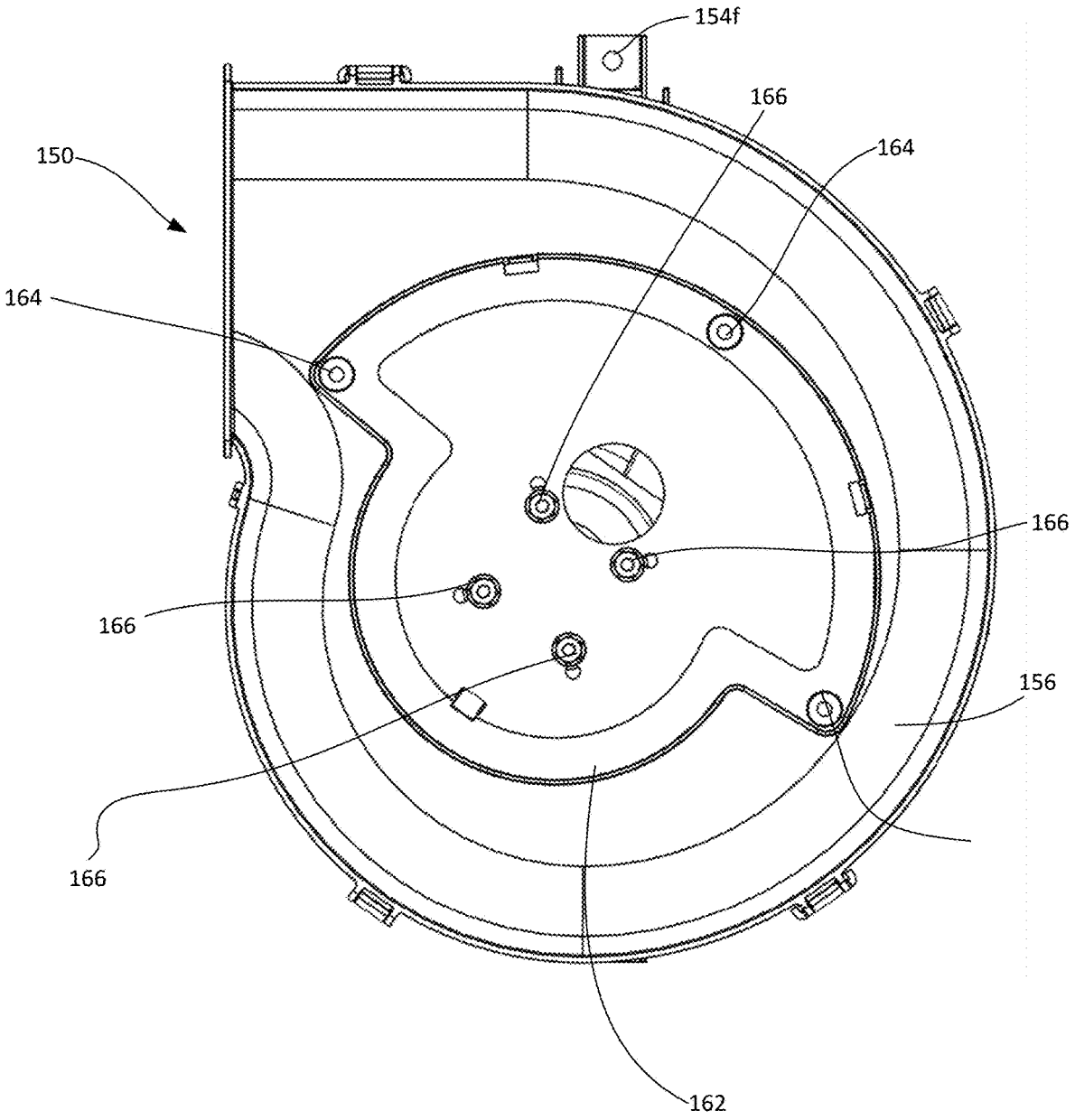
FIG. 21 is a rear view of the fan assembly shown in FIG. 18.
Figure 22:
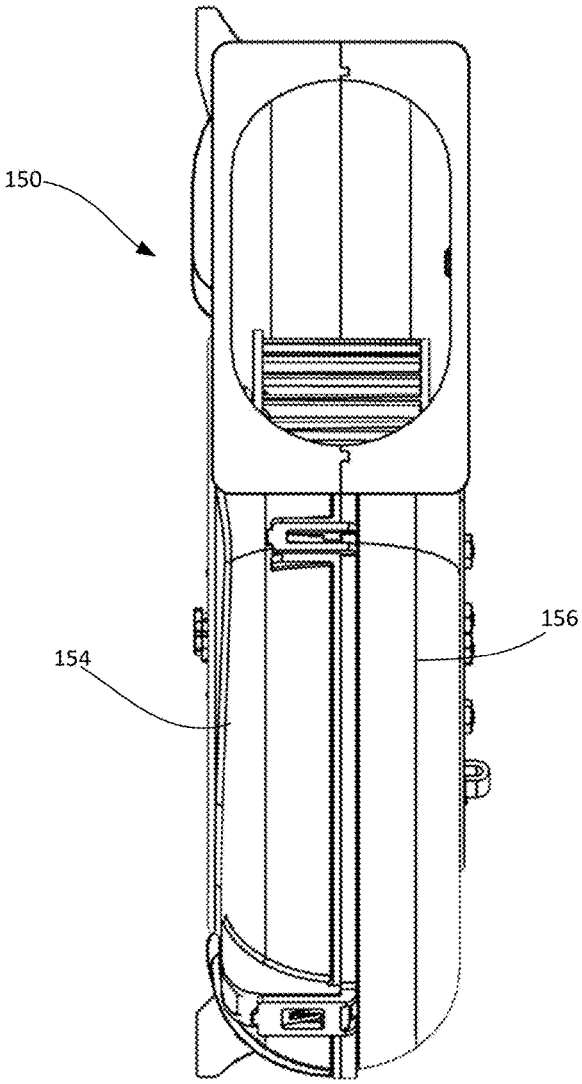
FIG. 22 is a first side view of the fan assembly shown in FIG. 18.
Figure 23:
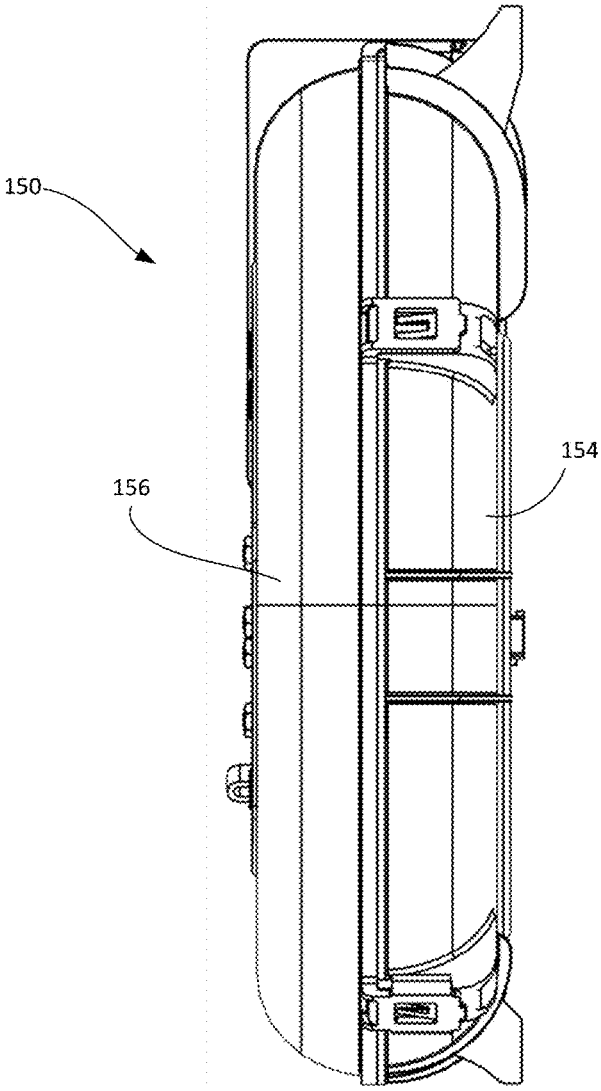
FIG. 23 is a second side view of the fan assembly shown in FIG. 18.
Figure 24:
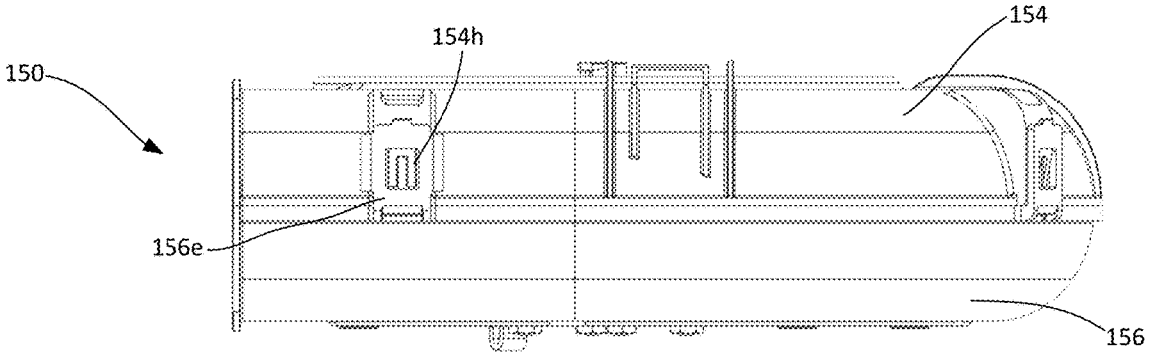
FIG. 24 is a third side view of the fan assembly shown in FIG. 18.
Figure 25:
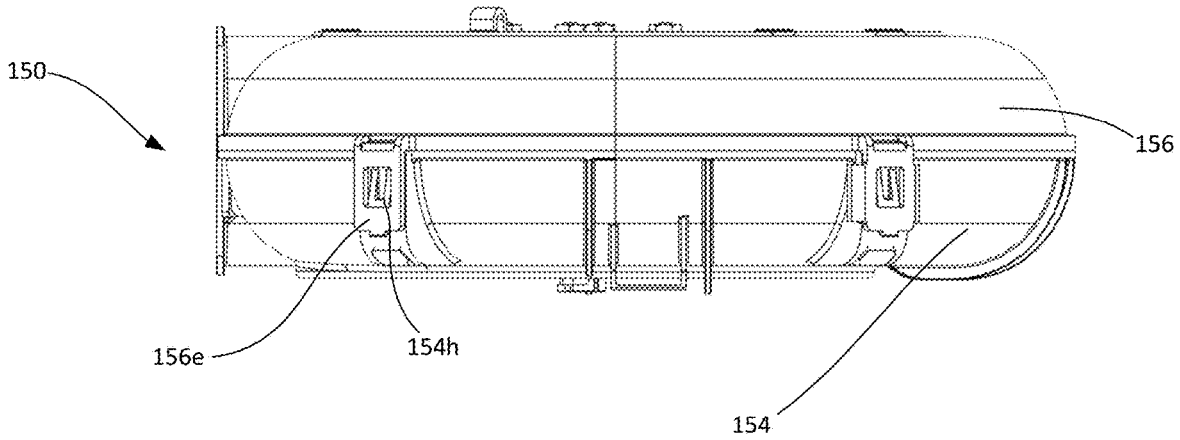
FIG. 25 is a fourth side view of the fan assembly shown in FIG. 18.
Figure 26:
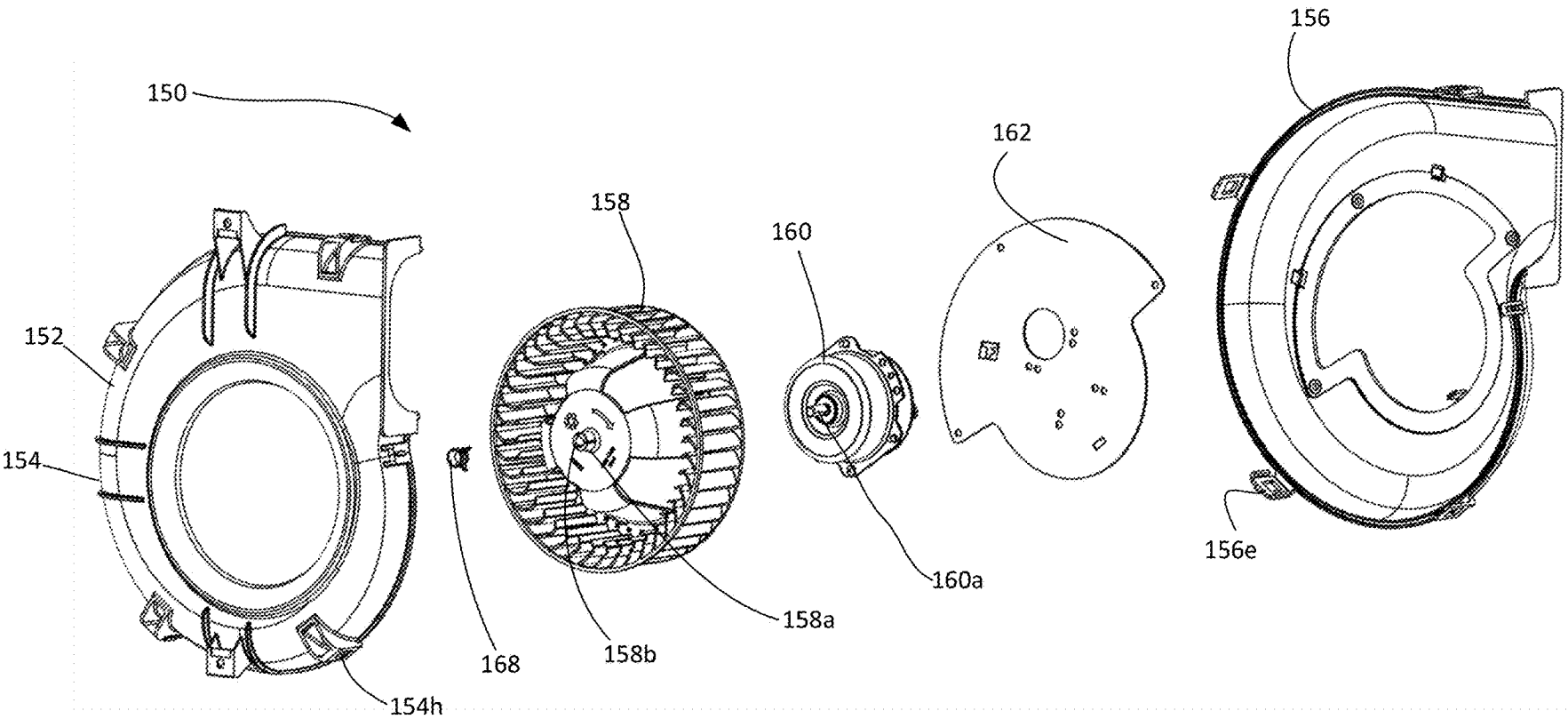
FIG. 26 is a perspective exploded view of the fan assembly shown in FIG. 18.
Figure 27:
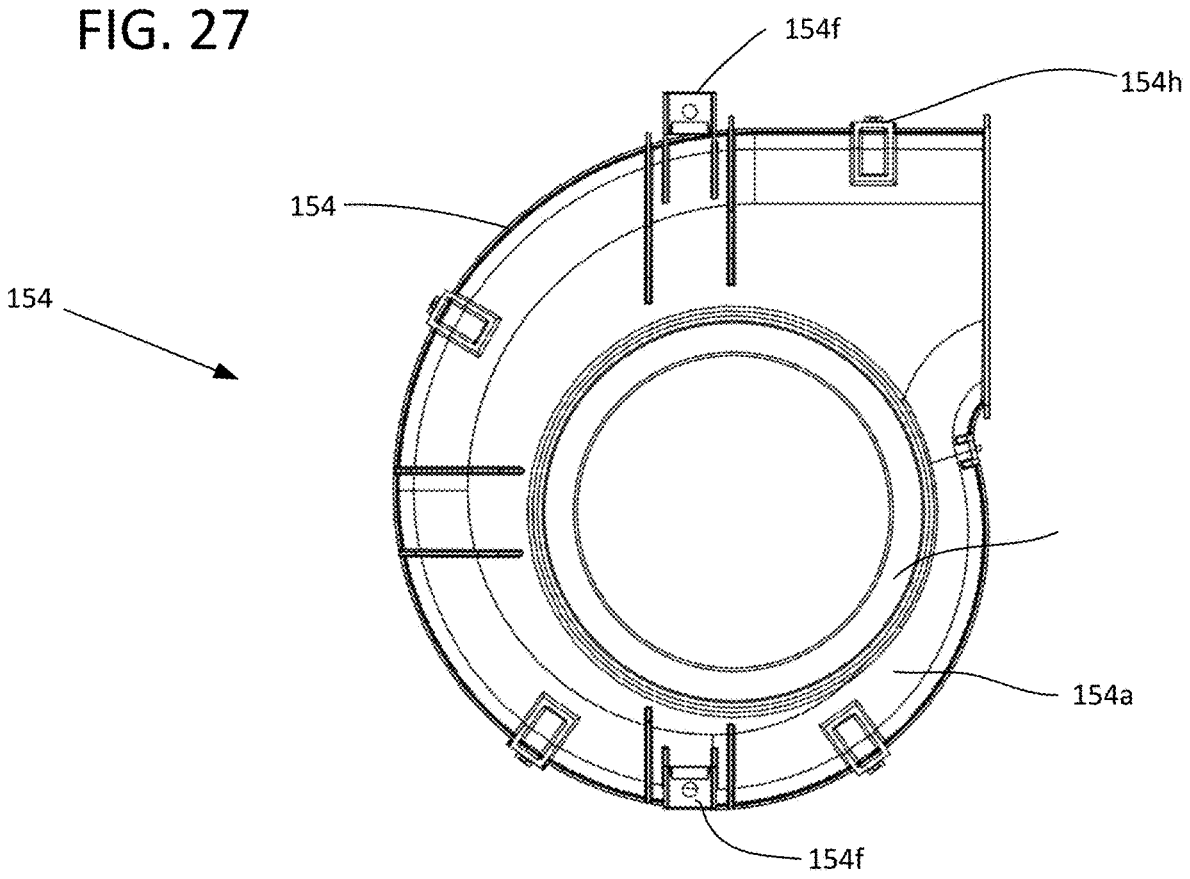
FIG. 27 is a front view of a first housing part of the fan assembly shown in FIG. 18.
Figure 28:
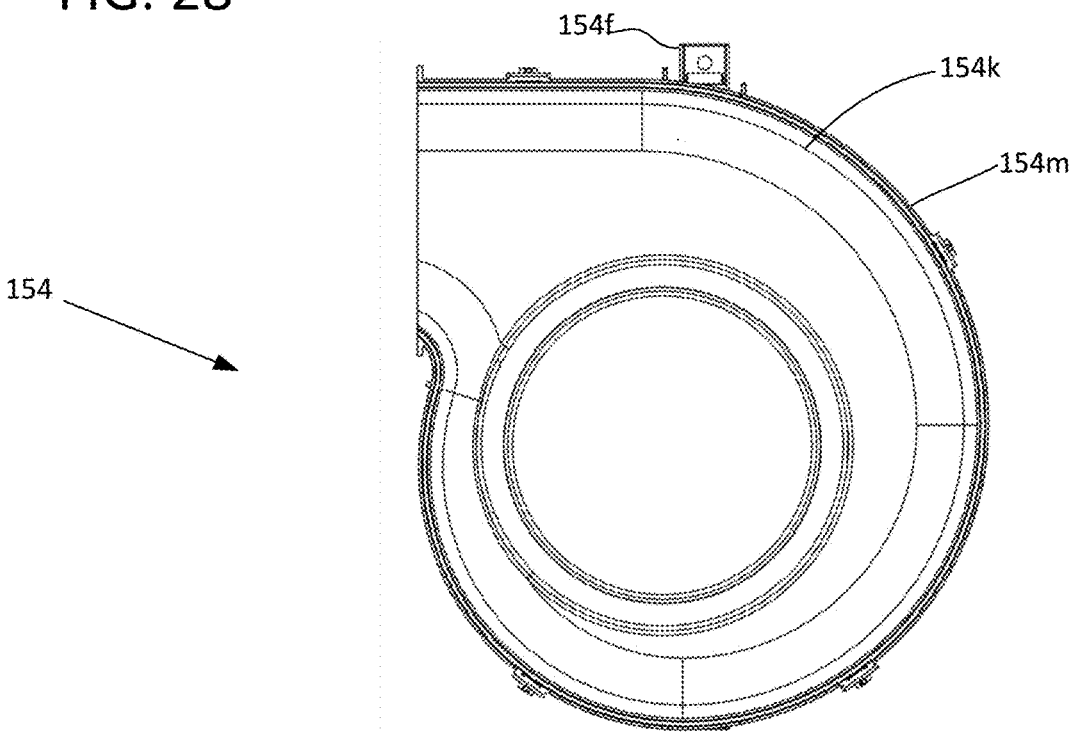
FIG. 28 is a rear view of the first housing part shown in FIG. 27.
Figure 29:
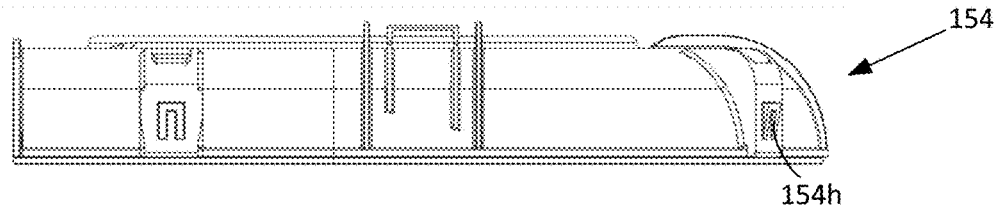
FIG. 29 is a first side view of the first housing part shown in FIG. 27.
Figure 30:
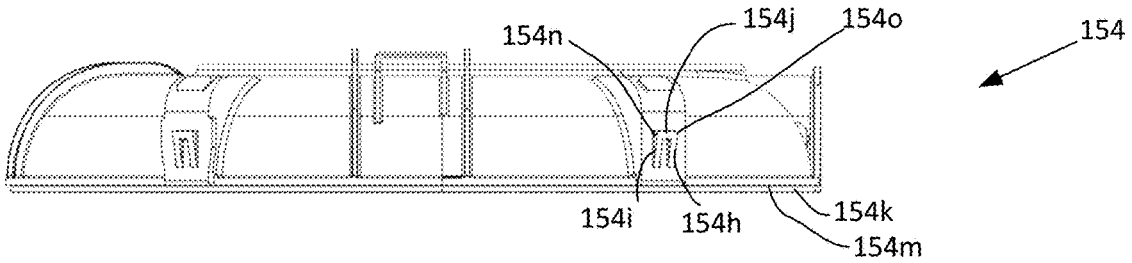
FIG. 30 is a second side view of the first housing part shown in FIG. 27.
Figure 31:
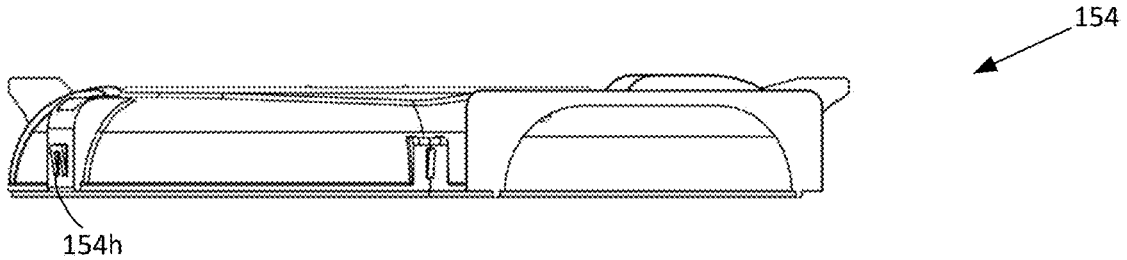
FIG. 31 is a third side view of the first housing part shown in FIG. 27.
Figure 32:
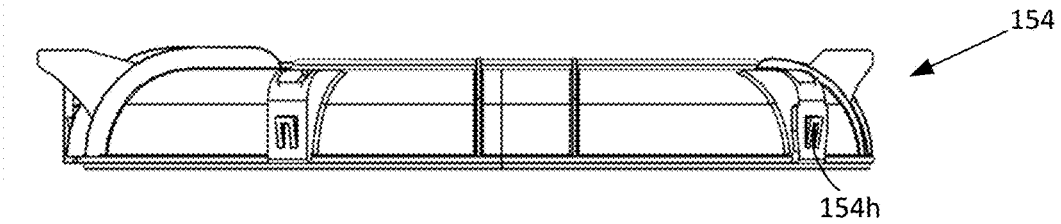
FIG. 32 is a fourth side view of the first housing part shown in FIG. 27.
Figure 33:
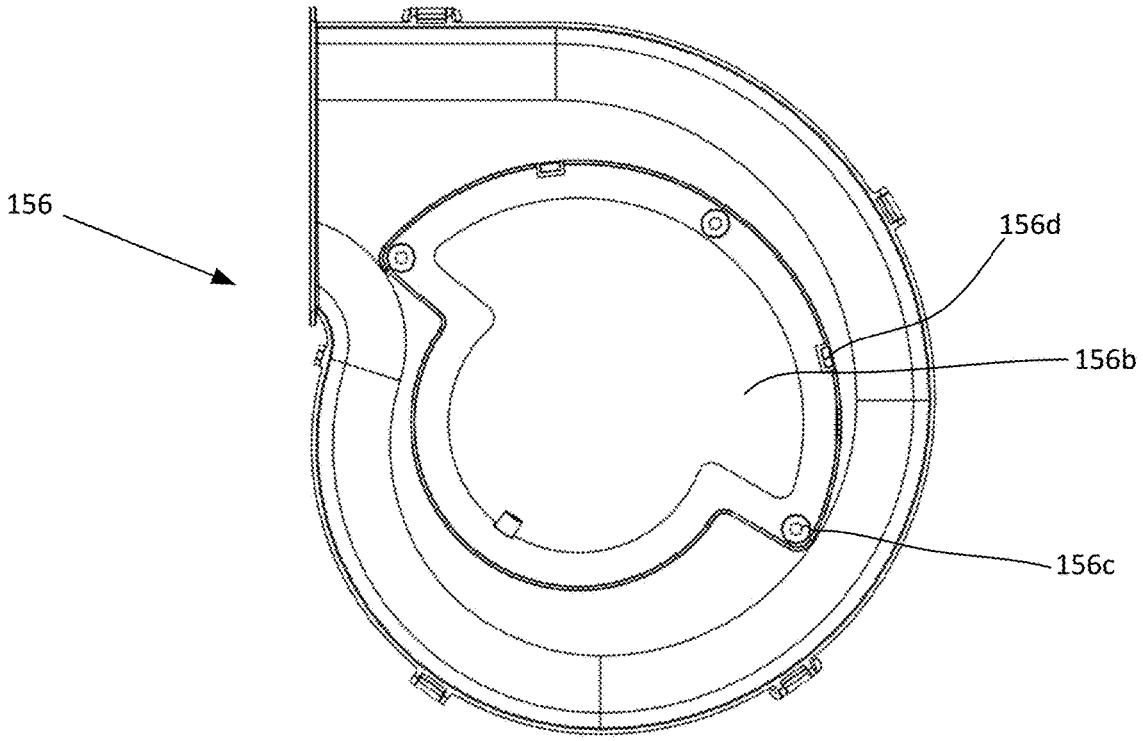
FIG. 33 is a front view of a second housing part of the fan assembly shown in FIG. 18.
Figure 34:
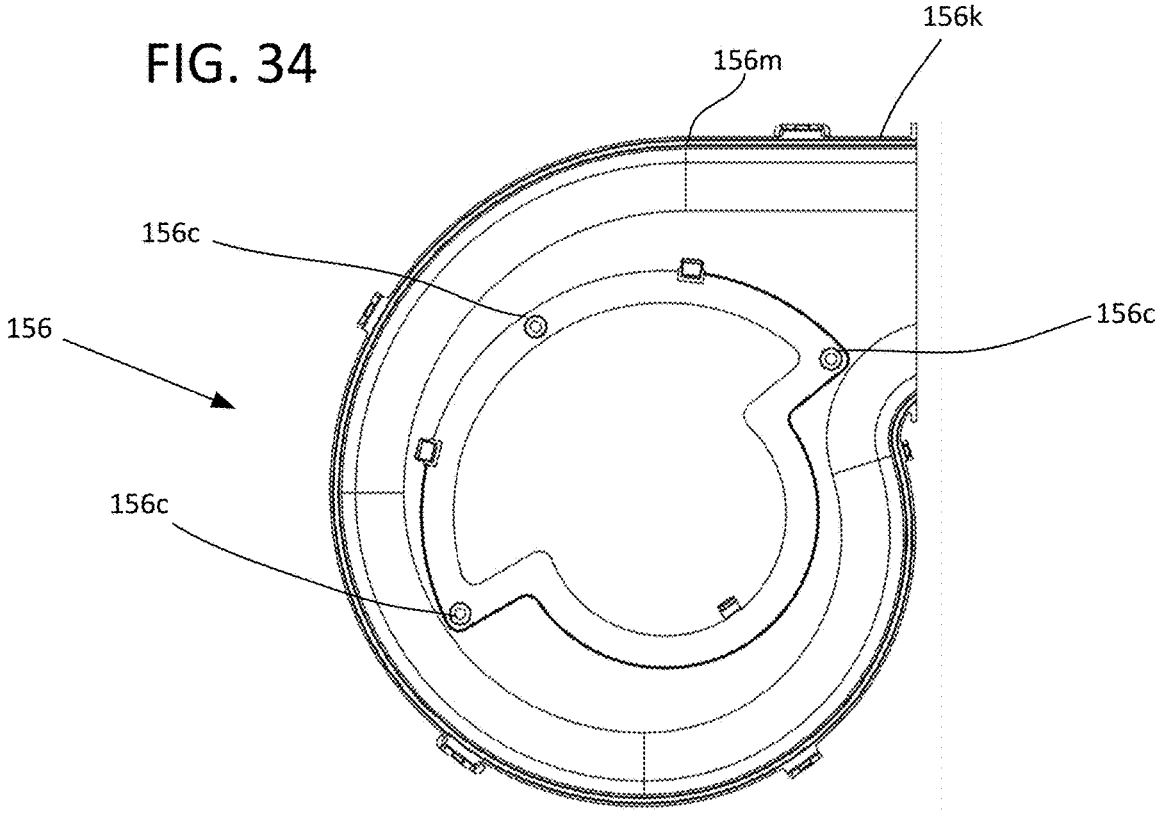
FIG. 34 is a rear view of the second housing part shown in FIG. 33.
Figure 35:
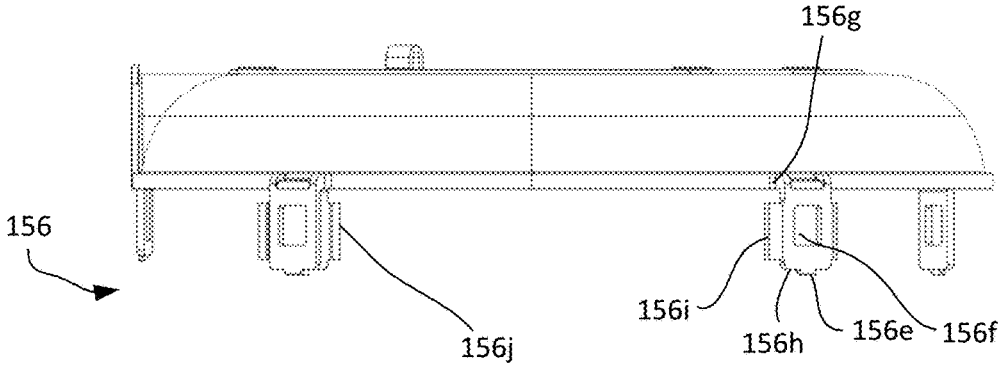
FIG. 35 is a first side view of the second housing part shown in FIG. 33.
Figure 36:
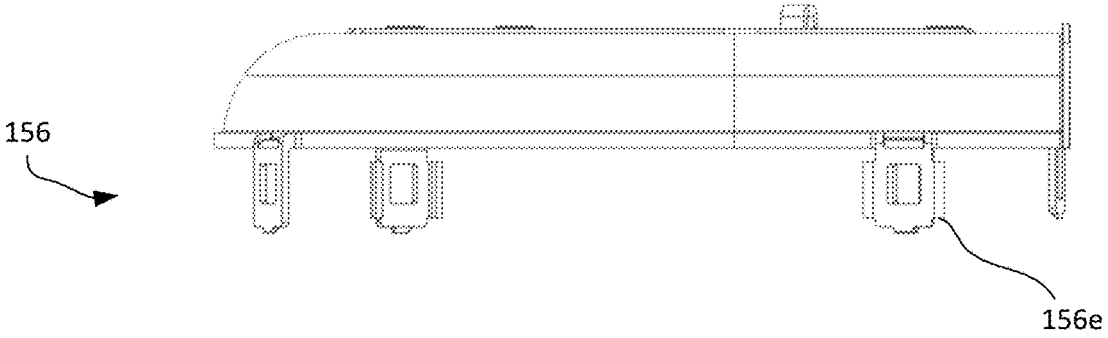
FIG. 36 is a second side view of the second housing part shown in FIG. 33.
Figure 37:
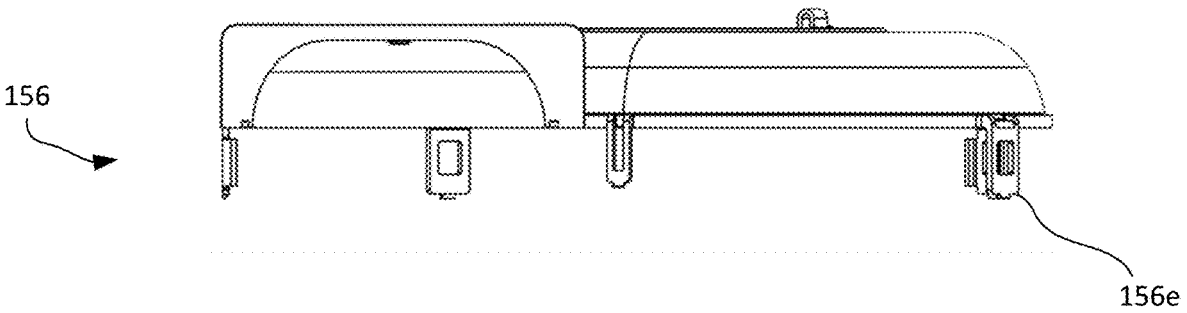
FIG. 37 is a third side view of the second housing part shown in FIG. 33.
Figure 38:
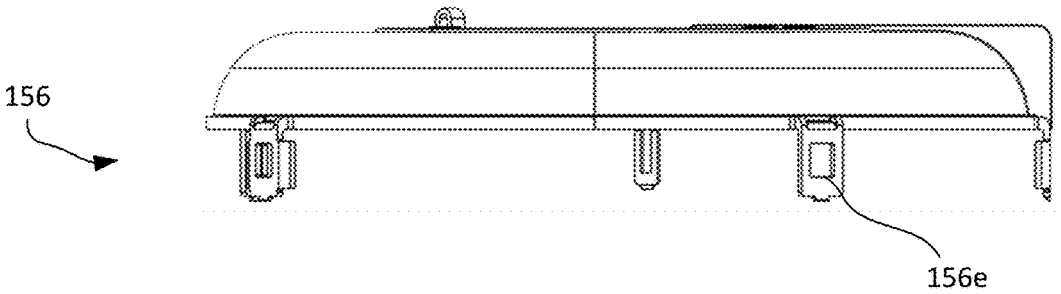
FIG. 38 is a fourth side view of the second housing part shown in FIG. 33.
Figure 39:
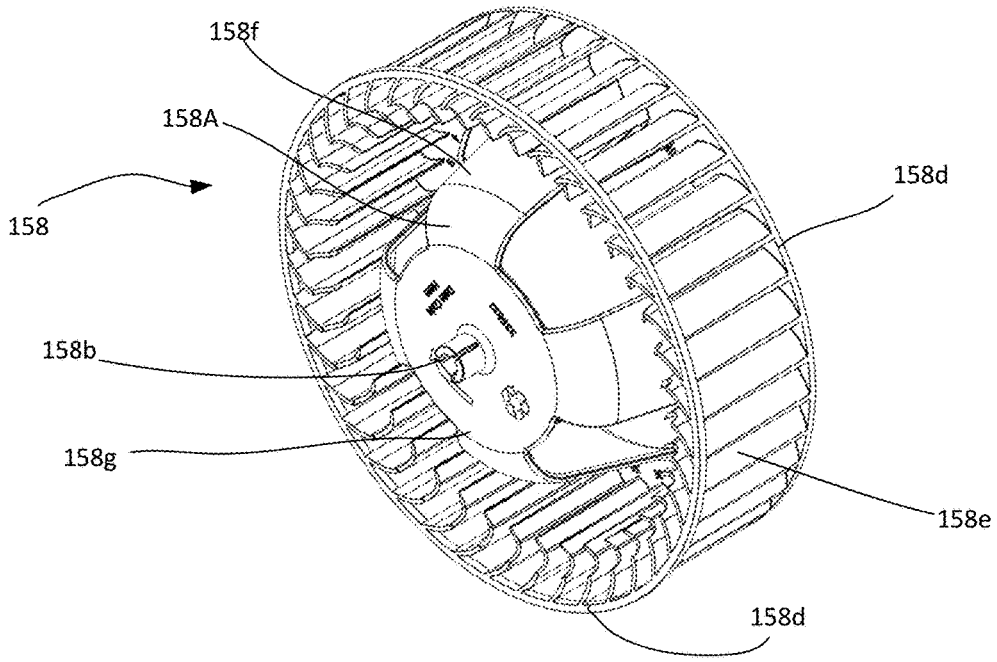
FIG. 39 is a front perspective view of a fan wheel of the fan assembly shown in FIG. 18.
Figure 40:
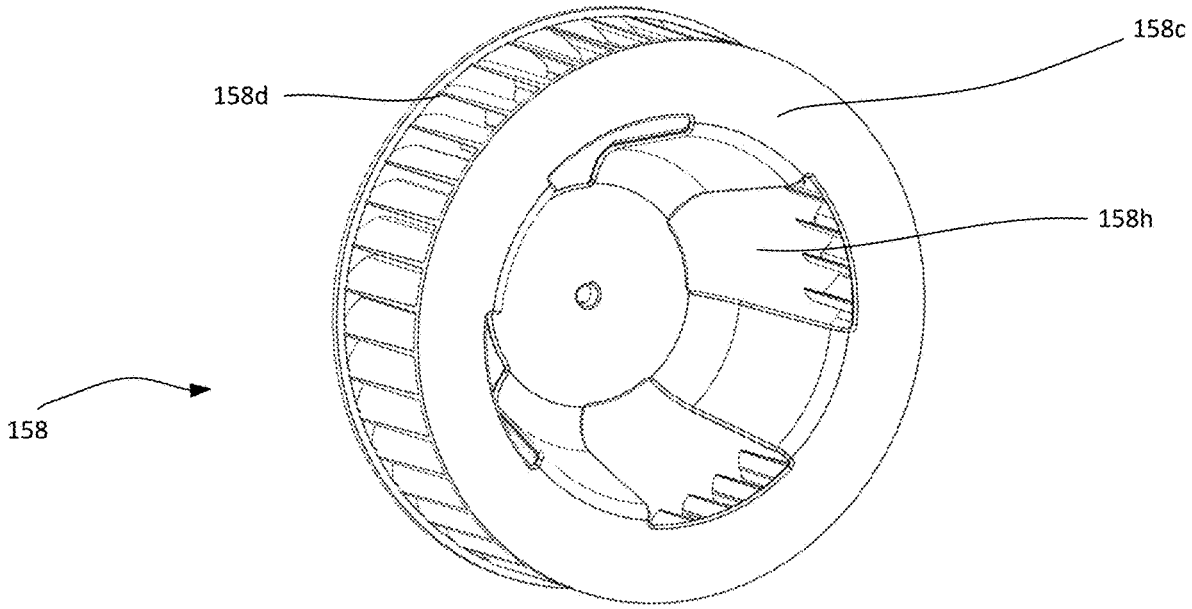
FIG. 40 is a rear perspective view of the fan wheel shown in FIG. 18.
Figure 41:
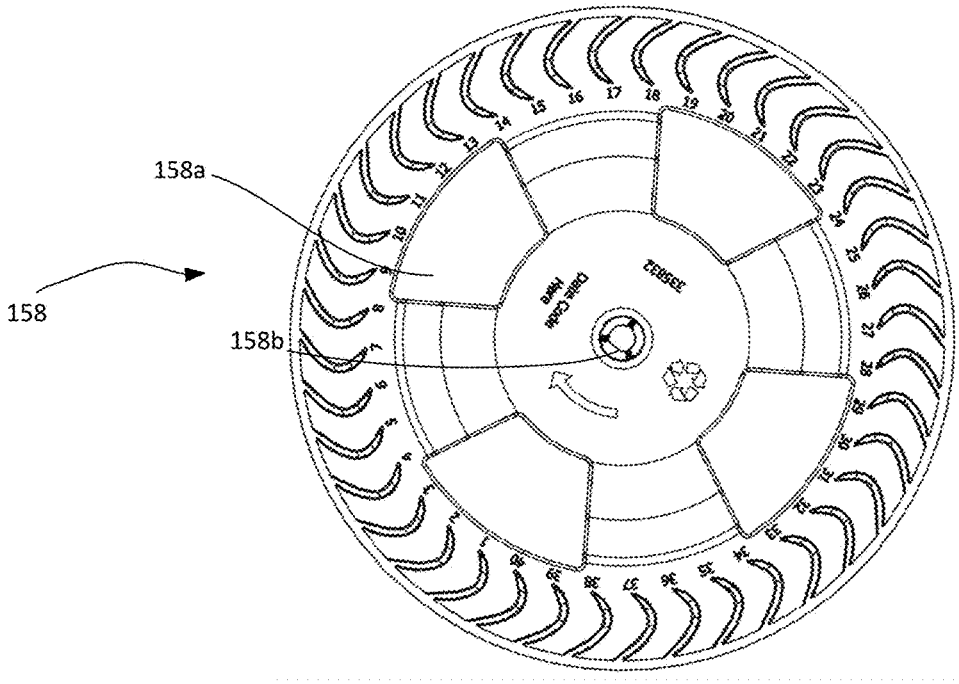
FIG. 41 is a front view of the fan wheel shown in FIG. 18.
Figure 42:
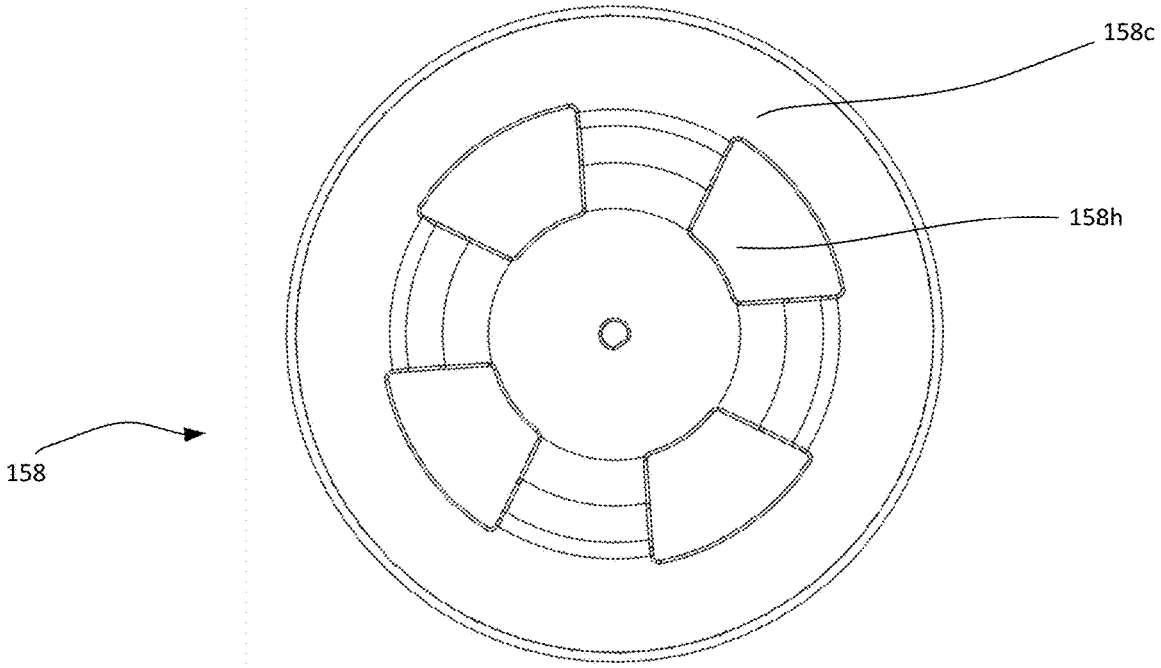
FIG. 42 is a rear view of the fan wheel shown in FIG. 18.
Figure 43:
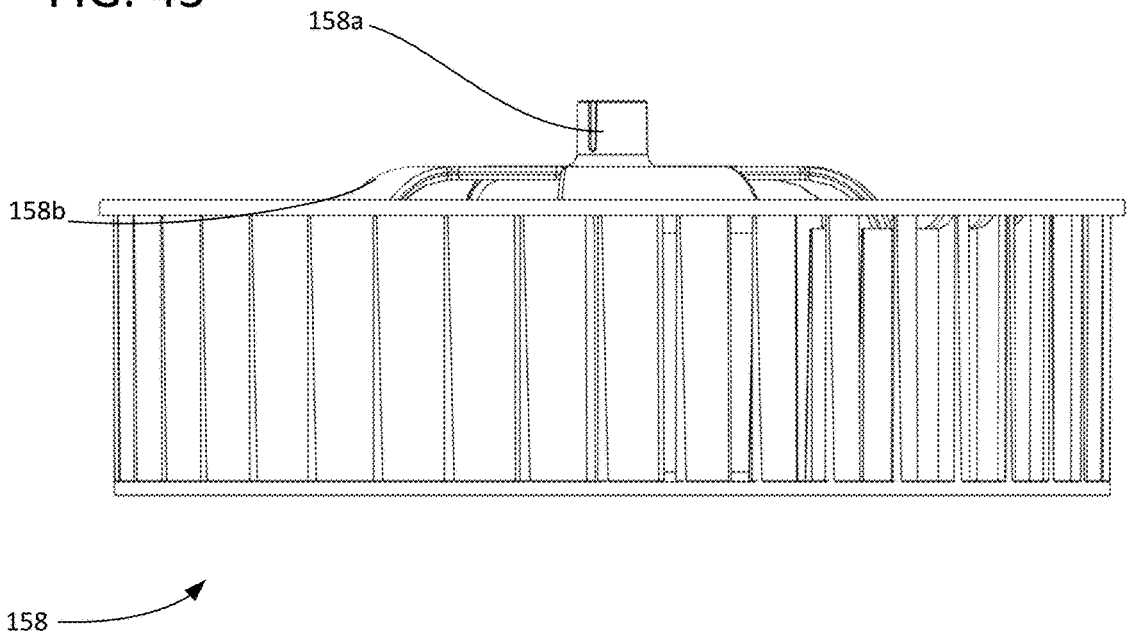
FIG. 43 is a side view of the fan wheel shown in FIG. 18.
Figure 44:
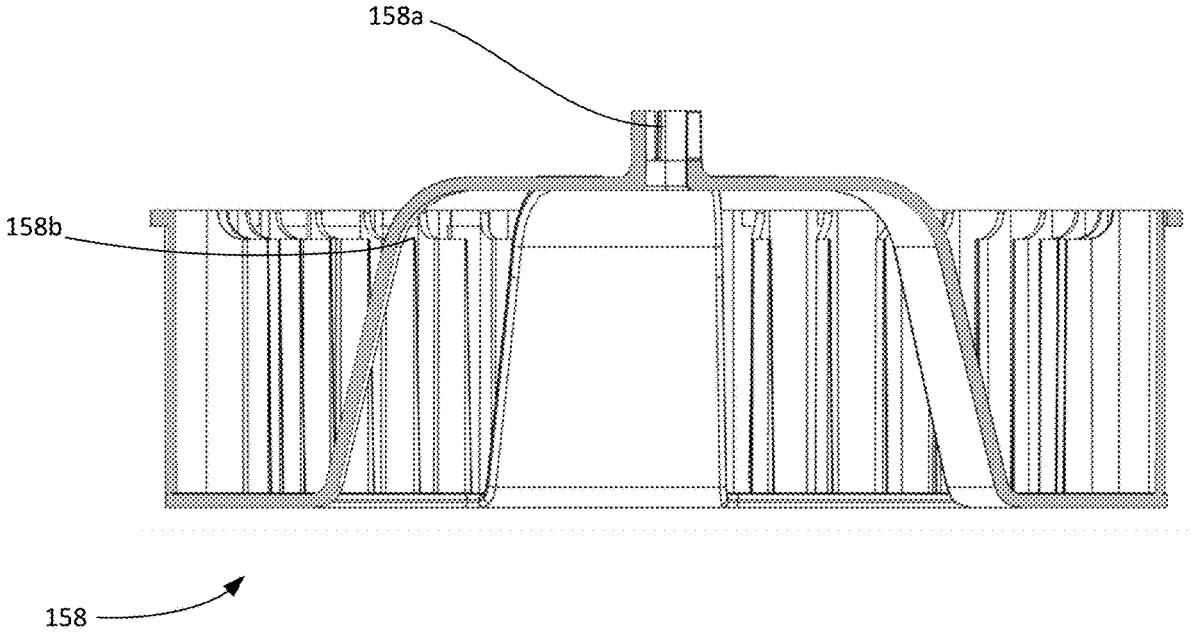
FIG. 44 is a cross-sectional side view of the fan wheel shown in FIG. 18.

With reference to FIGS. 15 to 17, the backdraft damper 112 is shown in more detail. In one aspect, the backdraft damper 112 includes a main body 112*a* and a pair of pins 112*b* received in the apertures 106*e*. When the backdraft damper 112 is mounted within the sidewall 106*c* of the outlet collar 106, the backdraft damper 112 is freely rotatable between an open position and a closed position. In the open position, tab portions 112*c* of the main body 112*a* are rotated against stop members 106*f*, 106*g* and the main body 112*a* is generally parallel with the direction of airflow through the outlet collar 106 such that air can flow through the outlet collar 106. In the closed position, the tab portions 112*c* rotate against the stop members 106*f*, 106*g* such that the main body 112*a* is generally orthogonal to the direction of airflow through the outlet collar 106 such that air flow is blocked from flowing through the outlet collar 106. In one aspect, the main body 112*a* is shaped such that, when the fan assembly 150 is activated, and air is forced through the outlet collar 106, the damper 112 naturally rotates to the open position whereby air is ultimately exhausted from the space and into an interconnected duct. The main body of the b 112*a* is also shaped such that, when the fan assembly 150 is deactivated and airflow in the reverse direction occurs, the damper 112 automatically moves into the closed position.

Figure 6:
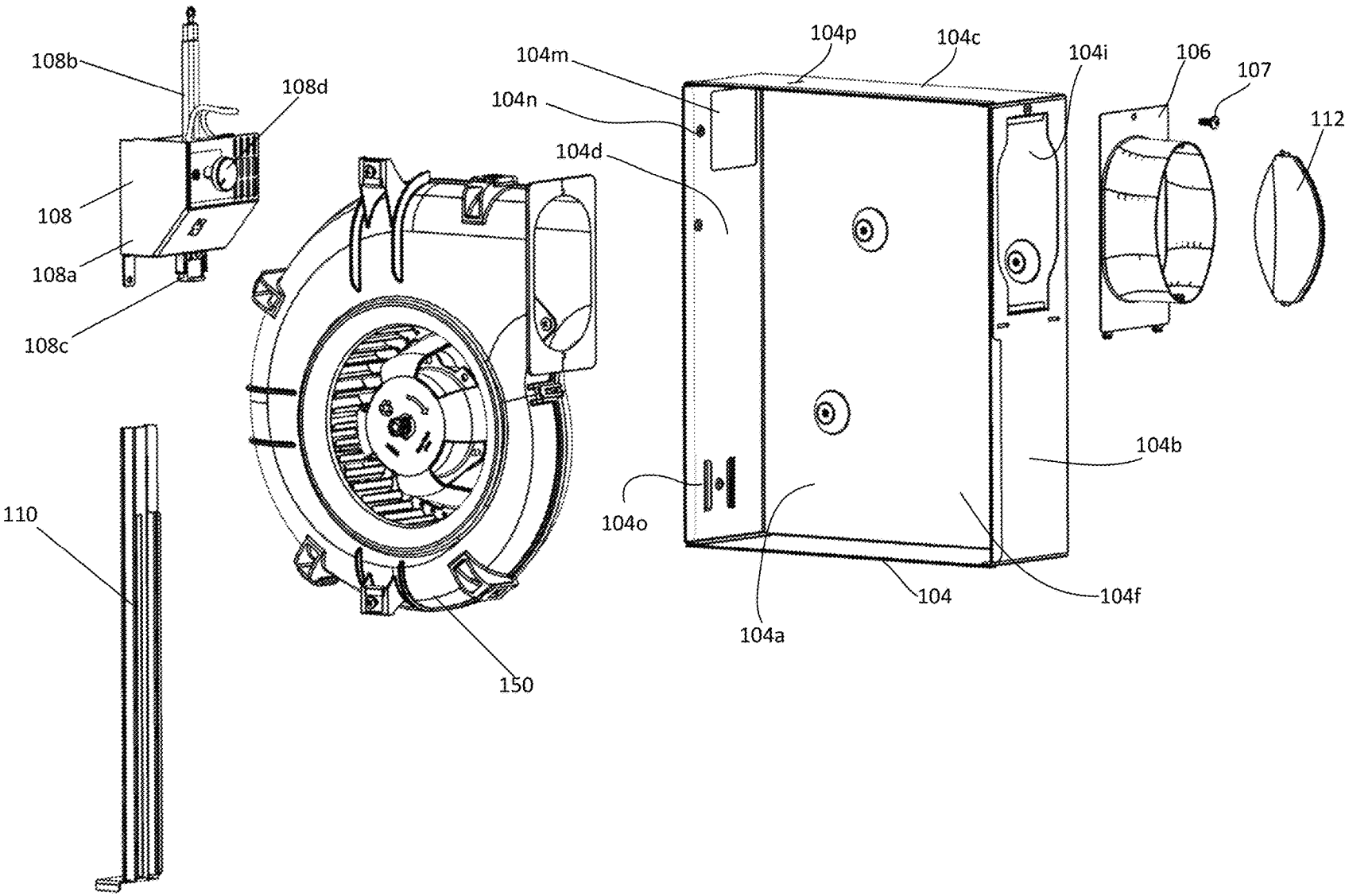
FIG. 6 is an exploded perspective view of the exhaust fan assembly shown in FIG. 2.
Figure 7:
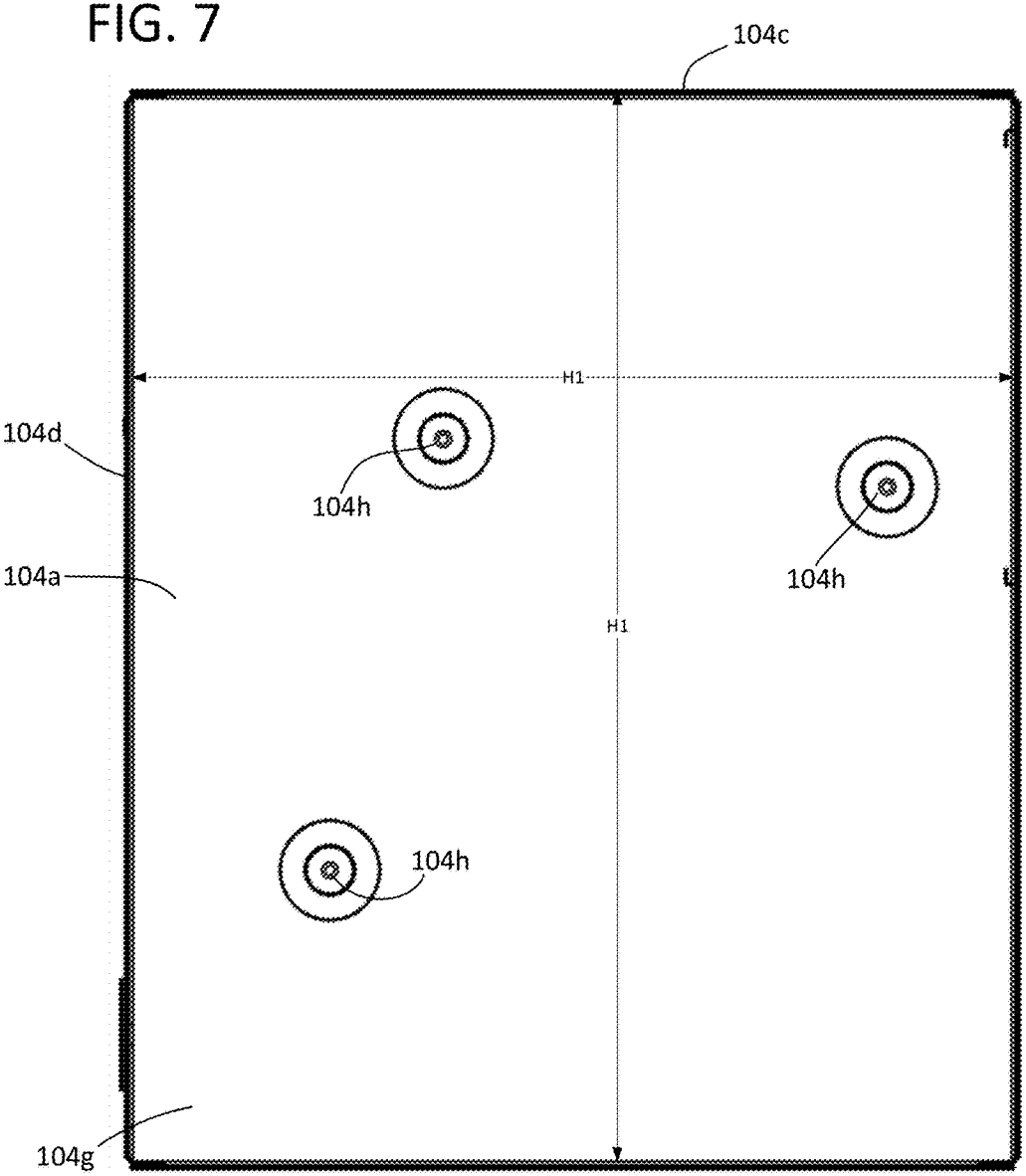
FIG. 7 is a front view of a housing of the exhaust fan assembly shown in FIG. 2.
Figure 9:
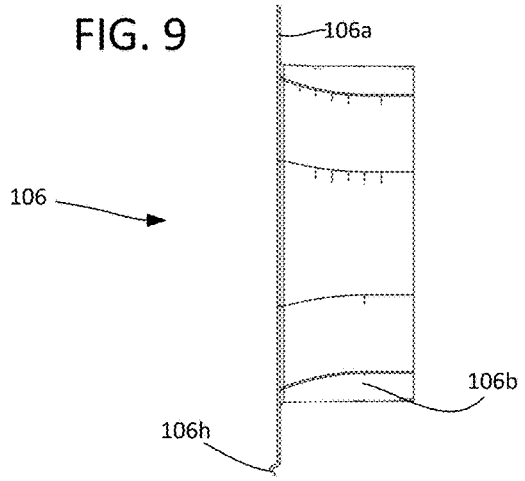
FIG. 9 is a first side view of an outlet structure of the exhaust fan assembly shown in FIG. 2.
Figure 10:
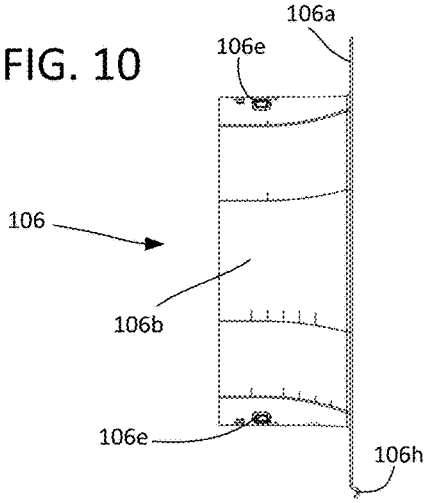
FIG. 10 is a second side view of the outlet structure shown in FIG. 9.
Figure 11:
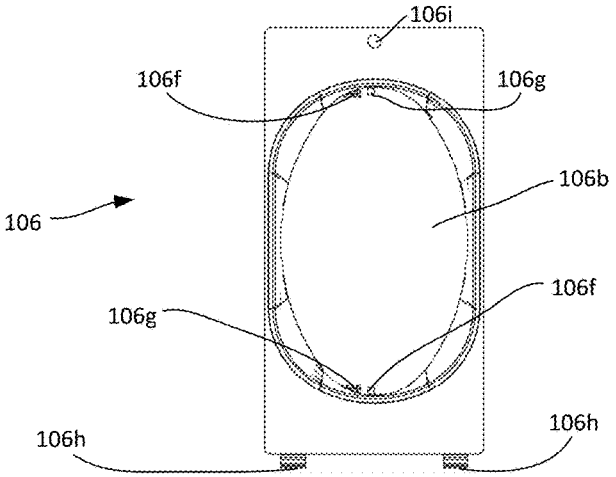
FIG. 11 is a front view of the outlet structure shown in FIG. 9.
Figure 12:
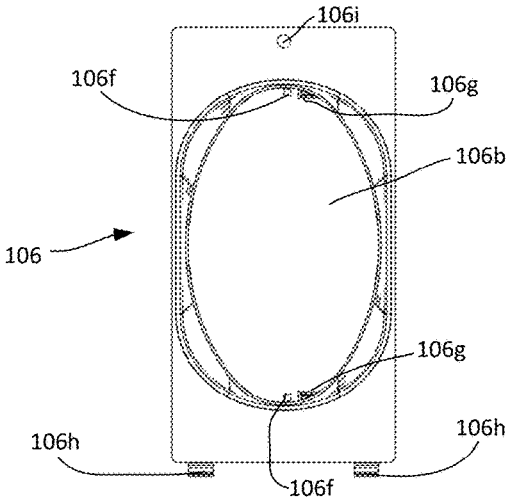
FIG. 12 is a rear view of the outlet structure shown in FIG. 9.
Figure 13:
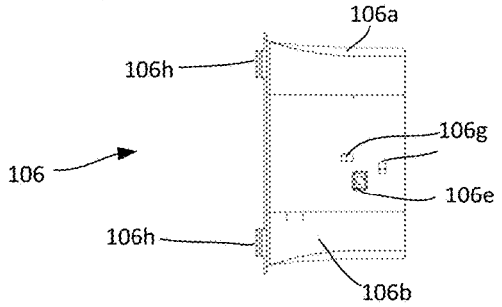
FIG. 13 is a first side view of the outlet structure shown in FIG. 9.
Figure 14:
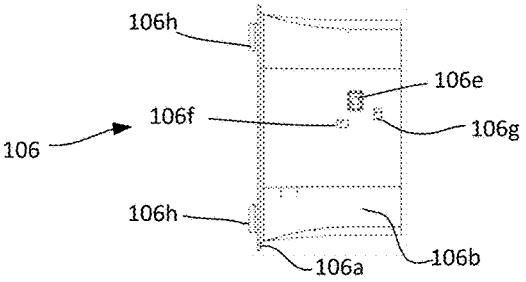
FIG. 14 is a second side view of the outlet structure shown in FIG. 9.

With reference to FIG. 6, the junction box assembly 108 can be most easily seen. As shown, the junction box assembly 108 includes a cover 108*a* that is mounted to the sidewalls 104*b*, 104*c* via a tab/slot construction and/or screws. The junction box assembly 108 further includes electrical wiring 108*b* for interconnection with a power source. The wiring 108*b* is shown as extending through the sidewall 104*b* for purposes of clarity, but resides beneath the cover 108*a* once connected to wiring from a power source, which can extend through the housing opening 104*m*. A plug 108*c* may also be provided such that the fan assembly 150 can be electrically connected and disconnected from the wiring 108*b* more easily during replacement of the fan assembly 150. The junction box assembly 108 can also be provided with a potentiometer 108*d* for setting or adjusting an operational speed and thus airflow of the fan assembly 150.

Referring to FIGS. 18 to 49, the fan assembly 150 is shown in further detail. In one aspect, the fan assembly 150 includes a housing 152 formed from a first half-piece 154 and a second half-piece 156. When secured together, the housing 152 defines a volute-shaped interior volume 152*a* extending between an inlet 152*b* and an outlet 152*c*. Within the interior volume, the fan assembly 150 further includes a fan wheel 158, a motor 160, and a mounting plate 162. As assembled, the mounting plate 162 is mounted to the second half-piece 156 via cooperating features (e.g. tabs) and fasteners 164, provided in this example as threaded screws. The motor 160, shown as a split capacitor motor, is mounted to the mounting plate 162 via fasteners 166, shown as threaded bolts and hex nuts. The fan wheel 158 is mounted to a shaft 160*a* of the motor 160 such that the shaft 160*a* passes through an opening 158*b* in a hub portion 158*a* of the fan wheel 158. The fan wheel 158 can be secured to the shaft 160*a* by a fastener, such as a spring clip or constant-tension band 168.

Referring to FIGS. 27 to 32, the first half-piece 154 is shown in more detail. In one aspect, the first half-piece 154 includes a main body 154*a* forming an integral inlet structure 154*b* which defines the inlet 152*b* of the housing 152. The inlet structure 154*b* is provided with a curved outer surface 154*c* extending radially and axially inward from a base end 154*d* to a distal end 154*e*. In the example shown, the distal end 154*e* defines an open diameter of about 6 inch and the axial distance between the base end 154*d* and the distal end 154*e* is about 0.55 inch. In examples, the curved outer surface 154*c* can be characterized as defining a Venturi inlet for the fan assembly 150. Such a construction uses the differential pressures of incoming air to create better suction into the exhaust fan 100. Using a Venturi-type inlet can improve efficiency and provide cooling to the electric motor 116. In examples, the curved outer surface 154*c* is a convex outer surface. In examples, the curved outer surface 154*c* is a continuously curved surface. In the example, shown the curved outer surface 154*c* has a radius of about 1.1 inch. In examples, the curved outer surface 154*c* has a greater radius of curvature proximate the distal end 154*e* in comparison to a radius of curvature proximate the base end 154*c*. In examples, the curved outer surface 154*c* extends at an oblique angle a1 to the longitudinal axis X of the fan assembly 150. In the example shown, the curved outer surface 154*c* is defines a general inlet angle a1 of about 67 degrees with respect to the longitudinal axis X. In examples, the distal end 154*e* is closer to the longitudinal axis X as compared to the base end 154*d*. In examples, the distal end 154*e* is closer to the longitudinal axis X than a radial innermost portion of the fan blades 158*e* associated with the fan wheel 158.

In one aspect, the main body 154*a* of the first half-piece 154 further defines a pair of mounting legs 154*f* to which fasteners 154*g* can be secured. The mounting legs 154*f* and fasteners 154*g* can be used to secure the grill 102 to the exhaust fan 100.

In one aspect, the main body 154*a* of the first half-piece 154 further defines a plurality of latch structures 154*h*, each of which defines a ramped portion 154*i* and a catch surface 154*j* extending between sides 154*n*, 154*o*. The latch structures 154*h* are configured to engage into apertures of corresponding deflectable latch structures 156*e* of the second half-piece 156 such that the first and second half-pieces 154, 156 can be secured together in a snap-fit type connection, which can also be characterized as a fastenerless construction.

In one aspect, the main body 154*a* of the first half-piece 154 further defines an axially extending projection or tongue structure 154*k* projecting from a mating surface 154*m*, each of which circumscribe the outer perimeter of the main body 154*a*. The tongue structure 154*k* is configured to be received into a correspondingly shaped groove structure 156*k* of the second half-piece 156, wherein the mating surface 154*m* abuts with a corresponding mating surface 156*m* of the second half-piece 156. When the tongue structure 154*k* is received in the groove structure 156*k* and the latch structures 154*h*, 156*e* are engaged with each other, a robust assembly with high structural integrity, formed without the use of separate fasteners, results. Furthermore, the disclosed construction can be manufactured such that a 0.0005 clearance between the half-pieces 154, 156 results, thereby creating a highly effective seal between the half-pieces 154, 156. In some examples, a separate seal member may be provided between the half-pieces 154, 156.

Referring to FIGS. 33 to 38, the second half-piece 156 is shown in more detail. In one aspect, the second half-piece 156 includes a main body 156*a* defining an opening 156*b*. The opening 156*b* is covered by the mounting plate 162. The main body 156*a* is provided with tabs 156*d* arranged about the outer perimeter of the opening 156*b* such that the mounting plate 162 can be secured to the second half-piece 156. The main body 156*a* is further provided with openings 156*c* allowing the fasteners 164 to extend between the mounting plate 162 and the housing 104.

In one aspect, the main body 156*a* of the second half-piece 156 further defines a plurality of latch structures 156*e*, each of which defines an opening 156*f* and extends between a base end 154*d* and a distal end 156*f*. Two of the latch structures 156*e* are also provided with a pair of shoulder portions or arms 156*i*, 156*j* which guide and receive the latch structures 154*h* of the first half piece 154. In one aspect, each of the latch structures 156*e* is deflectable proximate the base end 154*d* such that, when the latch structures 156*e* initially contact the latch structures 154*h*, the latch structures 156*e* deflect radially outward and ride along the ramped portions 154*i* until the openings 156*f* pass beyond the ramped portions 154*i*. At this point, the latch structures 156*e* snap back in a radially inward direction such that the catch surfaces 154*j* engaged against the distal edge of the openings 156*f*, thus forming a snap-fit, fastenerless type connection. In the example shown, five latch structures 154*h*, 156*e* are provided. However, other numbers of latch structures may be provided.

As noted previously, the main body 156*a* of the second half-piece 156 further defines an axially extending groove structure 156*k* projecting from a mating surface 156*m*, each of which circumscribe the outer perimeter of the main body 156*a*.

In the example shown, the first and second half-pieces 154, 156 are polymeric components. In some examples, the first and second half-pieces 154, 156 are formed by an injection molding process.

Referring to FIGS. 39 to 45, the fan wheel 158 is shown in further detail. As indicated previously, the fan wheel 158 includes a hub portion 158*a* defining an opening 158*b* for receiving the shaft 160*a* of the motor 160. The fan wheel 158 is also shown as being provided with a first annular end ring 158*c* and a second annular end ring 158*d* between which a plurality of fan blades 158*e* extend axially. The hub portion 158*a* of the fan wheel 158 also includes a plurality of support legs 158*f* extending in a generally axial direction from the first annular end ring 158*c* to a central support portion 158*g* extending orthogonally to the longitudinal axis X. In one aspect, the support legs 158*f* have an S-shape profile and are shaped such that the central support portion 158*g* is closer to the second annular end ring 158*d* than to the first annular end ring 158*c*, as most easily viewed at FIG. 44. In one aspect, the central support portion 158*g* is located axially beyond the second annular end ring 158*d*. This construction results in an interior region 158*h* being formed within the fan wheel 158 for accepting the motor 160 which allows for the motor 160 to be placed outside of the airflow stream in which air passes through an opening defined by the second annular end ring 158*d* and through the plurality of fan blades 158*e* via an interior region 158*i* opposite the interior region 158*h*. In the example shown, four support legs 158*f* are provided, although a different number of support legs 158*f* may be provided. In one aspect, a plurality of spaced apart members 158*h* extend axially from the central portion 158*e* and define the opening 158*b*. When the shaft 160*a* is received into the opening 158*b*, the spring clip 168, which can be provided as a simple hose clamp, binds the members 158*f* against the shaft 160*a* such that the fan wheel 158 is secured to and rotates with the shaft 160*a* when the motor 160 is activated. In the example shown, three members 158*h* are provided, although a different number of members 158*h* may be provided.

Figure 45:
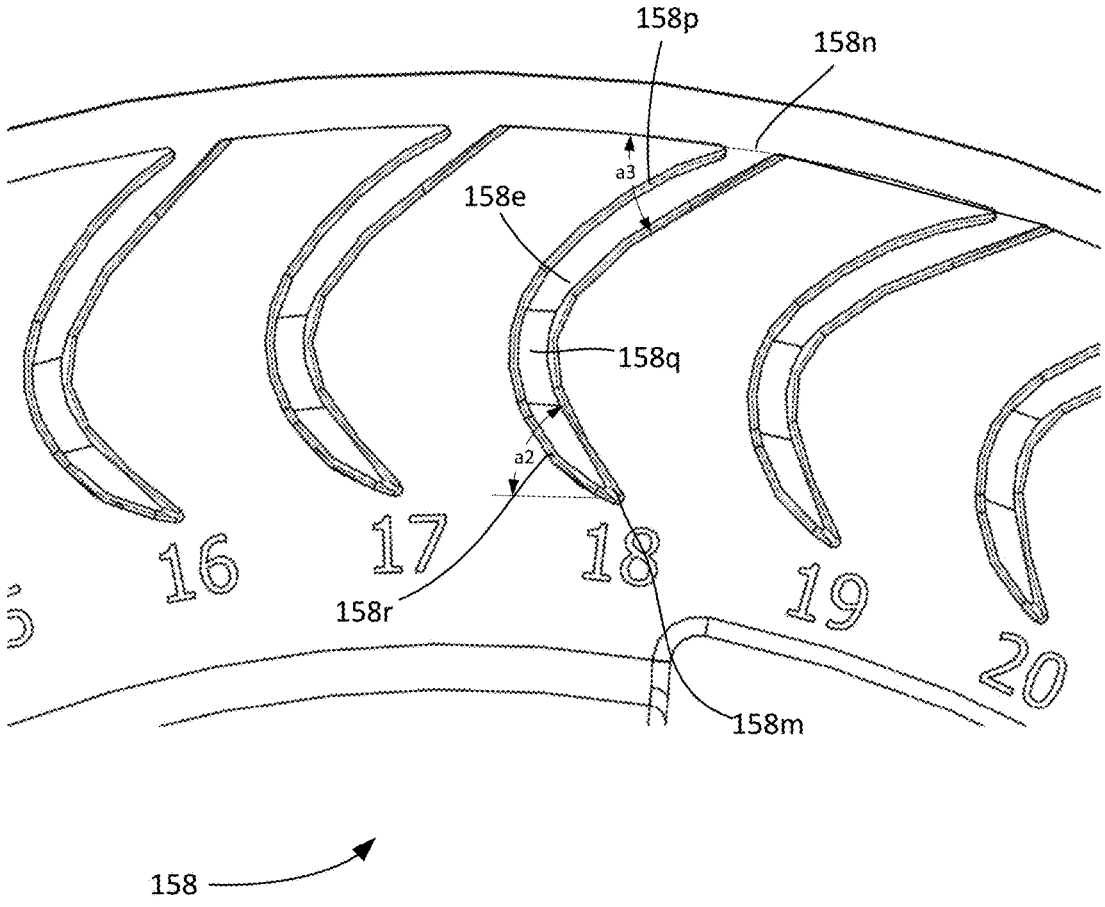
FIG. 45 is a top view of a portion of the fan wheel shown in FIG. 18.
Figure 46:
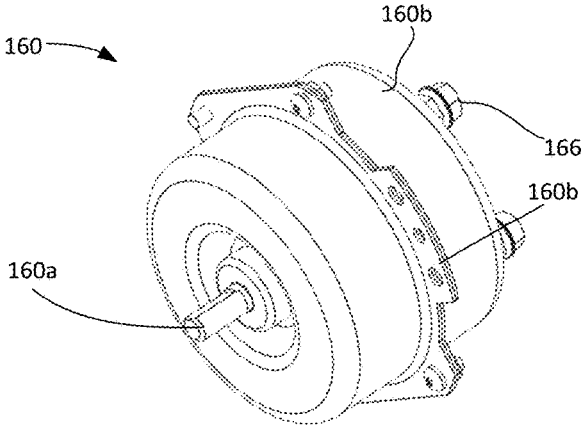
FIG. 46 is a front perspective view of a motor of the fan assembly shown in FIG. 18.
Figure 47:
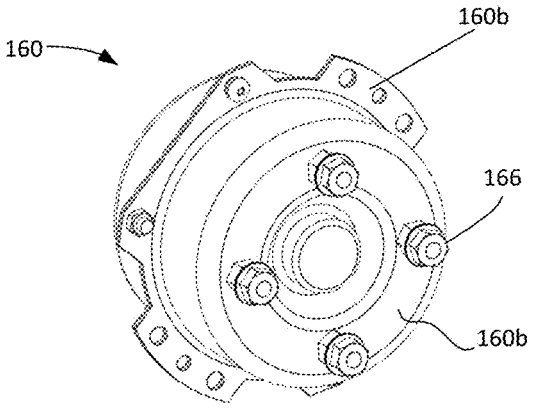
FIG. 47 is a rear perspective view of the motor shown in FIG. 46.
Figure 48:
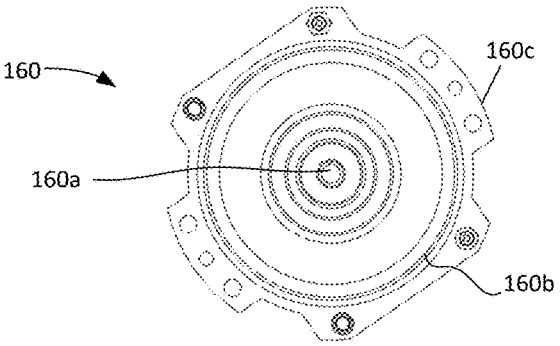
FIG. 48 is a front view of the motor shown in FIG. 46.
Figure 49:
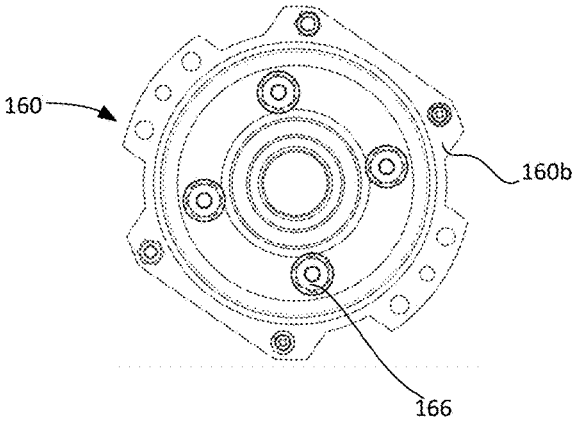
FIG. 49 is a rear view of the motor shown in FIG. 46.
Figure 50:
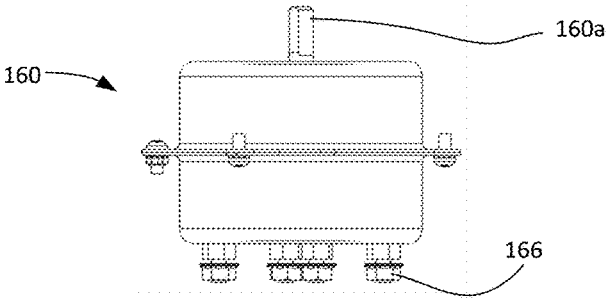
FIG. 50 is a side view of the motor shown in FIG. 46.

In one aspect, each of the fan blades 158*e* extends axially between a first end 158*j* and a second end 158*k* and extend between a leading edge 158*m* and a trailing edge 158*n*. As most easily seen in the view provided at FIG. 52, each of the fan blades 158*e*, is scalloped with a concave curved portion 158*o* which is generally aligned with the distal end 154*e* of the inlet structure 154*b*. The curved portions 158*o* allow for a better transition of the airflow entering the central region 158*i* as the airflow passes through the inlet structure 154*b* proximate fan blades 158*e*. In one aspect, and as most easily viewed at FIG. 45, each of the fan blades 158*e* can be characterized as having first, second, and third segments 158*p*, 158*q*, 158*r* extending between the leading and trailing edges 158*m*, 158*n*. In one aspect the first segment 158*p* of the fan blades 158*e*, proximate the leading edges 158*m*, is disposed at an angle of attack a2 relative to the travel path of the blades 158*e*, which can be characterized as being the angle between a line extending between adjacent fan blade tips and a line extending parallel to a line extending along the surface or average surface of the leading edge 158*m* of the blade 158*e*, as shown at FIG. 45. As each blade 158*e* nears the trailing edge 158*n*, at the third segment 158*r*, a chord of the segment 158*r* is disposed at an angle a3. Angle a3 can be characterized as the angle between the travel path of the blades 158*e* at the ends of the trailing edges 158*n* and the surface of the trailing edge 158*p* of the blade 158*e*, as illustrated at FIG. 45. In the example shown, the angle of attack a2 is about 55 degrees while the angle a3 is about 25 degrees. Additionally, the angle between the leading and trailing edge surfaces 158*r*, 158*p* is shown as being about 89 degrees. In one example, the angle a2 is no more than 60 degrees. In one example, the angle of attack a2 is no more than 30 degrees. In one example, the angle between the leading and trailing edge surfaces 158*r*, 158*p* is at least 45 degrees. In one example, the angle between the leading and trailing edge surfaces 158*r*, 158*p* is at least 60 degrees. In one example, the angle between the leading and trailing edge surfaces 158*r*, 158*p* is at least 70 degrees. The angle of attack a2 is significantly less than provided for conventional exhaust fans. The disclosed fan blade geometry enables the fan wheel 150 to have significantly less separation of air flowing through the meridional passage and a more homogenous flow around the circumference of the fan wheel 150, resulting improved efficiency. Each fan blade 158 is also provided with an airfoil shape in which the first segment 158*p* at the leading edge 158*m* generally tapers into a point.

Figure 51:
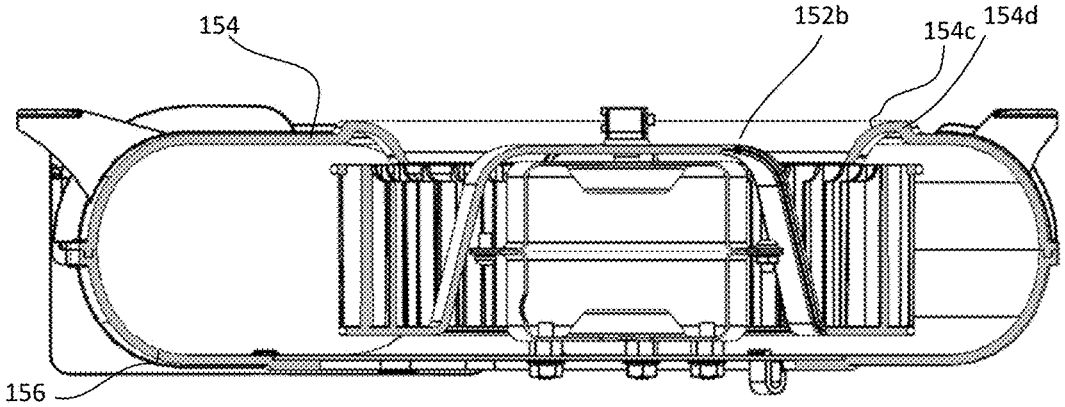
FIG. 51 is a cross-sectional side view of the fan assembly shown in FIG. 18.
Figure 52:
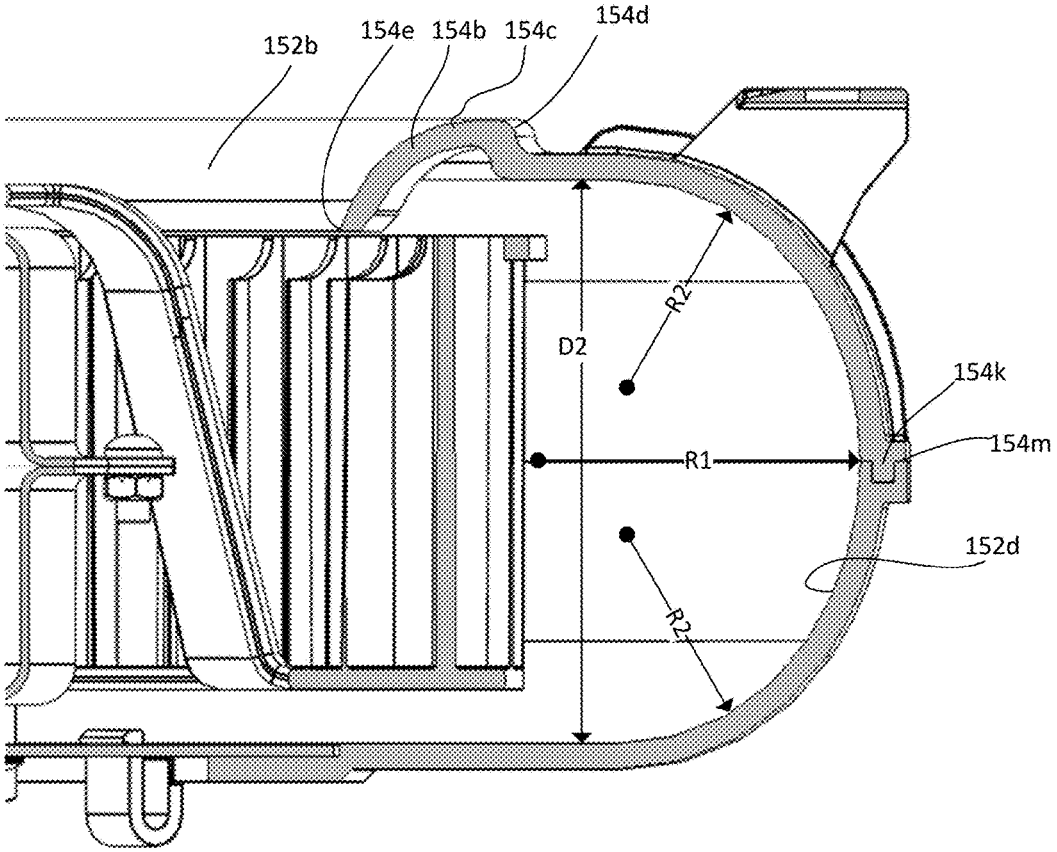
FIG. 52 is a cross-sectional side view of a portion of the fan assembly shown in FIG. 51.

In one aspect, the fan housing 152 defines the volute-shaped interior volume 152*a* with an outer perimeter 152*d* having a continuously curved cross-sectional shape, as most easily seen at FIGS. 51 and 52. In the example shown, the outer perimeter 152*d* has compound or multi-radius curve in which a central portion is curved at a first radius R1 and adjacent side portions are curved at a second radius R2 less than the first radius R1. In one example, the radius R1 is about 1.625 inch while the radius R2 is about 1.125 inch. Such a construction provides for improved airflow over typical exhaust fan housings, which generally have rectangular cross-sectional profiles. In some examples, the outer perimeter 152*d* has a single, generally constant radius R1 which can be, for example, 1.5 inches. In some examples, the volute-shaped interior volume 152*a* has a first width D2. In the example shown, the first width D2 is a constant width. In some examples the width D2 is less than 3.5 inch.

Figure 53:
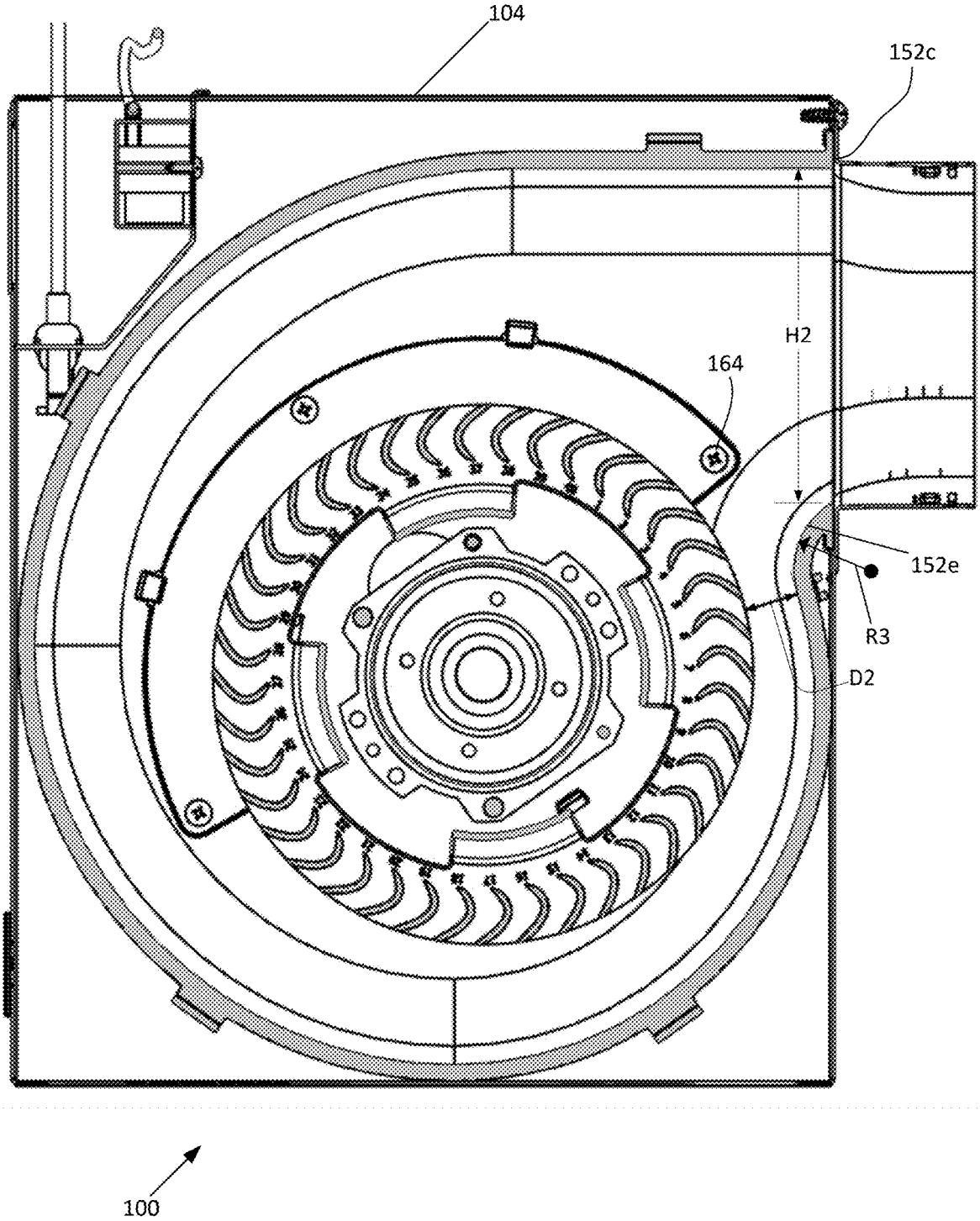
FIG. 53 is a cross-sectional side view of a portion of the exhaust fan assembly shown in FIG. 2.
Figure 54:
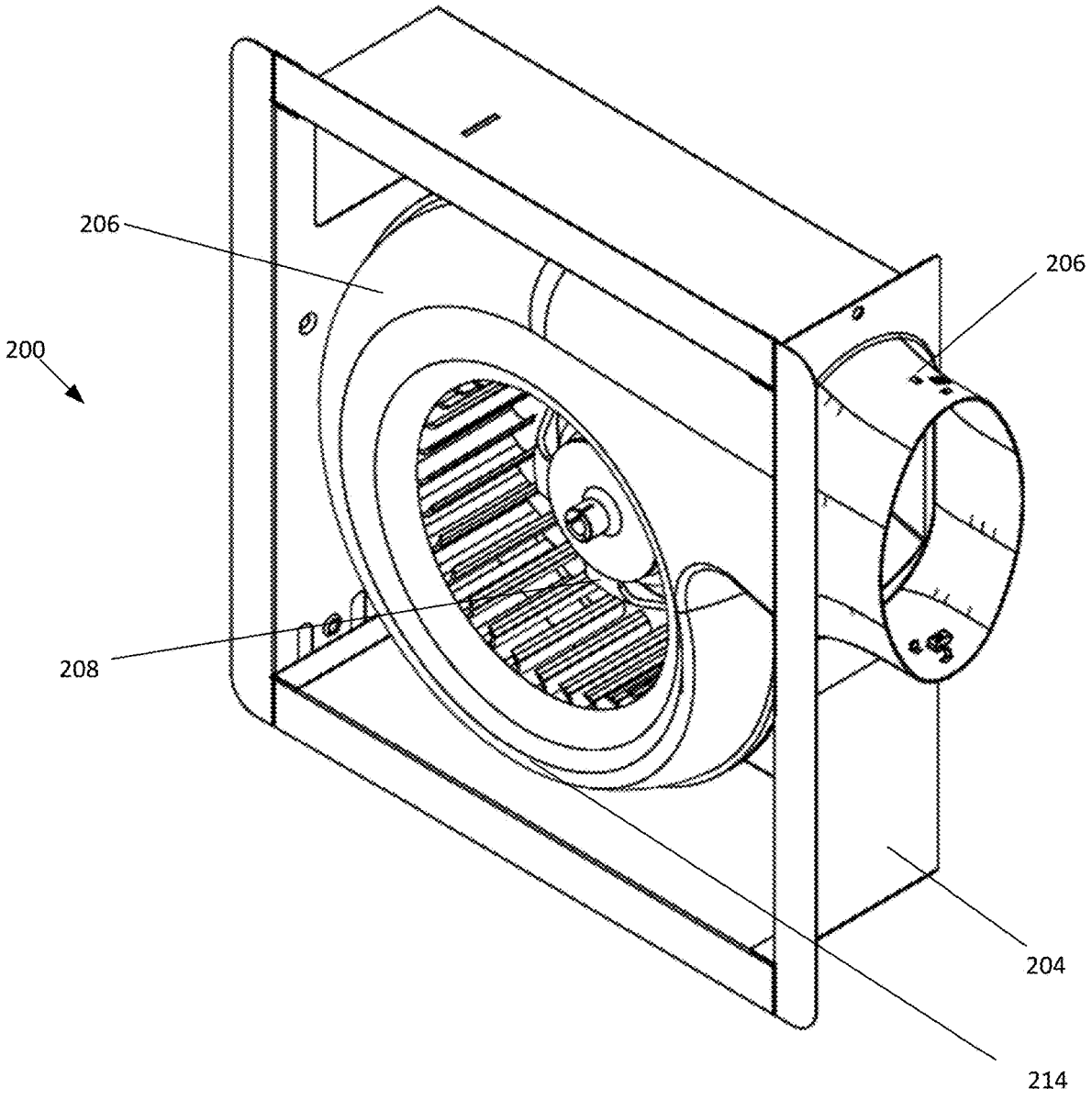
FIG. 54 is a perspective view of a different exhaust fan assembly in accordance with the principles of this disclosure with the grill removed.
Figure 55:
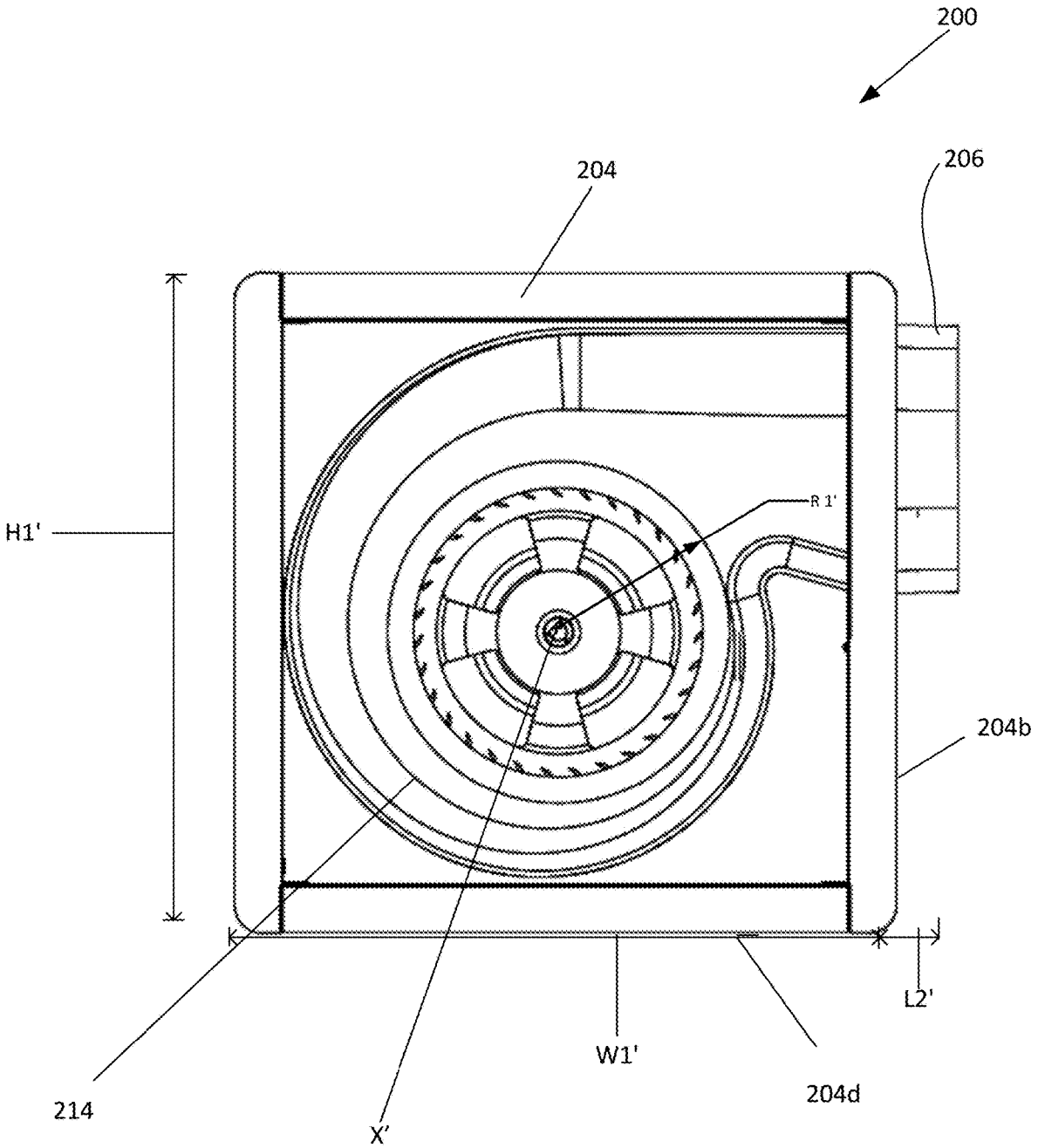
FIG. 55 is a first view of the exhaust fan assembly shown in FIG. 54.
Figure 56:
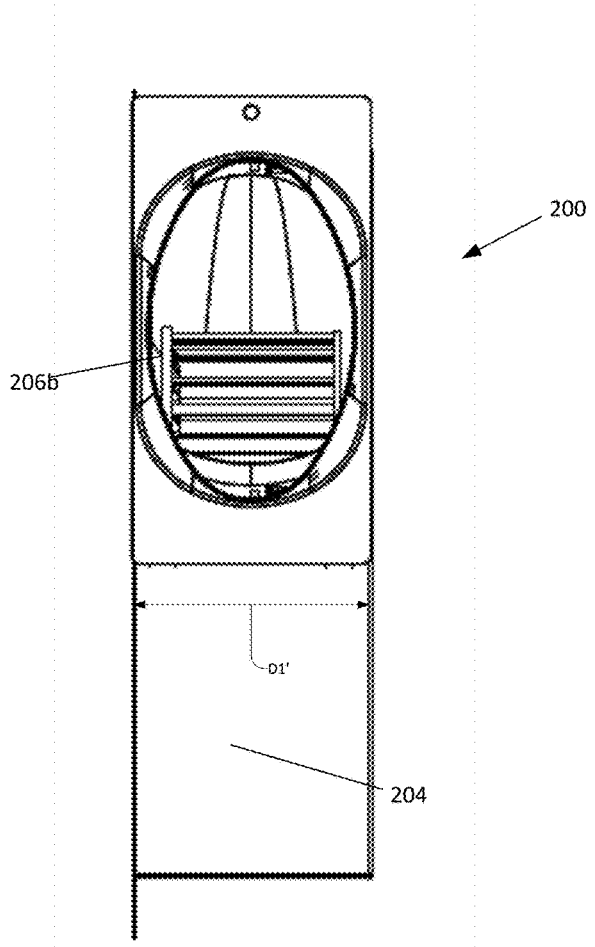
FIG. 56 is a second view of the exhaust fan assembly shown in FIG. 54.
Figure 57:
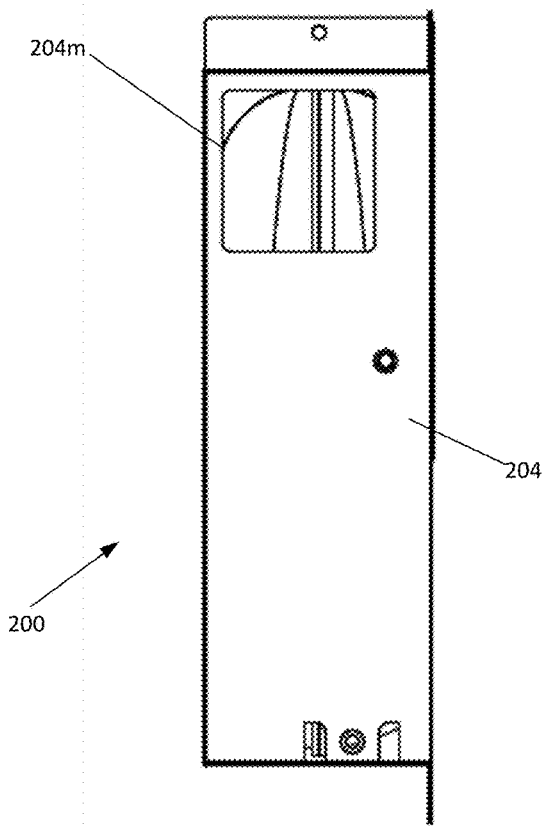
FIG. 57 is a third view of the exhaust fan assembly shown in FIG. 54.
Figure 59:
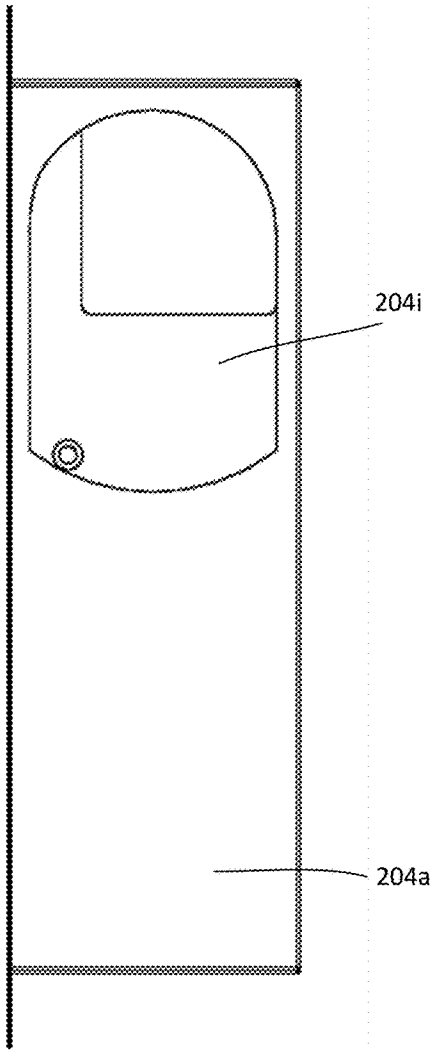
FIG. 59 is a first view of the housing of FIG. 58.
Figure 58:
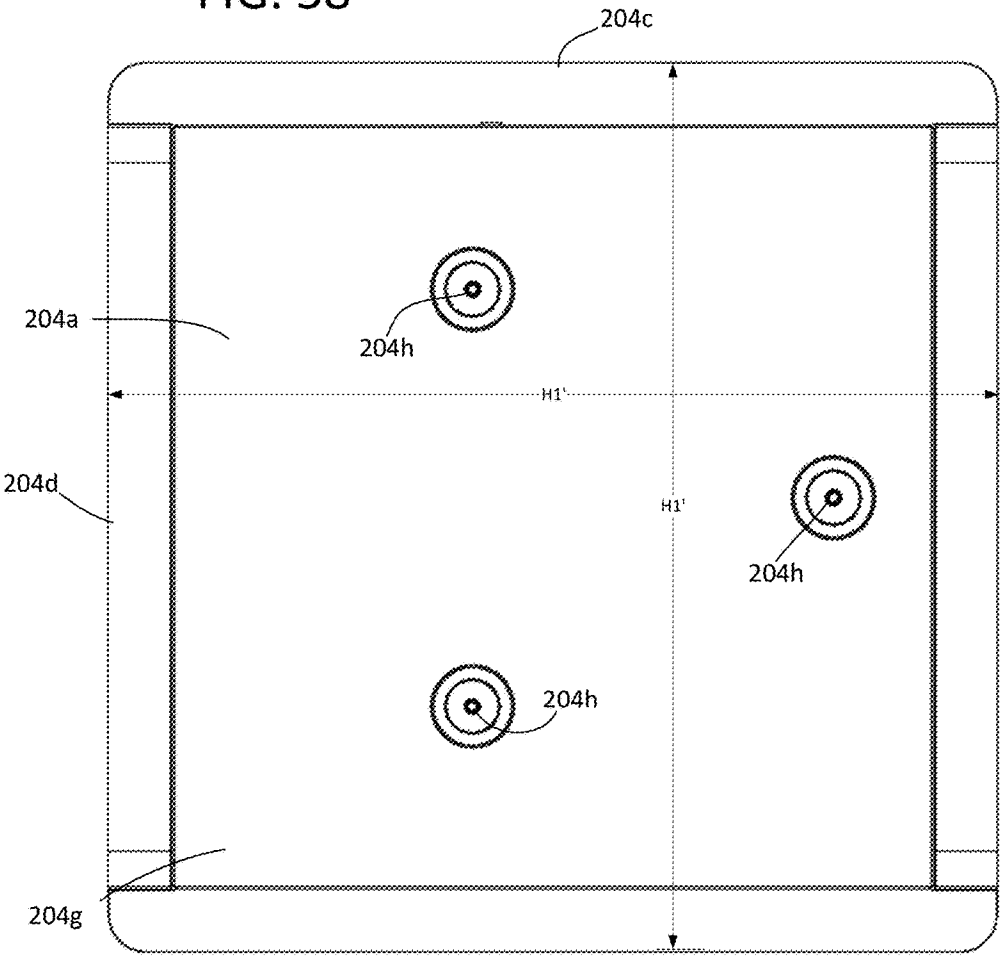
FIG. 58 is a first view of a housing of the fan assembly of FIG. 54.
Figure 60:
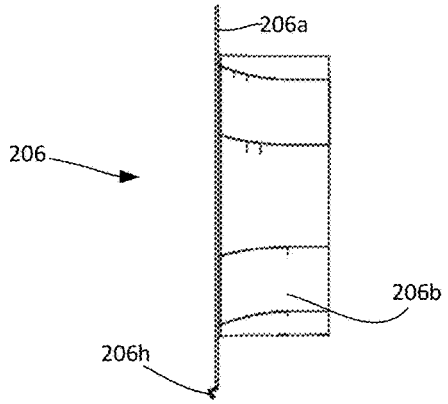
FIG. 60 is a first side view of an outlet structure of the exhaust fan assembly shown in FIG. 54.
Figure 61:
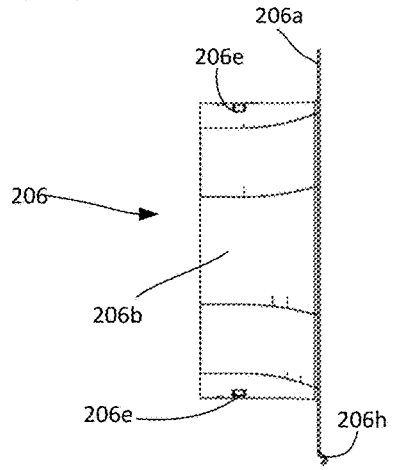
FIG. 61 is a second side view of the outlet structure shown in FIG. 60.
Figure 62:
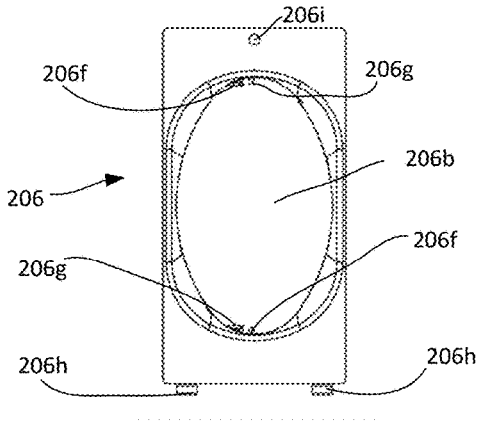
FIG. 62 is a front view of the outlet structure shown in FIG. 60.
Figure 63:
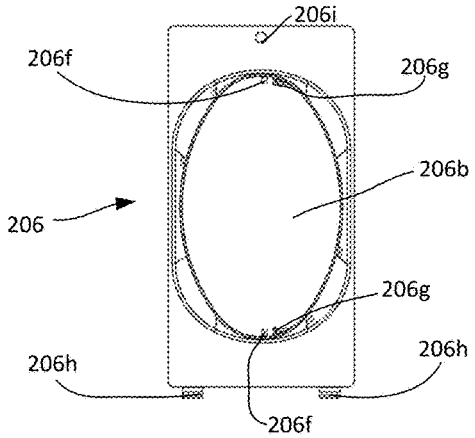
FIG. 63 is a rear view of the outlet structure shown in FIG. 60.
Figure 64:
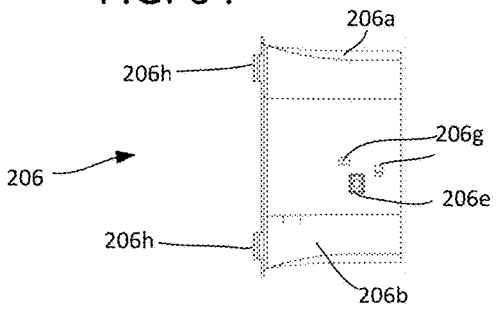
FIG. 64 is a first side view of the outlet structure shown in FIG. 60.
Figure 65:
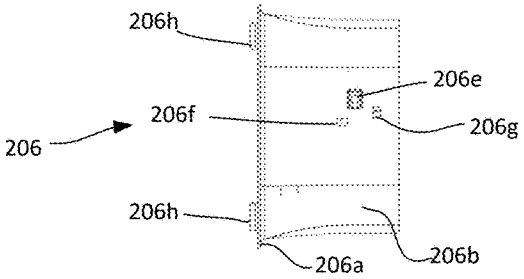
FIG. 65 is a second side view of the outlet structure shown in FIG. 60.
Figure 66:
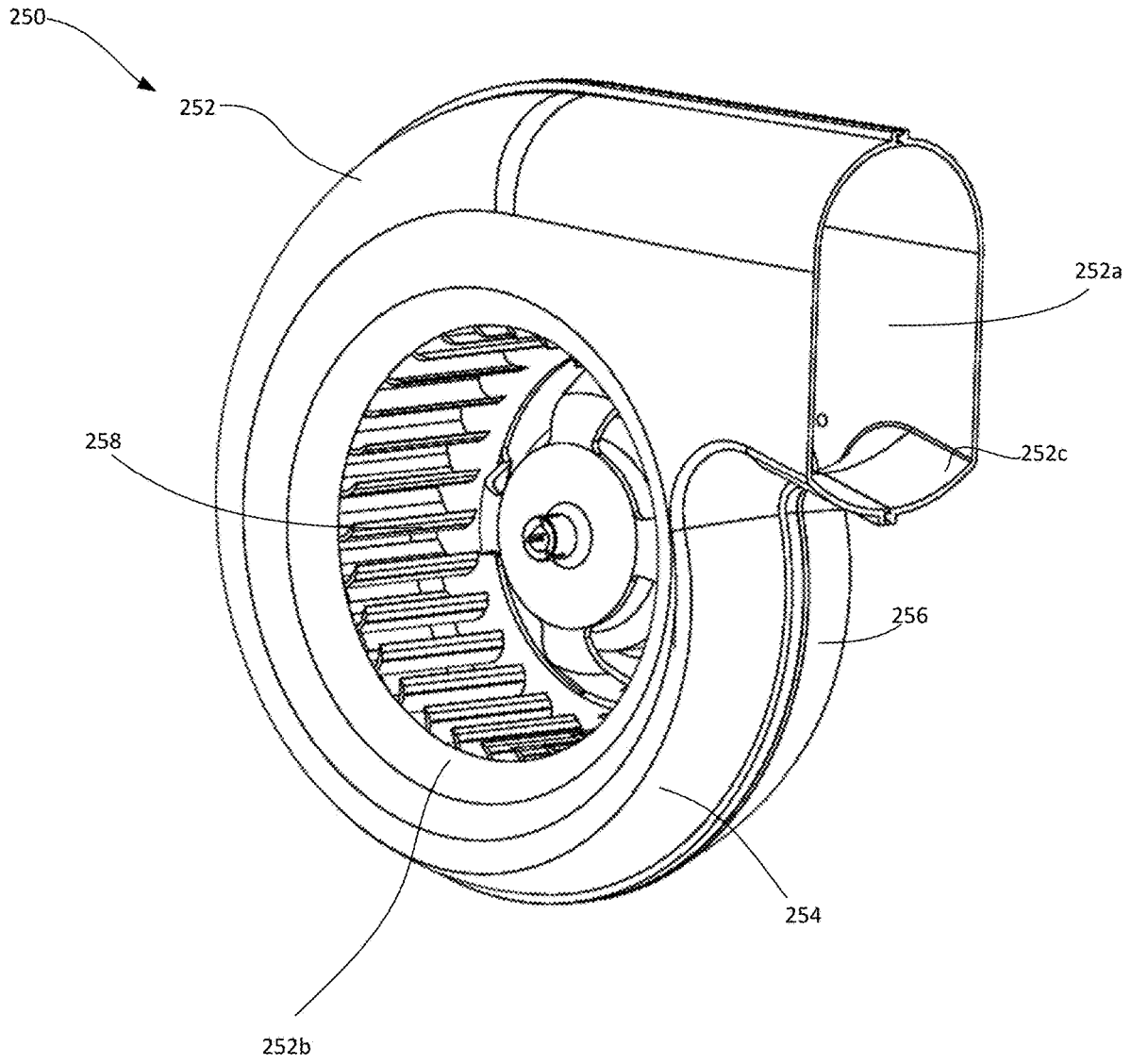
FIG. 66 is a first perspective view of a fan assembly of the exhaust fan assembly shown in FIG. 54.
Figure 67:
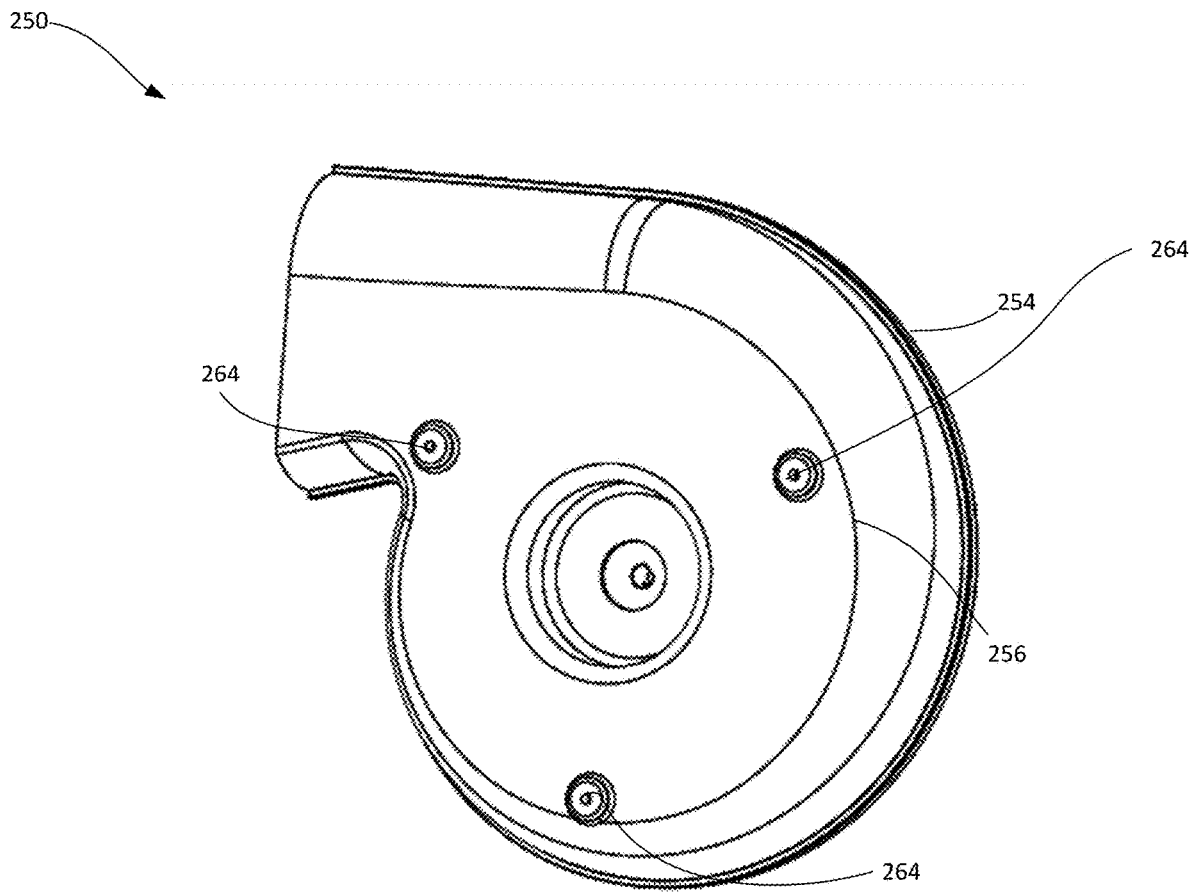
FIG. 67 is a second perspective view of the fan assembly of the exhaust fan assembly shown in FIG. 66.
Figure 68:
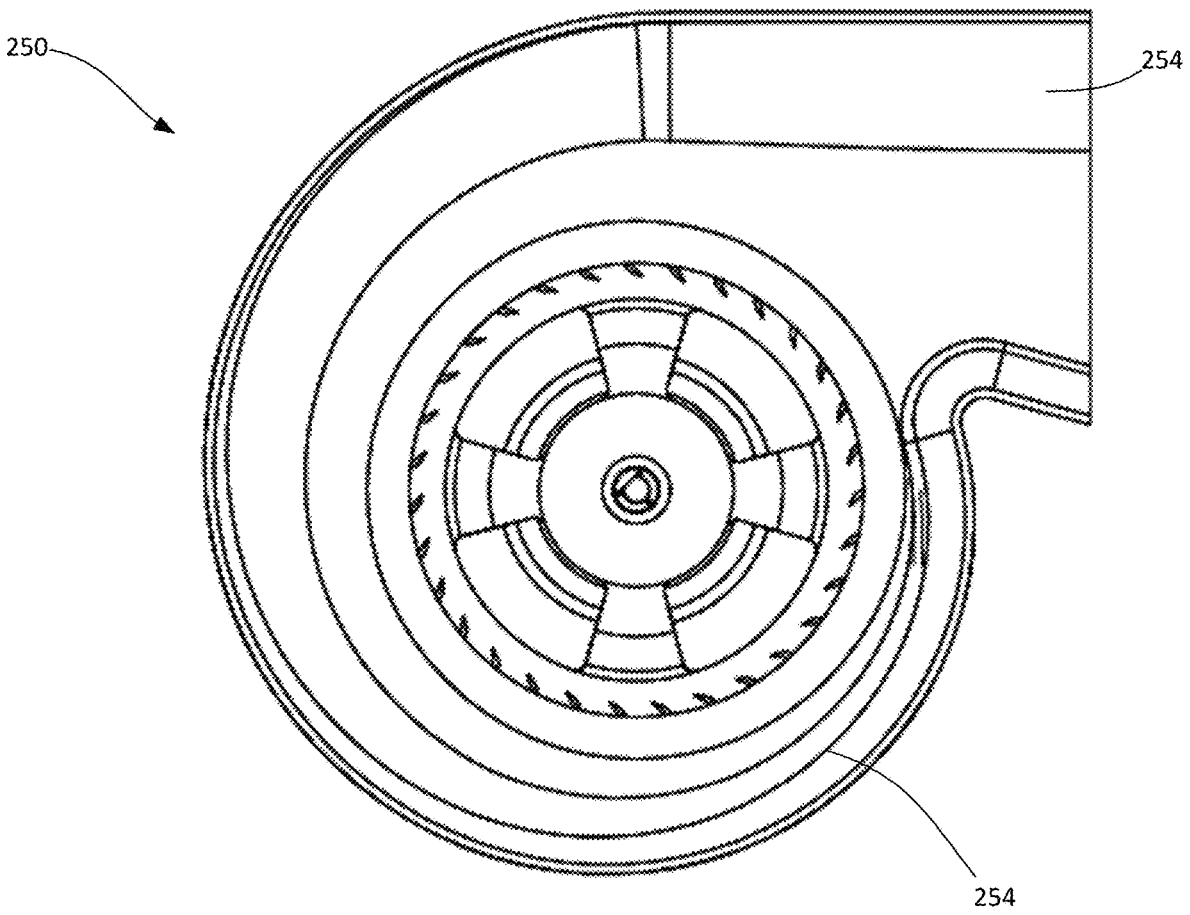
FIG. 68 is a front view of the fan assembly shown in FIG. 66.
Figure 69:
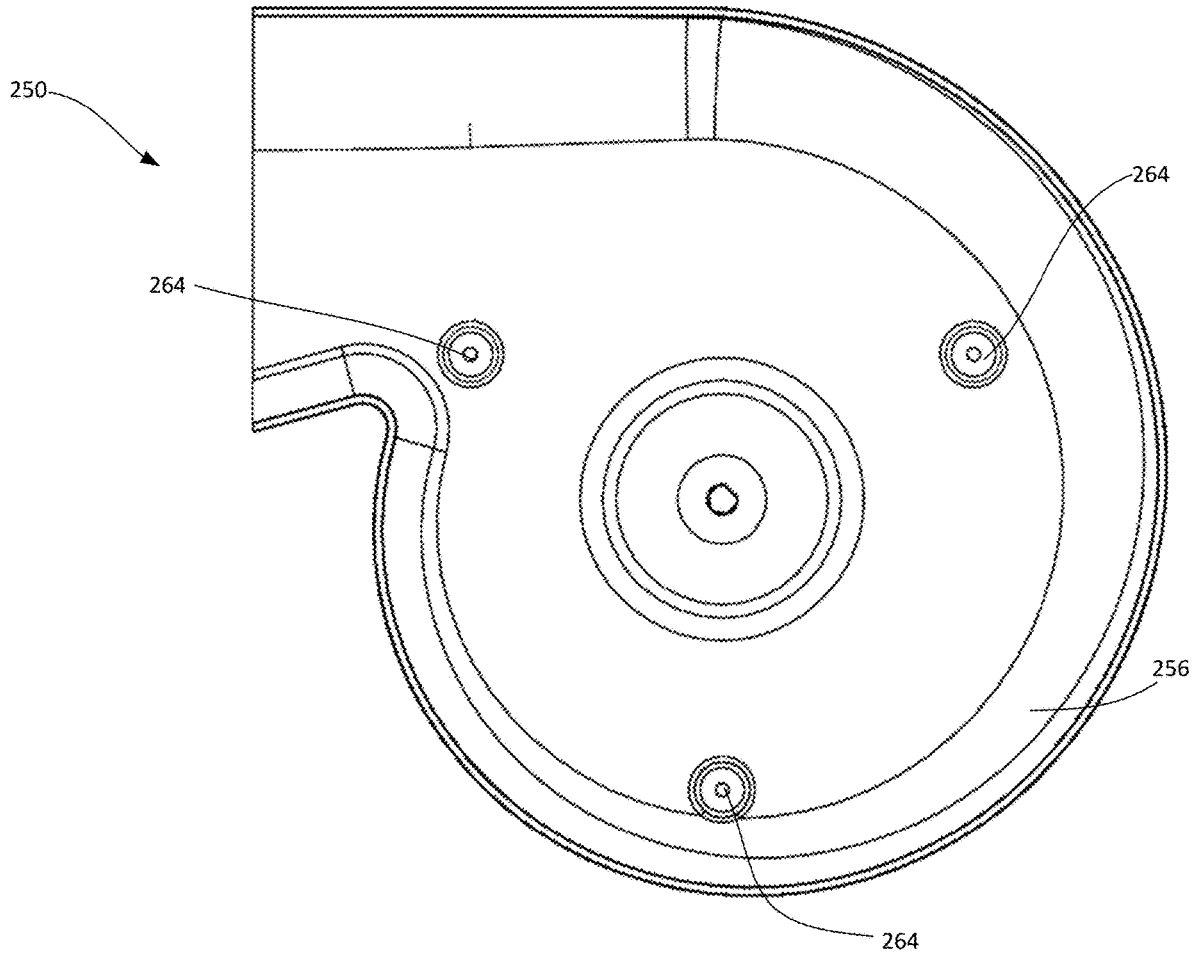
FIG. 69 is a rear view of the fan assembly shown in FIG. 66.
Figure 70:
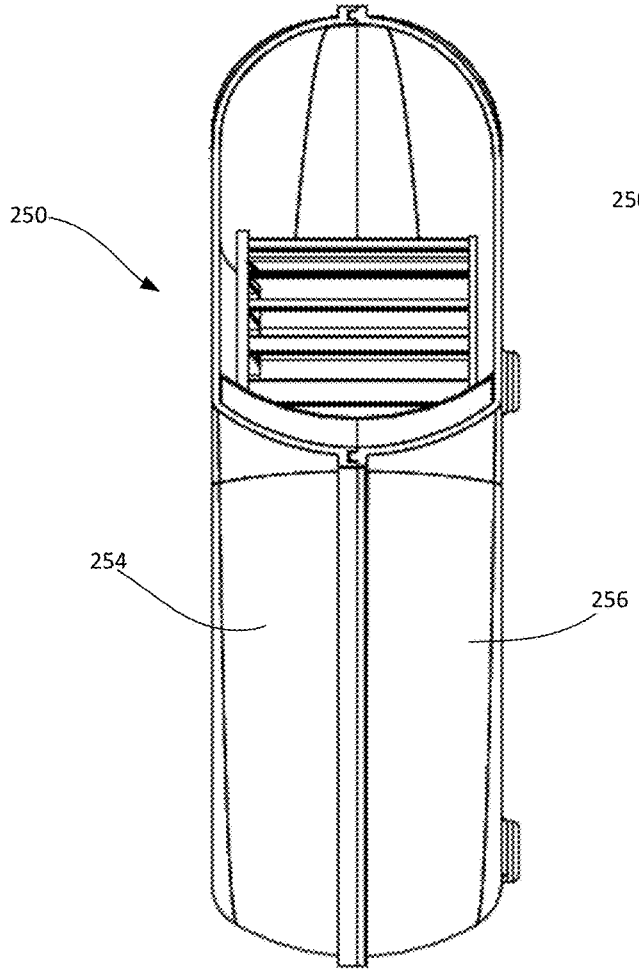
FIG. 70 is a first side view of the fan assembly shown in FIG. 66.
Figure 71:
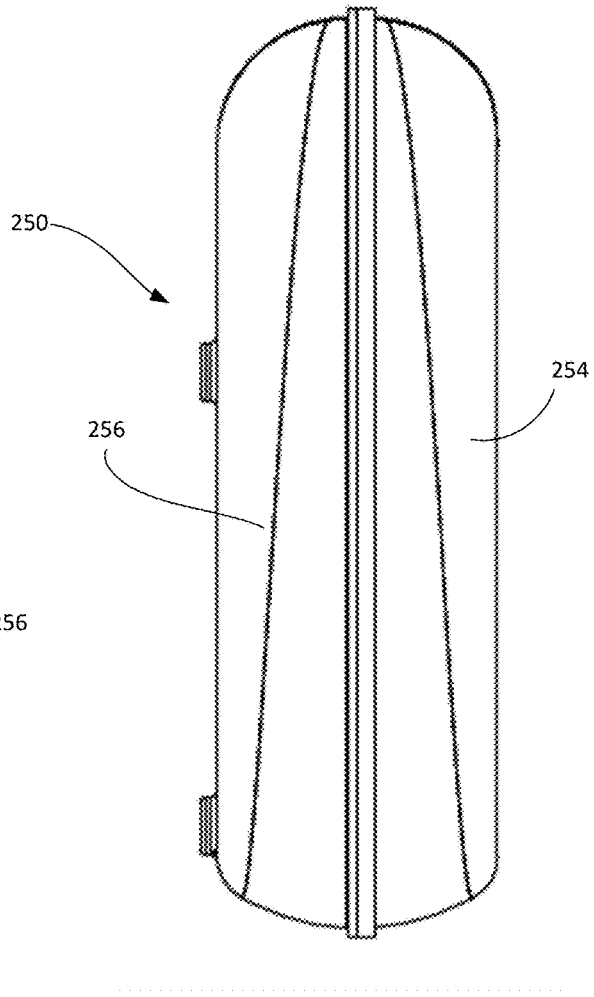
FIG. 71 is a second side view of the fan assembly shown in FIG. 66.
Figure 72:
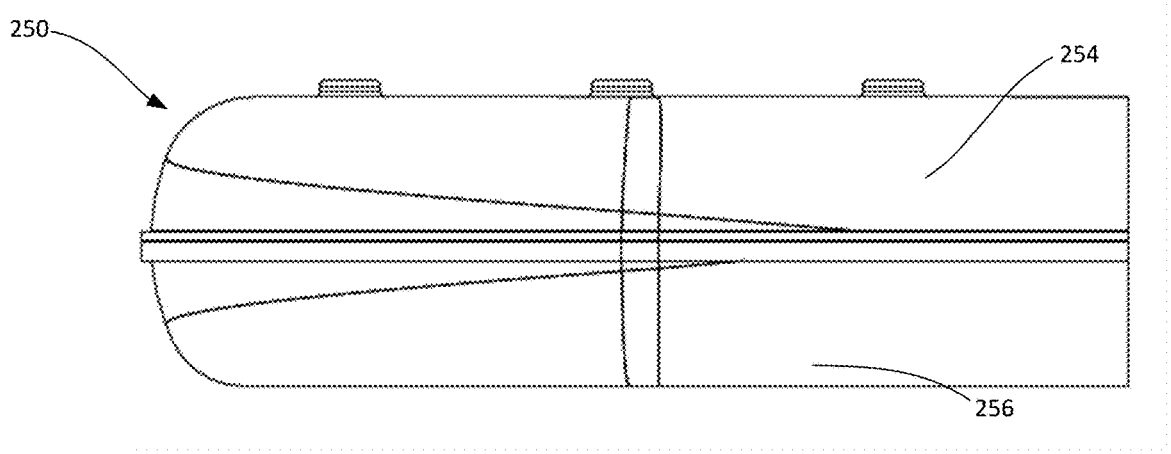
FIG. 72 is a third side view of the fan assembly shown in FIG. 66.
Figure 73:
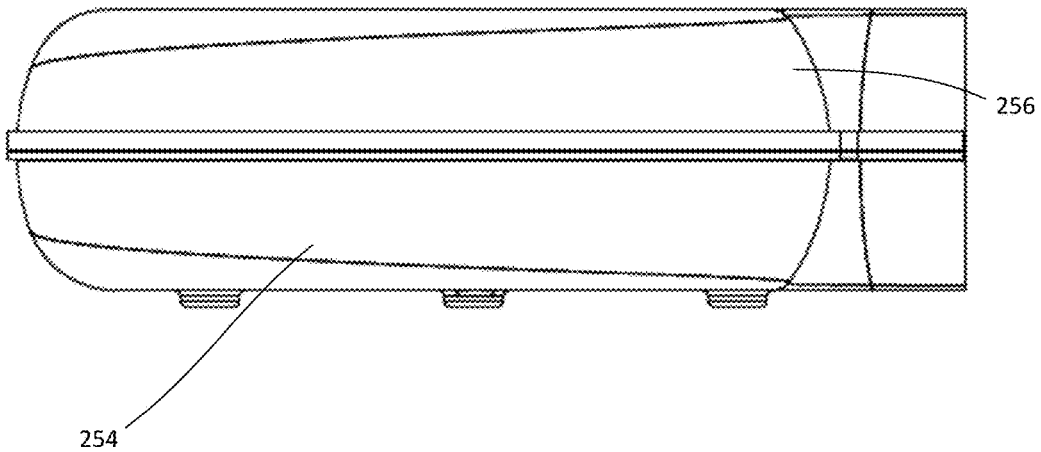
FIG. 73 is a fourth side view of the fan assembly shown in FIG. 66.
Figure 74:
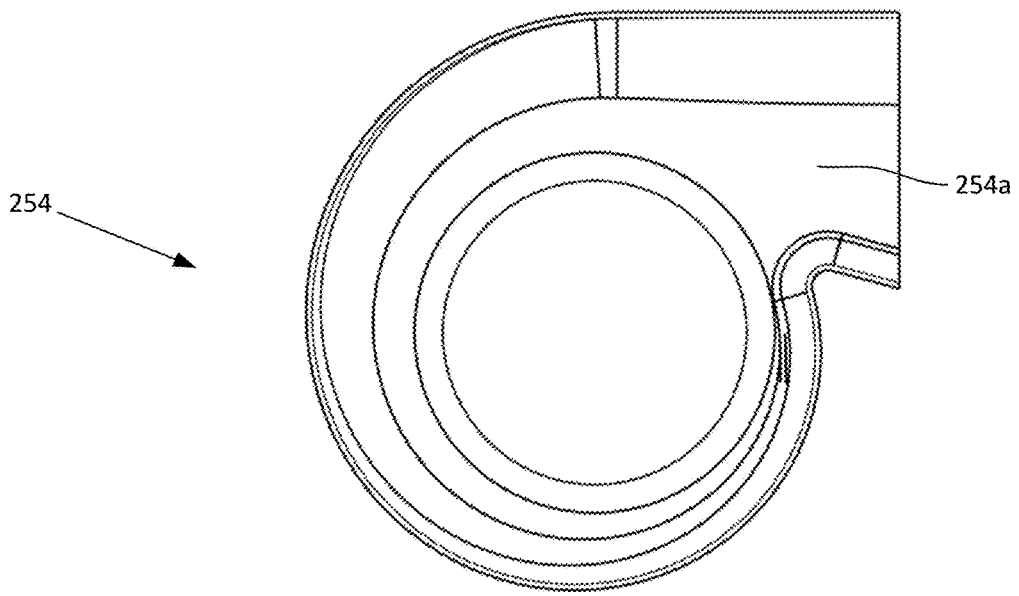
FIG. 74 is a front view of a first housing part of the fan assembly shown in FIG. 54.
Figure 75:
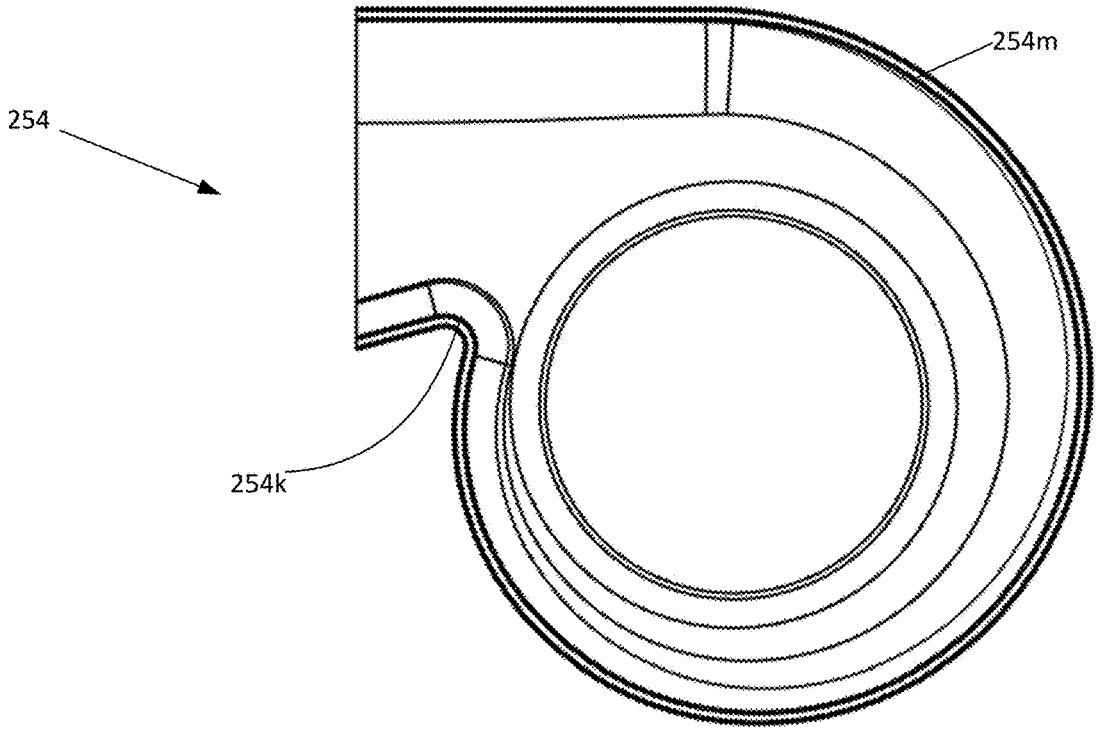
FIG. 75 is a rear view of the first housing part shown in FIG. 74.
Figure 76:
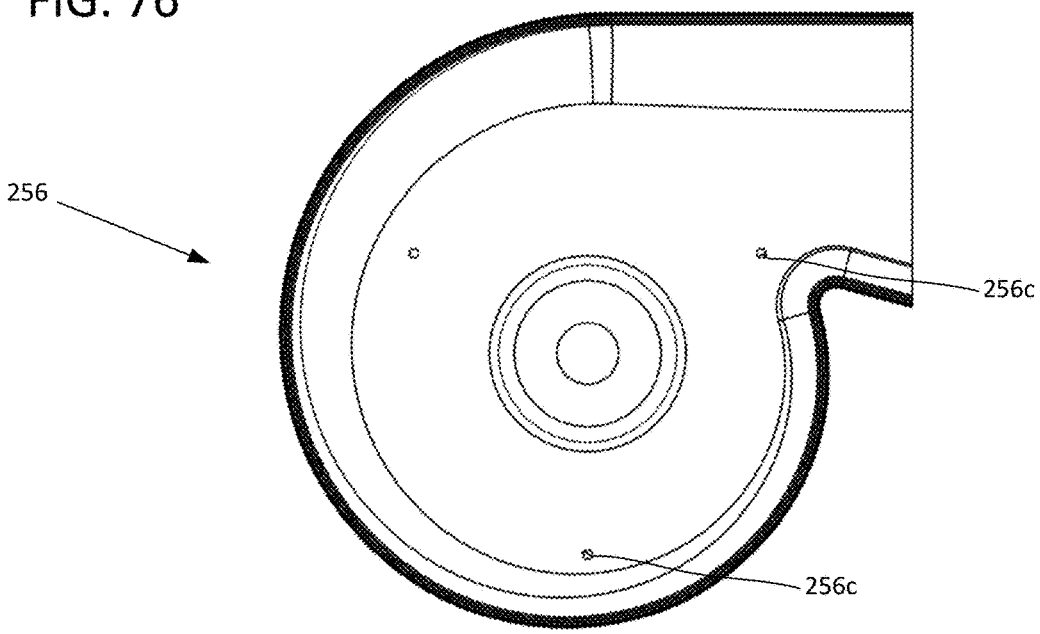
FIG. 76 is a front view of a second housing part of the fan assembly shown in FIG. 54.
Figure 77:
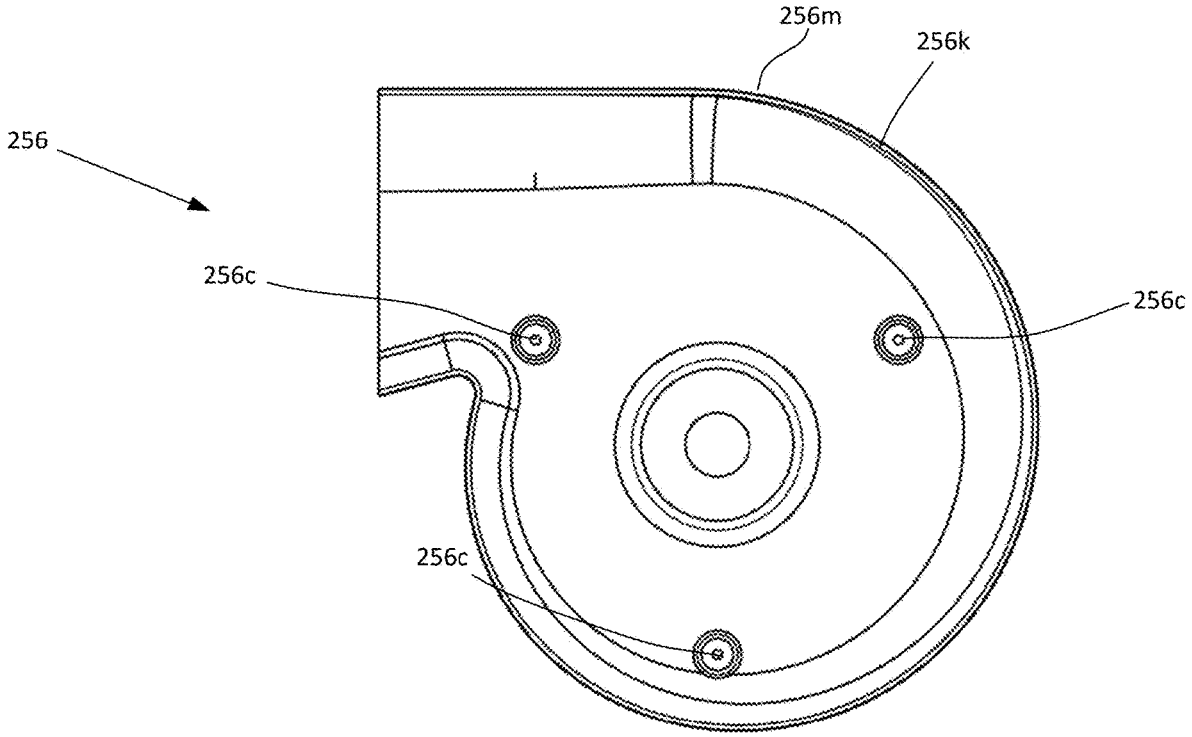
FIG. 77 is a rear view of the first housing part shown in FIG. 76.
Figure 78:
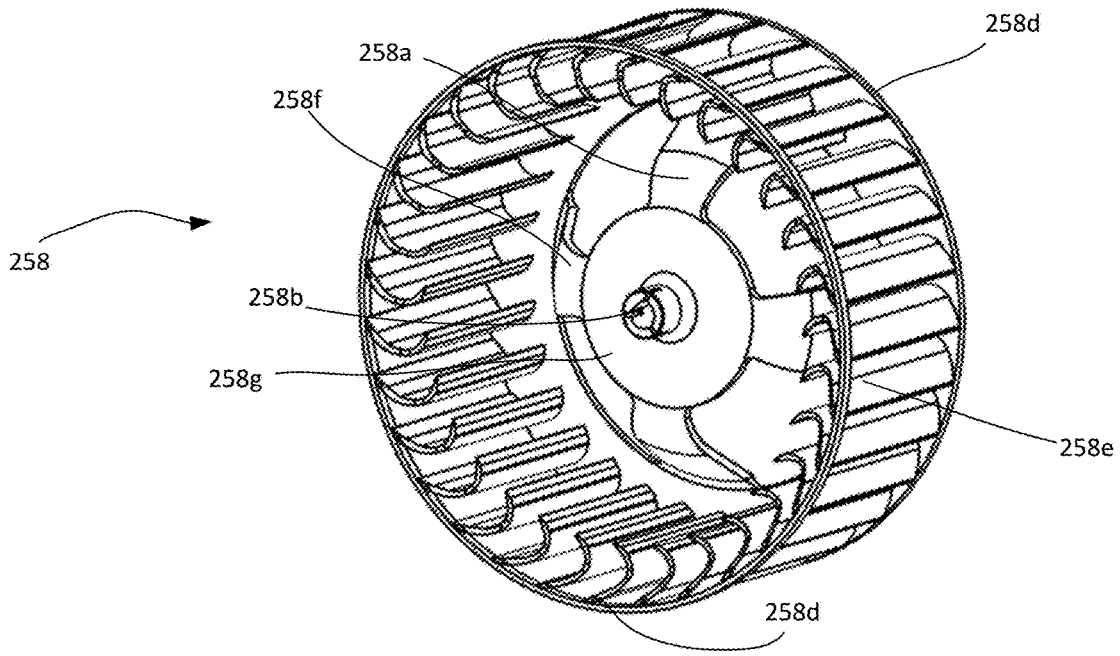
FIG. 78 is a front perspective view of a fan wheel of the fan assembly shown in FIG. 54.
Figure 79:
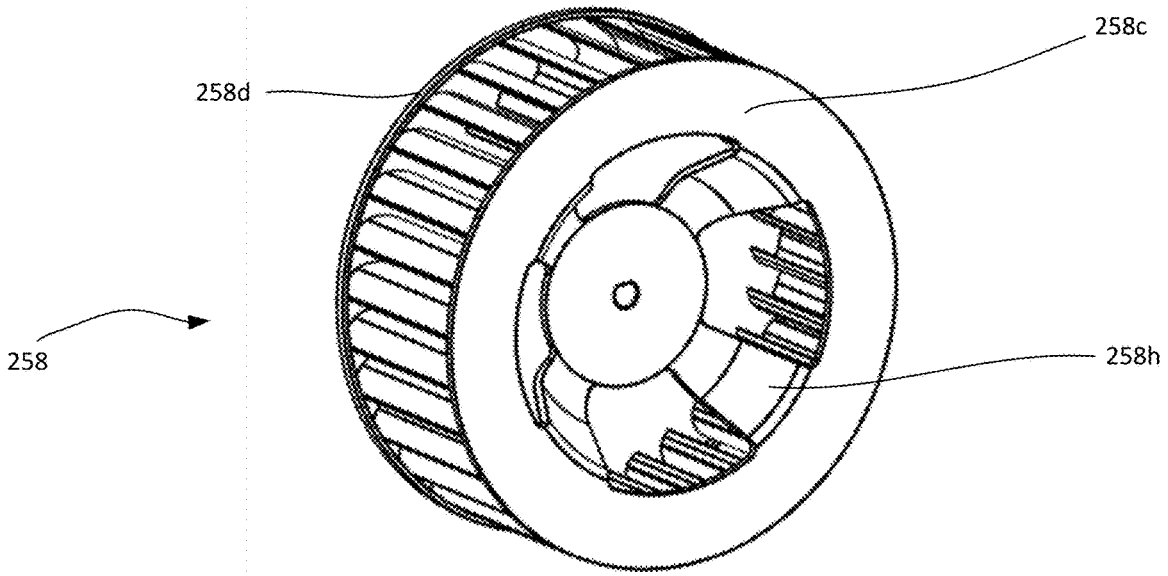
FIG. 79 is a rear perspective view of the fan wheel shown in FIG. 78.
Figure 80:
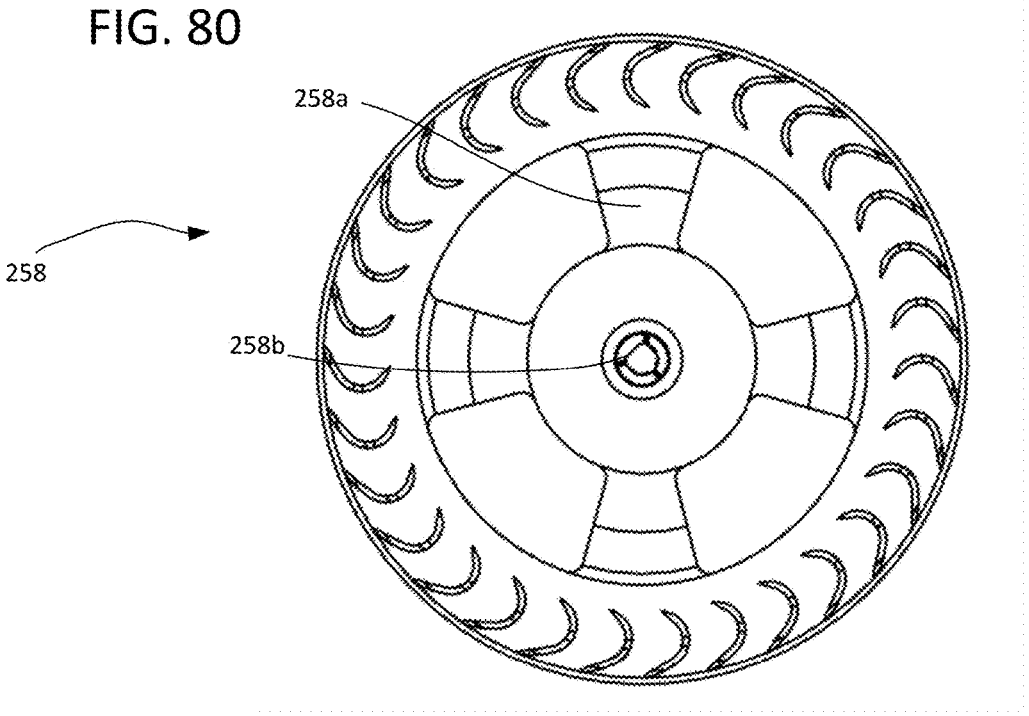
FIG. 80 is a front view of the fan wheel shown in FIG. 78.
Figure 81:
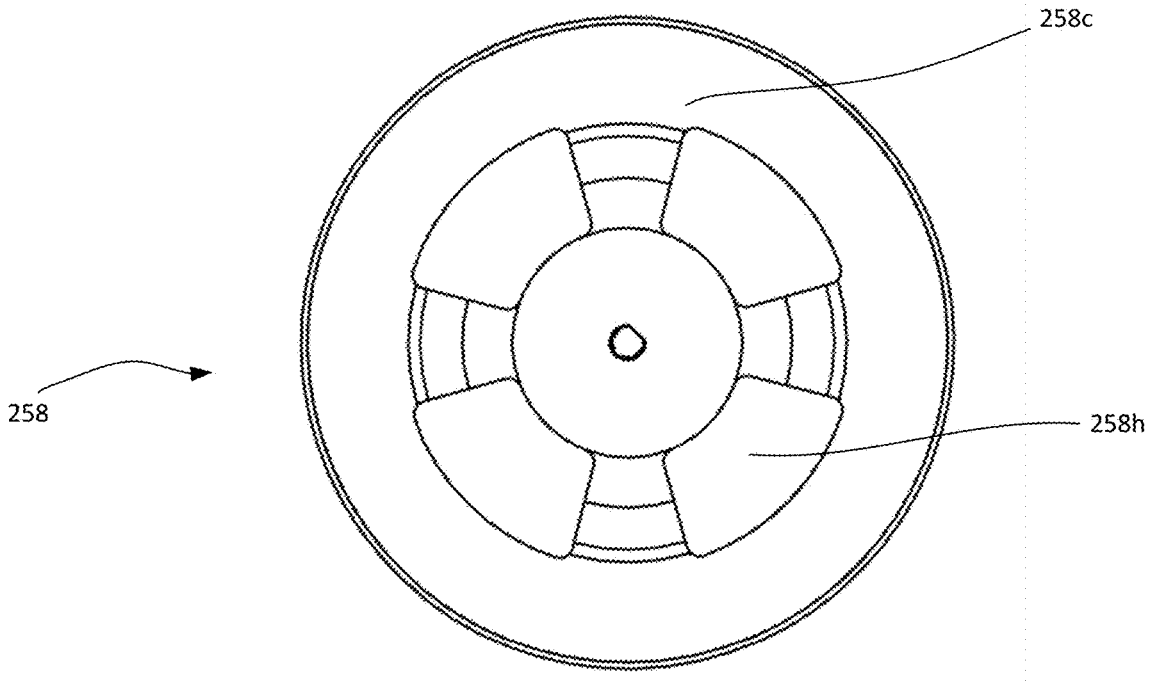
FIG. 81 is a rear view of the fan wheel shown in FIG. 78.
Figure 80:
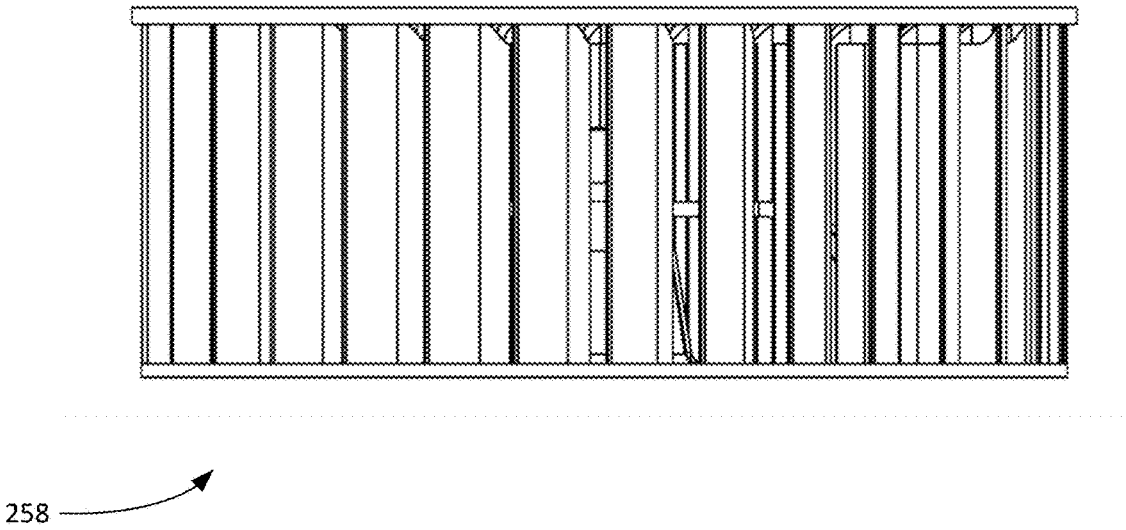
Figure 81:
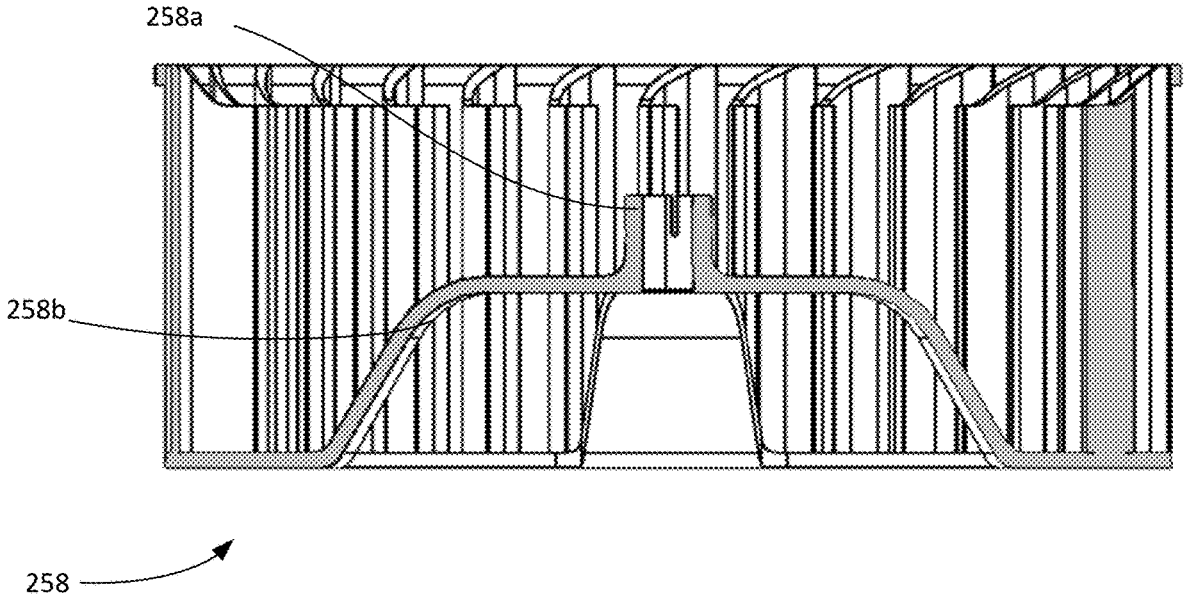
Figure 82:
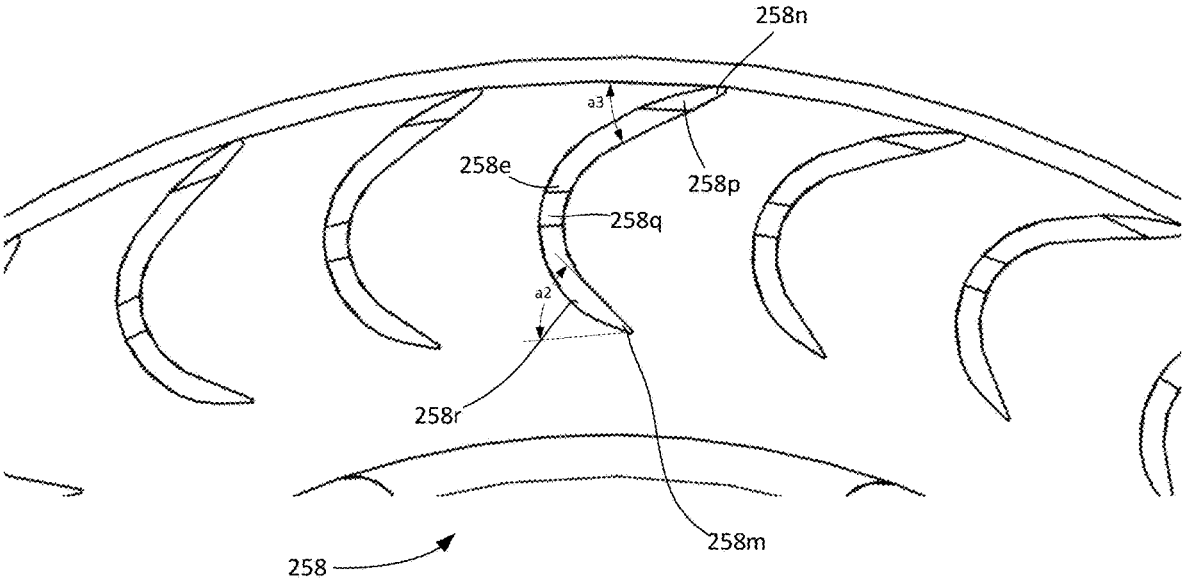
FIG. 82 is a top view of a portion of the fan wheel shown in FIG. 78.
Figure 83:
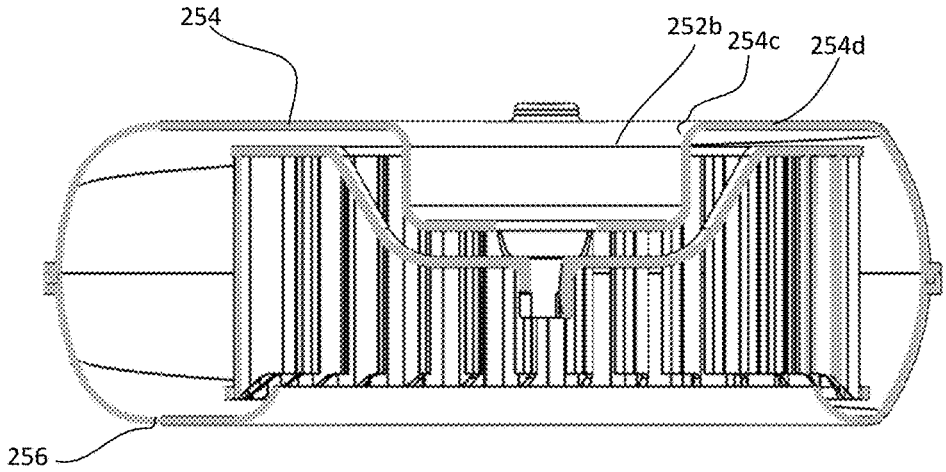
FIG. 83 is a cross-sectional side view of the fan assembly shown in FIG. 54.
Figure 84:
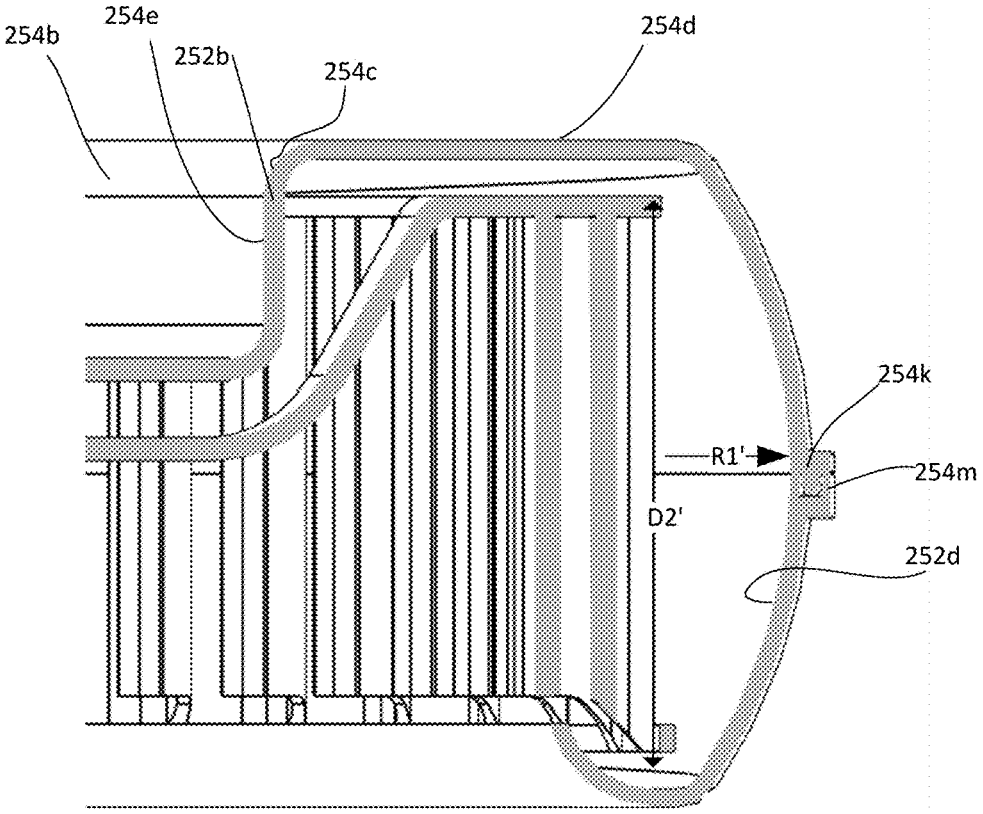
FIG. 84 is a portion of the cross-section view of the fan assembly shown in FIG. 83.

In one aspect, the volute-shaped interior volume 152*a* gradually increases in volume from a tongue portion 152*e* of the housing 152 towards the outlet 152*c*. In one aspect, the tongue portion 152*e* has a radius R3. In the example shown, the radius R3 is about 1.1 inch. The fan wheel 158 is set within the interior volume 152*a* such that the fan wheel 158 is separated a distance D2 from the tongue portion 152*e*, which represents the closest point between the fan wheel 158 and the outer perimeter 152*d* of the housing 152. By creating such a spacing between the tongue portion 152*e* and the fan wheel 150, and in contrast to convention exhaust fan designs, increased efficacy results. In one aspect, the distance D2 is less than a height H2 of the outlet 152*c* which can be, for example, a height H2 of 4.6 inch. With reference to the orientation depicted at FIG. 53, the radius of the outer perimeter 152*d* increases such that the distance between the fan wheel 150 and the outer perimeter 152*d* gradually increases in a clockwise direction from the tongue portion 152*e* to the outlet 152*c*. Such a configuration allows for a relatively high flow rate at a relatively low sound level.

The disclosed features of the exemplary exhaust fan 100 presented herein enable the exhaust fan 100 to be provided with a robust construction, a high operating efficacy, and a low sound output, all while being provided in a form factor allowing for either wall or ceiling installations. Furthermore, testing has shown that the half-piece 154, 156 and latch structure 154*h*, 156*e* design results in a construction able to withstand a 125 pound tensile (pull apart) force.

FIGS. 46 through 50 show the motor 160 in isolation. In the example shown, the motor 160 is a split capacitor motor, as discussed above, meaning that the motor 160 includes a capacitor which is stationary and extends around a rotor. The capacitor is powered via a power source and an electromagnet is created as current flows through the capacitor which causes the rotor to spin. The motor 160 is shown with the shaft 160*a* extending from the center, the shaft 160*a* is connected to the rotor allowing for the shaft 160*a* to spin and drive the fan blade 158. The motor 160 includes a housing 160*b* and an outer flange 160*c*. The motor 160 is additionally shown with the fasteners 166 which are used to mount the motor 160 to the mounting plate 162 attached. This configuration of the motor 160 and the disclosed configuration of the fan wheel 158 advantageously enable for the motor 160 to be located outside of the airflow path.

Referring to FIGS. 54 to 87, an exhaust fan 200 is presented having many of the same features as previously shown and described for exhaust fan 100. For example, the exhaust fan 200 has a fan assembly 250 with a two-part housing having an integral Venturi inlet and a fan wheel 258 that places the motor 260 outside of the airflow path. Additionally, the fan wheel blades 258*e* and the curved volute of the housing 206 remain advantageously configured with optimized shapes and profiles. Accordingly, where features are generally similar, like numbers are used, but in a 200 series rather than a 100 series (i.e. 2XX instead of 1XX). Where features are similar between exhaust fan 100 and exhaust fan 200, the above-presented description is fully applicable and need not be repeated here. Rather, this section will focus on the primary differences presented in exhaust fan 200. It is also noted that exhaust fan 200 is shown in a simplified version and that the additional features shown throughout FIGS. 1 to 53 (e.g. housing 104, electrical power and control at junction box 108, latch structures 154*h*, 156*e*, etc.) shown for exhaust fan 100 are fully implementable with the exhaust fan 200. Conversely, the fan assembly 250 of the exhaust fan 200 can be readily installed within the housing 104 and connected to the junction box 108.

The exhaust fan 200 differs from the exhaust fan 100 primarily in that a high performance DC-type motor 260 is used in fan assembly 250. With such a motor type additional control functions are available such that the fan speed and flow can be actively controlled, for example to provide a constant volume or to perform ASHRAE 62.2 functions wherein airflow is selectively increased and decreased depending upon space occupancy. The motor 260 is also significantly smaller in size in comparison to the AC type motor 160 used in fan assembly 150. Due to this reduced size, the fan wheel 158 and the housing 104 can also be provided with a reduced size. Accordingly, material costs savings of the entire fan assembly 150 can result.

Similar to exhaust fan 100, the opening 204*i* in the housing 204 and the opening 206*b* in the outlet collar are advantageously provided with a rounded or non-rectangular shape. However, in contrast to the exhaust fan 100 housing 104, the opening 204*i* in housing 204 is provided with a concave curved top end and a concave curved bottom end extending between straight sidewalls, wherein the bottom end has a radius of curvature that is greater than that of the top end. This larger curvature at the bottom end enables for a smoother transition between the outlet of the fan housing volute 204 and the outlet collar 206.

In one aspect, the volute-shaped interior volume 252*a* gradually increases in volume from a tongue portion 252*e* of the housing 252 towards the outlet 252*c*. In one aspect, the tongue portion 252*e* has a radius R3. In the example shown, the radius R3' is about than one inch. The fan wheel 158 is set within the interior volume 252*a* such that the fan wheel 258 is separated a distance D2 from the tongue portion 252*e*, which represents the closest point between the fan wheel 258 and the outer perimeter 252*d* of the housing 252. By creating such a spacing between the tongue portion 252*e* and the fan wheel 250, and in contrast to convention exhaust fan designs, increased efficacy results. In one aspect, the distance D2 is less than a height H2 of the outlet 252*c* which can be, for example, a height H2 of 4.6 inch. With reference to the orientation depicted at FIG. 87, the radius of the outer perimeter 252*d* increases such that the distance between the fan wheel 150 and the outer perimeter 252*d* gradually increases in a clockwise direction from the tongue portion 252*e* to the outlet 252*c*. It is additionally noted that the configuration of the tongue 252*e*, by virtue of the angle a4 being less than 90 degrees, results in the outlet of the housing to increase in cross-sectional area in a direction from the tongue portion 252*e* towards the outlet collar 206. This is illustrated at FIG. 87 where it can be seen that the housing volute has a cross-sectional height X1 at the location of the tongue portion 242*e* and a height X2 at the location of the outlet of the housing 204, wherein the height X2 is greater than the height X1. In the example shown, the angle a4 is about 60 degrees and the difference between X1 and X2 is about half an inch. Such a configuration allows for a relatively high flow rate at a relatively low sound level.

Figure 85:
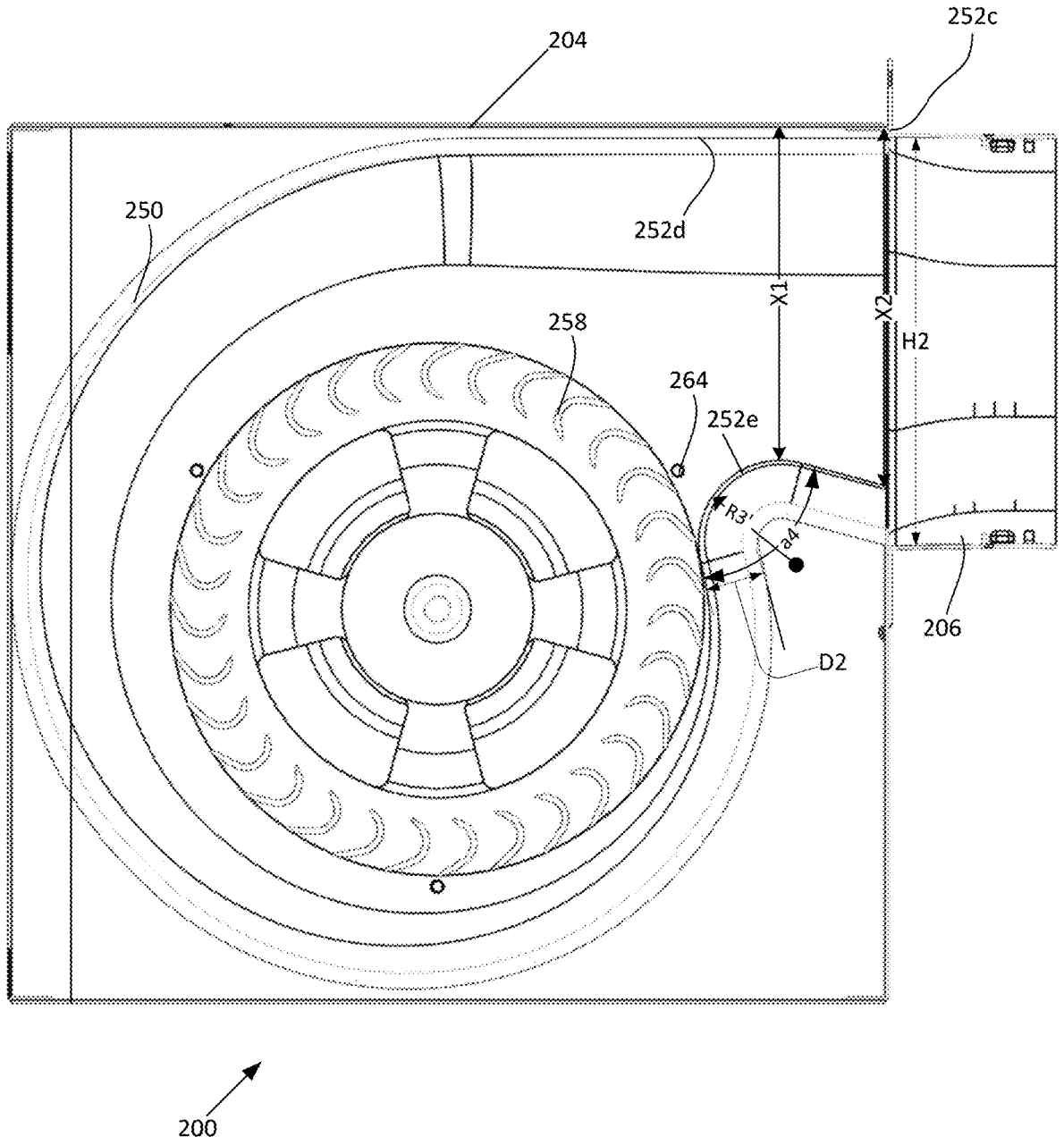
FIG. 85 is a cross-sectional side view of the fan assembly shown in FIG. 54.

In one aspect, the fan housing 252 defines the volute-shaped interior volume 252*a* with an outer perimeter 252*d* having a continuously curved cross-sectional shape, as most easily seen at FIGS. 85 and 86. In contrast to fan housing 152, the outer perimeter 252*d* has a single radius curve with a larger radius R1'. Similar to outer perimeter 152*d*, the outer perimeter 252*d* also provides for improved airflow over typical exhaust fan housings, which generally have rectangular cross-sectional profiles. An outer perimeter 252*d* with a compound curve shape similar to 152*d* is also possible. In some examples, the volute-shaped interior volume 152*a* has a first width D2'. In the example shown, the first width D2 is a constant width. In some examples the width D2' is less than 3.5 inch.

In one aspect, the fan wheel 250 is provided with blades 258*e* having the generally advantageous angles a2, a3 as that provided for blades 158*e* in fan wheel 150, in that angles a2 and a3 for blades 258*e* remain less than 50 degrees and 30 degrees, respectively, and in that the angle between the leading and trailing edges 258*r*, 258*p* is greater than 60 degrees. However, the angle a2 for blade 258 is further decreased and is shown at about 47 degrees with a resulting angle between the leading edge surface 258*r* and the trailing edge surface 258*p* of about 70 degrees.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. An exhaust fan assembly comprising:

a) an outer housing;

b) a fan housing mounted to the outer housing; and c) a fan wheel and an electric motor operably coupled to the fan wheel, the fan wheel and electric motor being mounted within the fan housing;

d) wherein the fan housing defines an open inlet side for accepting airflow in a direction generally parallel to a rotational axis of the fan wheel and an outlet for discharging airflow in a direction generally perpendicular to the rotational axis, wherein the fan housing defines a volute section with two flat sides extending to an outer perimeter having a continuously curved cross-sectional shape in which a central portion of the outer perimeter is curved at a first radius and adjacent side portions of the outer perimeter are curved at a second radius being less than the first radius.

2. The exhaust fan assembly of claim 1, wherein the fan housing outlet defines an outlet collar portion.

3. The exhaust fan assembly of claim 2, wherein a distal end of the outlet collar portion has an elliptical shape.

4. The exhaust fan assembly of claim 2, wherein a backdraft damper is mounted within the outlet collar portion.

5. The exhaust fan assembly of claim 4, wherein the backdraft damper has an outer perimeter with an elliptical shape.

6. The exhaust fan assembly of claim 1, wherein the outer housing has a width of no greater than 4 inches.

7. The exhaust fan assembly of claim 1, wherein the volute section proximate the outlet has an outer perimeter having an oblong or race track shape.

8. The exhaust fan assembly of claim 1, wherein the volute section has a continuously curved tongue portion.

9. The exhaust fan assembly of claim 1, wherein the electric motor is directly mounted to a back wall portion of the fan housing oppositely located from the open inlet side.

10. The exhaust fan assembly of claim 9, wherein the fan wheel includes a fan blade portion and a central hub portion, wherein the central hub portion is mounted to a shaft of the electric motor, wherein the fan wheel further includes a plurality of radially extending arm portions connecting the central portion to the fan blade portion, wherein the electric motor is located between the central portion and the back wall portion such that the fan blade portion and a body of the electric motor are located entirely within the fan housing and such that the central hub portion is located outside of an interior region defined by the fan blade portion.

11. The exhaust fan assembly of claim 1, further comprising an inlet Venturi part mounted to the open inlet side of the fan housing, wherein the inlet Venturi part defines an annulus with an unobstructed central opening.

12. The exhaust fan assembly of claim 1, further including a grill mounted to the outer housing.

13. An exhaust fan assembly comprising:

a) an outer housing;

b) a fan housing mounted within the outer housing and including a first half-piece joined to a second half-piece; and c) a fan wheel and an electric motor operably coupled to the fan wheel, the fan wheel and electric motor being mounted within the fan housing, the fan wheel including a plurality of radially extending arm portions extending between a fan blade portion and a central hub portion mounted to a shaft of the electric motor, wherein the electric motor is directly mounted to the second half-piece such that a body of the electric motor is located between the central hub portion and the second half-piece, such that the fan wheel is located entirely within the fan housing, and such that the central hub portion is located outside of an interior region defined by the fan blade portion;

d) wherein the fan housing defines an open inlet side within the first half-piece for accepting airflow in a direction generally parallel to a rotational axis of the fan wheel and an outlet for discharging airflow in a direction generally perpendicular to the rotational axis, wherein the fan housing defines a volute section with two flat sides extending to an outer perimeter having a continuously curved cross-sectional shape.

14. The exhaust fan assembly of claim 13, wherein the first half-piece is joined to the second half-piece by a snap-fit connection.

15. The exhaust fan assembly of claim 13, wherein the first half-piece includes an integrally formed Venturi-shaped portion that forms the open inlet side.

16. The exhaust fan assembly of claim 13, wherein the first and second half-pieces are joined together at a tongue and groove interface.

17. The exhaust fan assembly of claim 13, wherein the fan wheel defines an inlet air flow region and wherein the electric motor is outside of the inlet air flow region.

18. The exhaust fan assembly of claim 13, wherein the fan wheel includes a plurality of fan blades, each of which includes a leading edge presented at an angle of attack relative to a travel path of the fan blades of no more than 50 degrees.

19. The exhaust fan assembly of claim 18, wherein the plurality of fan blades each have an airfoil shape in which the leading edge tapers to a point.

20. The exhaust fan assembly of claim 13, wherein the cross-sectional shape includes more than one radius of curvature.

* * * * *